United States Patent [19]

Uram

[11] 3,934,128

[45] Jan. 20, 1976

[54] SYSTEM AND METHOD FOR OPERATING A STEAM TURBINE WITH IMPROVED ORGANIZATION OF LOGIC AND OTHER FUNCTIONS IN A SAMPLED DATA CONTROL

[75] Inventor: Robert Uram, East Pittsburgh, Pa.

[73] Assignee: Westinghouse Electric Corporation, Pittsburgh, Pa.

[22] Filed: Oct. 16, 1973

[21] Appl. No.: 407,024

Related U.S. Application Data

[63] Continuation of Ser. No. 247,551, April 26, 1972, abandoned.

[52] U.S. Cl. ..... 235/151.21; 444/1; 290/40; 415/17

[51] Int. Cl... F01d 17/02; G05b 15/00; G06f 15/06

[58] Field of Search..... 235/151.21, 151.34, 151.3, 235/151; 415/17, 15, 13, 1; 60/73, 39, 28 R, 105; 290/40, 40.2, 2; 340/172.5; 444/1

[56] References Cited

UNITED STATES PATENTS

| | | | |
|---|---|---|---|
| 3,552,872 | 1/1971 | Giras et al. | 415/17 |
| 3,555,251 | 1/1971 | Shavit | 235/151 |
| 3,561,216 | 2/1971 | Moore, Jr. | 60/73 |
| 3,564,273 | 2/1971 | Cockrell | 415/17 X |
| 3,588,265 | 6/1971 | Berry | 415/17 X |

OTHER PUBLICATIONS

Application of the Prodac 50 System to Direct Digital Control, J. C. Belz, G. J. Kirk and P. S. Radcliffe, IEEE Intl. Conv. Rec. Part 3, 1965, pp. 102–122.

Monitoring and Automatic Control in Steam Power Stations by Process Computer, E. Doetsch and G. Hirschberg, Siemens Review XXXV(1968) No. 12, pp. 471–476.

*Primary Examiner*—Felix D. Gruber
*Assistant Examiner*—Edward J. Wise
*Attorney, Agent, or Firm*—E. F. Possessky

[57] ABSTRACT

The throttle and governor valves of a steam turbine are operated by a digital computer control system to provide speed and load control for the turbine. The computer includes a speed and load control which periodically generates control outputs and a separate logic control which responds to panel and contact inputs to generate logicals which structure the speed and load control. An analog scan periodically enters feedback parameters into the computer for use by the controls. An input contacts scan enters feedback logicals into the computer on demand, or under certain conditions periodically. A monitor operates with an auxiliary synchronizer to control the execution of the scans and the controls. The speed and load controls are bid for execution once each second to generate the control outputs which are applied to an external electrohydraulic control for the valves. The analog scan is bid for execution once each half second and the logic control is bid for execution on demand for performance of a logic function. The auxiliary synchronizer is bid for execution once each tenth of a second. The monitor controls the execution with a priority order of auxiliary synchronizer, speed and load control, analog scan and logic control. Certain logic and controller functions are performed commonly by a single programmed element as needed at different points in time by multiple parts of the controls.

16 Claims, 47 Drawing Figures

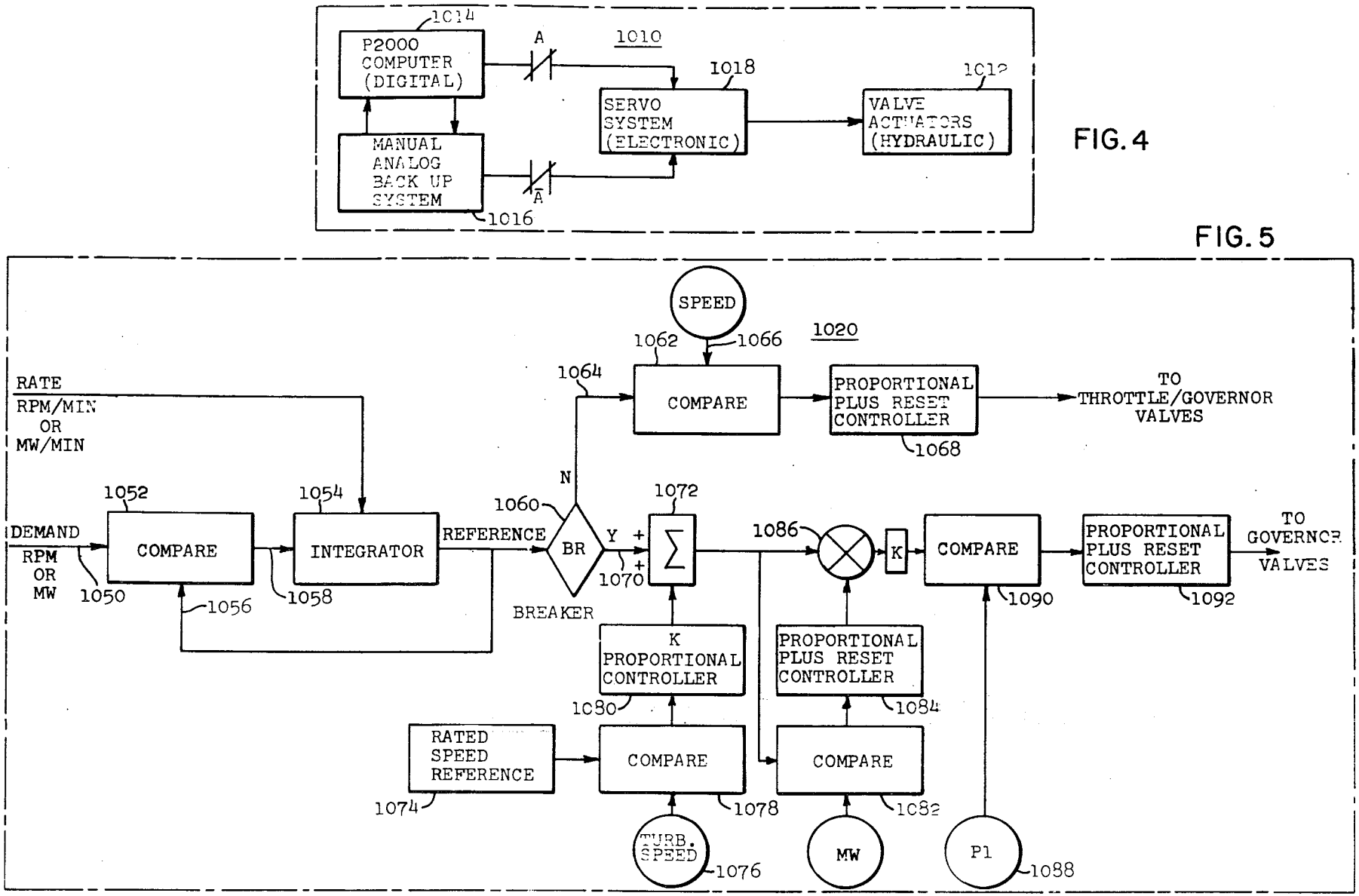
FIG. 4
FIG. 5
1010
1014
P2000 COMPUTER (DIGITAL)
MANUAL ANALOG BACK UP SYSTEM
1016
A
A
1018
SERVO SYSTEM (ELECTRONIC)
1012
VALVE ACTUATORS (HYDRAULIC)
1020
SPEED
1066
1062
COMPARE
1064
PROPORTIONAL PLUS RESET CONTROLLER
1068
TO THROTTLE/GOVERNOR VALVES
N
BR
Y
1060
REFERENCE
1070
1072
1086
K
COMPARE
1090
PROPORTIONAL PLUS RESET CONTROLLER
1092
TO GOVERNOR VALVES
BREAKER
K PROPORTIONAL CONTROLLER
1080
PROPORTIONAL PLUS RESET CONTROLLER
1084
COMPARE
1082
P1
1088
MW
COMPARE
1078
TURB. SPEED
1076
RATED SPEED REFERENCE
1074
INTEGRATOR
1054
1058
COMPARE
1052
1056
1050
RATE
RPM/MIN OR MW/MIN
DEMAND
RPM OR MW

TABLE 1-1. TASK PRIORITY ASSIGNMENT

FIG. 7

| Level | Function | Frequency | Core Location |
|---|---|---|---|
| F | STOP/INITIALIZE | ON DEMAND | 2F40 |
| E | AUXILIARY SYNCHRONIZER | 0.1 SEC | 14BD |
| D | CONTROL | 1.0 SEC | 2730 |
| C | OPERATOR'S PANEL | ON DEMAND | 21B0 |
| B | ANALOG SCAN | 0.5 SEC | 16D0 |
| A | ATS-PERIODICS | 1.0 SEC | 4420 |
| 9 | LOGIC | ON DEMAND | 1962 |
| 8 | VISUAL DISPLAY | 1.0 SEC | 1E60 |
| 7 | DATA LINK | ON DEMAND | 3D10 |
| 6 | ATS-ANALOG CONVERSIONS | 5.0 SEC | 6960 |
| 5 | FLASH | 0.5 SEC | 15A0 |
| 4 | PROGRAMMER'S CONSOLE | ON DEMAND | 3000 |
| 3 | ATS-MESSAGE WRITER | 5.0 SEC | 6CA0 |
| 2 | ANALOG/DIGITAL TREND | 1.0 SEC | 3E70 |
| 1 | CCO TEST* | ON DEMAND | 0E80 |
| 0 | BATCH PROCESSORS** | ON DEMAND | 4000 |

*The CCO test task may be used only during maintenance and debugging periods, since this program overlays the data link program area.

**The batch processors may be used only on manual control and with the sync disabled; also, the sequence of events interrupt must be disabled since the batch processor programs overlay the ATS program area.

TABLE 1-2. CORE MAP 1—FINAL OPERATING VERSION

FIG. 8

| Starting Location | Program | Size | |
|---|---|---|---|
| | | Dec | Hex |
| 0 | FAM FAST ACCESS MEMORY | 32 | 20 |
| 20 | SEQUENCE OF EVENTS INTERRUPT | 32 | 20 |
| 40 | VALVE INTERRUPT | 96 | 60 |
| A0 | ZERO TABLE | 96 | 60 |
| 100 | SRI TABLE | 32 | 20 |
| 120 | PLANTCCI SUBROUTINE | 120 | 78 |
| 198 | SPEED CHANNEL 1 INTERRUPT | 47 | 2F |
| 1C7 | SPEED CHANNEL 2 INTERRUPT | 25 | 19 |
| 1E0 | CCO IMAGE TABLE | 32 | 20 |
| 200 | MONITOR | 3162 | C5A |
| E5A | MONITOR PATCHES | 6 | 6 |
| E60 | MONITOR SPARE | 32 | 20 |
| E80 | DATA LINK-SPARE TERMINAL | 16 | 10 |
| E92 | DATA LINK-DT INTERRUPT | 40 | 28 |
| EBA | DATA LINK-CONTROL WORDS | 10 | A |
| EC4 | DATA LINK-INPUT BUFFER | 10 | A |
| ECE | DATA LINK-OUTPUT BUFFER | 50 | 32 |
| F00 | SYSTEM LIBRARY | 618 | 26A |
| 116A | BREAKER OPEN INTERRUPT | 22 | 16 |

REFDMD
SPEED FEEDBACK LOOP
REF1
X
Y
REF2
GR3
PISP
IPI
N
Y
RESPI
VSP
PI
1876

REFDMD
SPEED FEEDBACK LOOP
REF1
X
MWI
N
Y
1087
1086
REF2
1089
RESMW
1084
1082
MW
1091

SYSTEM AND METHOD FOR OPERATING A STEAM TURBINE WITH IMPROVED ORGANIZATION OF LOGIC AND OTHER FUNCTIONS IN A SAMPLED DATA CONTROL

This is a continuation of application Ser. No. 247,551 filed Apr. 26, 1972, now abandoned.

CROSS-REFERENCE TO RELATED APPLICATIONS

1. Ser. No. 722,779, entitled "Improved System and Method for Operating a Steam Turbine and an Electric Power Generating Plant" filed by Theodore C. Giras and Manfred Birnbaum on Apr. 4, 1968, assigned to the present assignee, and continued as Ser. No. 124,993 on Mar. 16, 1971, and Ser. No. 319,115, on Dec. 29, 1972.

2. Ser. No. 408,962, entitled "System and Method for Starting, Synchronizing and Operating a Steam Turbine with Digital Computer Control" filed as a continuation of Ser. No. 247,877 which had been filed by Theodore C. Giras and Robert Uram on Apr. 26, 1972 and assigned to the present assignee and hereby incorporated by reference; other related cases are set forth in Ser. No. 408,962.

BACKGROUND OF THE INVENTION

The present invention relates to steam turbine operating systems and more particularly to sampled data turbine control systems which are organized to provide more efficient and more flexible turbine operation.

In Ser. No. 319,115, there is generally disclosed a prior sampled data digital computer control system for steam turbines in electric power plants. In Ser. No. 408,962, there is disclosed a detailed computer embodiment of a sampled data turbine control system. The present application has a disclosure like the latter patent application, and it is directed to certain features related to structural organization of a sampled data control system not specifically disclosure in Ser. No. 319,115 and not within the scope of Ser. No. 408,962.

The description of prior art herein is made on good faith and no representation is made that any prior art considered is the best pertaining prior art nor that the interpretation placed on it is unrebuttable.

SUMMARY OF THE INVENTION

A system for operating a steam turbine includes an arrangement of throttle and governor valves and means for actuating the valves in accordance with valve position signals. A digital controller is provided for the turbine and means are provided for coupling turbine speed and load signals periodically to speed and load controls in the digital controller to generate periodically valve position outputs for turbine speed and load control. Means are provided for scanning contact signal inputs and turbine variable signal inputs for registration in the digital controller. Preferably, a separate logic control is provided for generating mode control outputs in response to the signal inputs to the digital controller, and the mode control outputs are applied to the speed and load controls to provide for switching control elements in and out of the latter. The digital controller further includes means for generating synchronous outputs for triggering the operation of the speed and load controls on a periodic basis.

BRIEF DESCRIPTION OF THE DRAWINGS

FIG. 4 shows a simplified block diagram of the digital Electro Hydraulic Control System in accordance with the principle of the invention;

FIG. 5 shows a block diagram of a control program used in accordance with the principles of the invention;

FIG. 7 shows a table of program or task priority assignments in accordance with the principles of the invention;

FIG. 8 shows the location of subroutines in accordance with the principles of the invention;

DESCRIPTION OF THE PREFERRED EMBODIMENT

A. POWER PLANT

Figure 1:
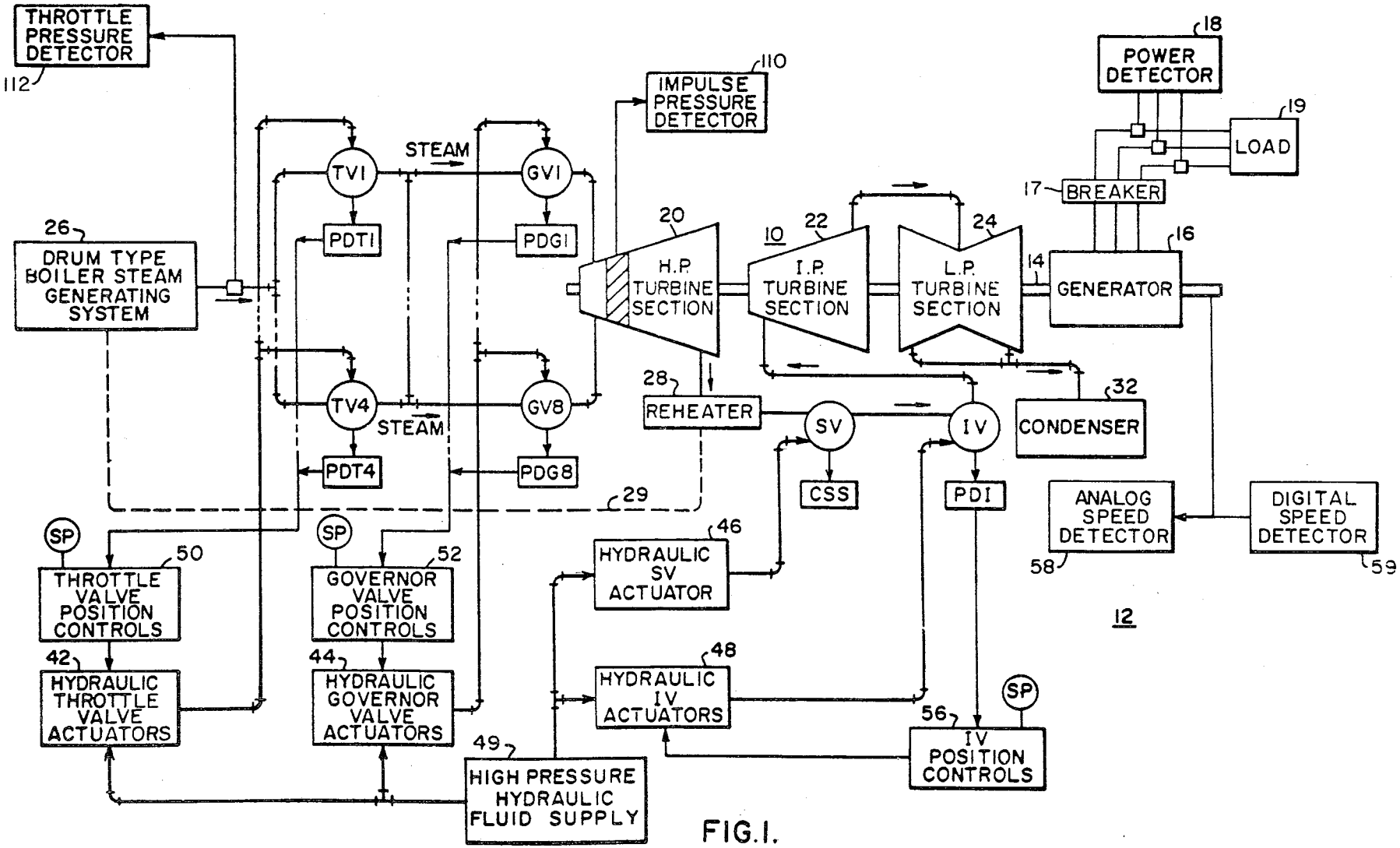
FIG. 1 shows a schematic diagram on an electric power plant including a large steam turbine and a fossile fuel fired drum type boiler and control devices which are all operable in accordance with the principles of the invention.
Figure 2:
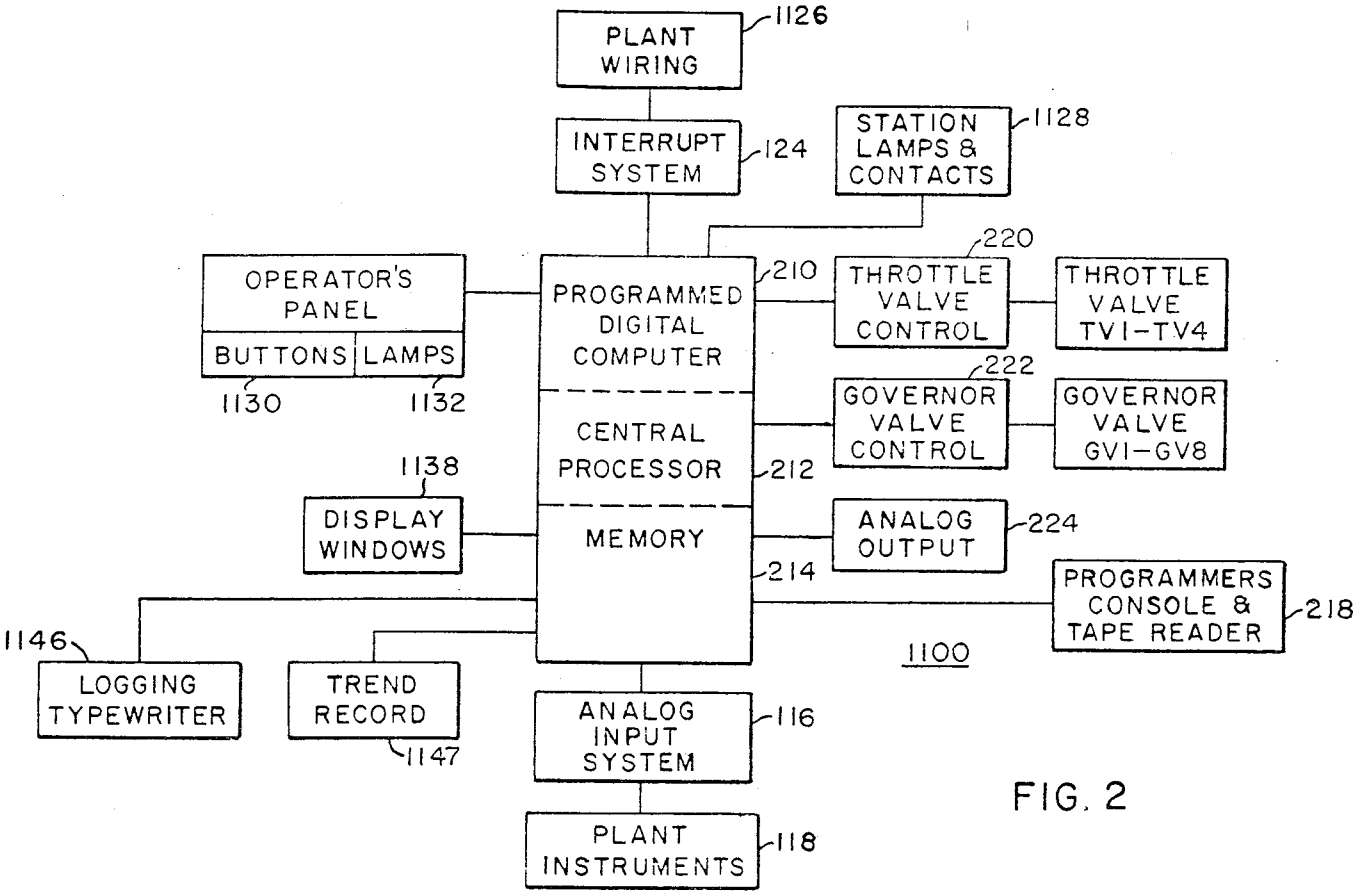
FIG. 2 shows a schematic diagram on a programmed digital computer control system operable with a steam turbine and its associated devices shown in FIG. 1 in accordance with the principles of the invention.

More specifically, there is shown in FIG. 1 a large single reheat steam turbine constructed in a well known manner and operated and controlled in an electric power plant 12 in accordance with the principles of the invention. As will become more evident through this description, other types of steam turbines can also be controlled in accordance with the principles of the invention and particularly in accordance with the broader aspects of the invention. The generalized electric power plant shown in FIG. 1 and the more general aspects of the computer control system to be described in connection with FIG. 2 are like those disclosed in the aforementioned Giras and Birnbaum patent application Ser. No. 319,115. As already indicated, the present application is directed to general improvements in turbine operation and control as well as more specific improvements related to digital computer operation and control of turbines.

The turbine 10 is provided with a single output shaft 14 which drives a conventional large alternating current generator 16 to produce three-phase electric power (or any other phase electric power) as measured by a conventional power detector 18 which measures the rate of flow of electric energy. Typically, the generator 16 is connected through one or more breakers 17 per phase to a large electric power network and when so connected causes the turbo-generator arrangement to operate at synchronous speed under steady state conditions. Under transient electric load change conditions, system frequency may be affected and conforming turbo-generator speed changes would result. At synchronism, power contribution of the generator 16 to the network is normally determined by the turbine steam flow which in this instance is supplied to the turbine 10 at substantially constant throttle pressure.

In this case, the turbine 10 is of the multistage axial flow type and includes a high pressure section 20, an intermediate pressure section 22, and a low pressure section 24. Each of these turbine sections may include a plurality of expansion stages provided by stationary vanes and an interacting bladed rotor connected to the shaft 14. In other applications, turbines operating in accordance with the present invention may have other forms with more or fewer sections tandemly connected to one shaft or compoundly coupled to more than one shaft.

The constant throttle pressure steam for driving the turbine 10 is developed by a steam generating system 26 which is provided in the form of a conventional drum type boiler operated by fossil fuel such as pulverized coal or natural gas. From a generalized standpoint, the present invention can also be applied to steam turbines associated with other types of steam generating systems such as nuclear reactor or once through boiler systems.

The turbine 10 in this instance is of the plural inlet front end type, and steam flow is accordingly directed to the turbine steam chest (not specifically indicated) through four throttle inlet valves TV1-TV4. Generally, the plural inlet type and other front end turbine types such as the single ended type or the end bar lift type may involve different numbers and/or arrangements of valves.

Steam is directed from the admission steam chest to the first high pressure section expansion stage through eight governor inlet valves GV1-GV8 which are arranged to supply steam to inlets arcuately spaced about the turbine high pressure casing to constitute a somewhat typical governor valving arrangement for large fossil fuel turbines. Nuclear turbines might on the other hand typically utilize only four governor valves.

During start-up, the governor valves GV1-GV8 are typically all fully opened and steam flow control is provided by a full arc throttle valve operation. At some point in the start-up process, transfer is made from full arc throttle valve control to full arc governor valve control because of throttling energy losses and/or throttling control capability. Upon transfer the throttle valves TV1 TV4 are fully opened, and the governor valves GV1-GV8 are normally operated in the single valve mode. Subsequently, the governor valves may be individually operated in a predetermined sequence usually directed to achieving thermal balance on the rotor and reduced rotor blade stressing while producing the desired turbine speed and/or load operating level. For example, in a typical governor valve control mode, governor valves GV5-GV8 may be initially closed as the governor valves GV1-GV4 are jointly operated from time to time to define positions producing the desired corresponding total steam flows. After the governor valves GV1-GV4 have reached the end of their control region, i.e., upon being fully opened, or at some overlap point prior to reaching the fully opened position, the remaining governor valves GV5-GV8 are sequentially placed in operation in numerical order to produce continued steam flow control at higher steam flow levels. This governor valve sequence of operation is based on the assumption that the governor valve controlled inlets are arcuately spaced about the 360° periphery of the turbine high pressure casing and that they are numbered consecutively around the periphery so that the inlets corresponding to the governor valves GV1 and GV8 are arcuately adjacent to each other.

After the steam has crossed past the first stage impulse blading to the first stage reaction blading of the high pressure section, it is directed to a reheater system 28 which is associated with a boiler or steam generating system 26. In practice, the reheater system 28 may typically include a pair of parallel connected reheaters coupled to the boiler 26 in heat transfer relation as indicated by the reference character 29 and associated with opposite sides of the turbine casing.

With a raised enthalpy level, the reheated steam flows from the reheater system 28 through the intermediate pressure turbine section 22 and the low pressure turbine section 24. From the latter, the vitiated steam is exhausted to a condenser 32 from which water flow is directed (not indicated) back to the boiler 26.

Respective hydraulically operated throttle valve actuators indicated by the reference character 42 are provided for the four throttle valves TV1-TV4. Similarly, respective hydraulically operated governor valve actuators indicated by the reference character 44 are provided for the eight governor valves GV1-GV8. Hydraulically operated actuators indicated by the reference characters 46 and 48 are provided for the reheat stop and interceptor valves SV and IV. A computer monitored high pressure fluid supply 50 provides for controlling fluid actuator operation of the valves TV1-TV4, GV1-GV8, SV and IV. A computer supervised lubricating oil system (not shown) is separately provided for turbine plant lubricating requirements.

The respective actuators 42, 44, 46 and 48 are of conventional construction, and the inlet valve actuators 42 and 44 are operated by respective stabilizing position controls indicated by the reference characters 50 and 52. If desired, the interceptor valve actuators 48 can also be operated by a position control 56 although such control is not employed in the present detailed embodiment of the invention. Each position control includes a conventional analog controller (not shown in FIG. 1) which drives a suitably known actuator servo valve (not indicated) in the well known manner. The reheat stop valve actuators 46 are fully open unless the conventional trip system or other operating means causes them to close and stops the reheat steam flow.

Since the turbine power is proportional to steam flow under the assumed control condition of substantially constant throttle pressure, steam valve positions are controlled to produce control over steam flow as an intermediate variable and over turbine speed and/or load as an end control variable or variables. Actuator operation provides the steam valve positioning, and respective valve position detectors PDT1-PDT4, PDG1-PDG8 and PDI are provided to generate respective valve position feedback signals for developing position error signals to be applied to the respective position controls 50, 52 and 56. One or more contact sensors CSS provides status data for the stop valving SV. The position detectors are provided in suitable conventional form, for example, they may make conventional use of linear variable differential transformer operation in generating negative position feedback signals for algebraic summing with respect to position setpoint signals SP in developing the respective input error signals. Position controlled operation of the interceptor valving IV would typically be provided only under a reheat steam flow cutback requirement.

A speed detector 58 is provided for determining the turbine shaft speed for speed control and for frequency participation control purposes. The speed detector 58 can for example be in the form of a reluctance pickup (not shown) magnetically coupled to a notched wheel (not shown) on the turbo-generator shaft 14. In the detailed embodiment subsequently described herein, a plurality of sensors are employed for speed detection. Analog and/or pulse signals produced by the speed detector 58, the electric power detector 18, the pressure detectors 38 and 40, the valve position detectors PDT1-PDT4, PDG1-PDG8 and PDI, the status contact or contacts CSS, and other sensors (not shown) and status contacts (not shown) are employed in programmed computer operation of the turbine 10 for various purposes including controlling turbine performance on an on-line real time basis and further including monitoring, sequencing, supervising, alarming, displaying and logging.

B. DEH - COMPUTER CONTROL SYSTEM

As generally illustrated in FIG. 2, a Digital Electro-Hydraulic control system (DEH) 1100 includes a programmed digital computer 210 to operate the turbine 10 and the plant 12 with improved performance and operating characteristics. The computer 210 can include conventional hardware including a central processor 212 and a memory 214. The digital computer 210 and its associated input/output interfacing equipment is a suitable digital computer system such as that sold by Westinghouse Electric Corporation under the trade name of P2000. In cases when the steam generating system 26 as well as the turbine 10 are placed under computer control, use can be made of one or more P2000 computers or alternatively a larger computer system such as that sold by Xerox Data Systems and known as the Sigma 5. Separate computers, such as P2000 computers, can be employed for the respective steam generation and turbine control functions in the controlled plant unit and interaction is achieved by interconnecting the separate computers together through data links or other means.

The digital computer used in the DEH control system 1100 is a P2000 computer which is designed for real time process control applications. The P2000 typically uses a 16 bit word length with 2's complement, a single address and fixed word length operated in a parallel mode. All the basic DEH system functions are performed with a 16,000 word (16K), 3 microsecond magnetic core memory. The integral magnetic core memory can be expanded to 65,000 words (65K).

The equipment interfacing with the computer 210 includes a contact interrupt system 124 which scans contacts representing the status of various plant and equipment conditions in plant wiring 1126. The status contacts might typically be contacts of mercury wetted relays (not shown) which operate by energization circuits (not shown) capable of sensing the predetermined conditions associated with the various system devices. Data from status contacts is used in interlock logic functioning and control for other programs, protection analog system functioning, programmed monitoring and logging and demand logging, etc.

Operator's panel buttons 1130 transmit digital information to the computer 2010. The operator's panel buttons 1130 can set a load reference, a pulse pressure, megawatt output, speed, etc.

In addition, interfacing with plant instrumentation 1118 is provided by an analog input system 1116. The analog input system 1116 samples analog signals at a predetermined rate from predetermined input channels and converts the signals sampled to digital values for entry into the computer 210. The analog signals sensed in the plant instrumentation 1118 represent parameters including the impulse chamber pressure, the megawatt power, the valve positions of the throttle valves TV1 through TV4 and the governor valves GV1 through GV8 and the interceptor valve IV, throttle pressure, steam flow, various steam temperatures, miscellaneous equipment operating temperature, generator hydrogen cooling pressure and temperature, etc. A detailed list of all parameters is provided in Appendix 1. Such parameters include process parameters which are sensed or controlled in the process (turbine or plant) and other variables which are defined for use in the programmed computer operation. Interfacing from external systems such as an automatic dispatch system is controlled through the operator's panel buttons 1130.

A conventional programmer's console and tape reader 218 is provided for various purposes including program entry into the central processor 212 and the memory 214 thereof. A logging typewriter 1146 is provided for logging printouts of various monitored parameters as well as alarms generated by an automatic turbine startup system (ATS) which includes program system blocks 1140, 1142, 1144 (FIG. 6) in the DEH control system 1100. A trend recorder 1147 continuously records predetermined parameters of the system. An interrupt system 124 is provided for controlling the input and output transfer of information between the digital computer 210 and the input/output equipment. The digital computer 210 acts on interrupt from the interrupt system 124 in accordance with an executive program. Interrupt signals from the interrupt system 124 stop the digital computer 210 by interrupting a program in operation. The interrupt signals are serviced immediately.

Output interfacing is provided by contacts 1128 for the computer 210. The contacts 1128 operate status display lamps, and they operate in conjunction with a conventional analog/output system and a valve position control output system comprising a throttle valve control system 220 and a governor valve control system 222. A manual control system is coupled to the valve position control output system 220 and is operable therewith to provide manual turbine control during computer shut-down. The throttle and governor valve control systems 220 and 222 correspond to the valve position controls 50 and 52 and the actuators 42 and 44 in FIG. 1. Generally, the manual control system is similar to those disclosed in prior U.S. Pat. No. 3,552,872 by T. Giras et al and U.S. Pat. No. 3,741,246 by A. Braytenbah, both assigned to the present assignee.

Digital output data from the computer 210 is first converted to analog signals in the analog output system 224 and then transmitted to the valve control system 220 and 222. Analog signals are also applied to auxiliary devices and systems, not shown, and interceptor valve systems, not shown.

C. SUBSYSTEMS EXTERNAL TO THE DEH COMPUTER

Figure 3A:
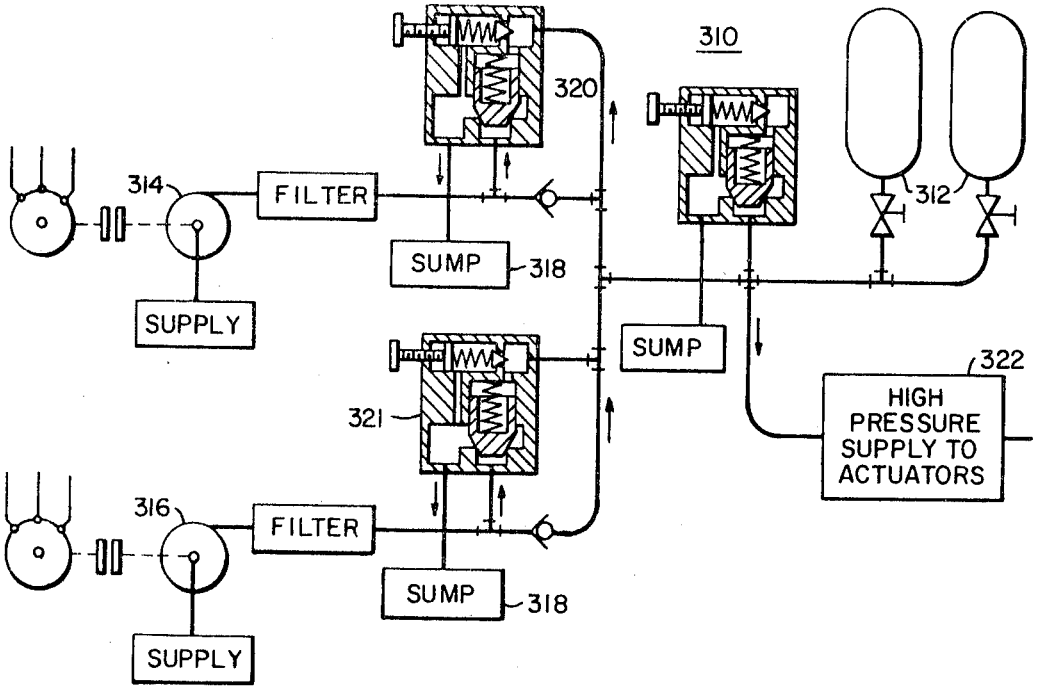
FIGS. 3A, 3B and 3C show a hydraulic system for supplying hydraulic fluid to valve actuators of the steam turbine.
Figure 3B:
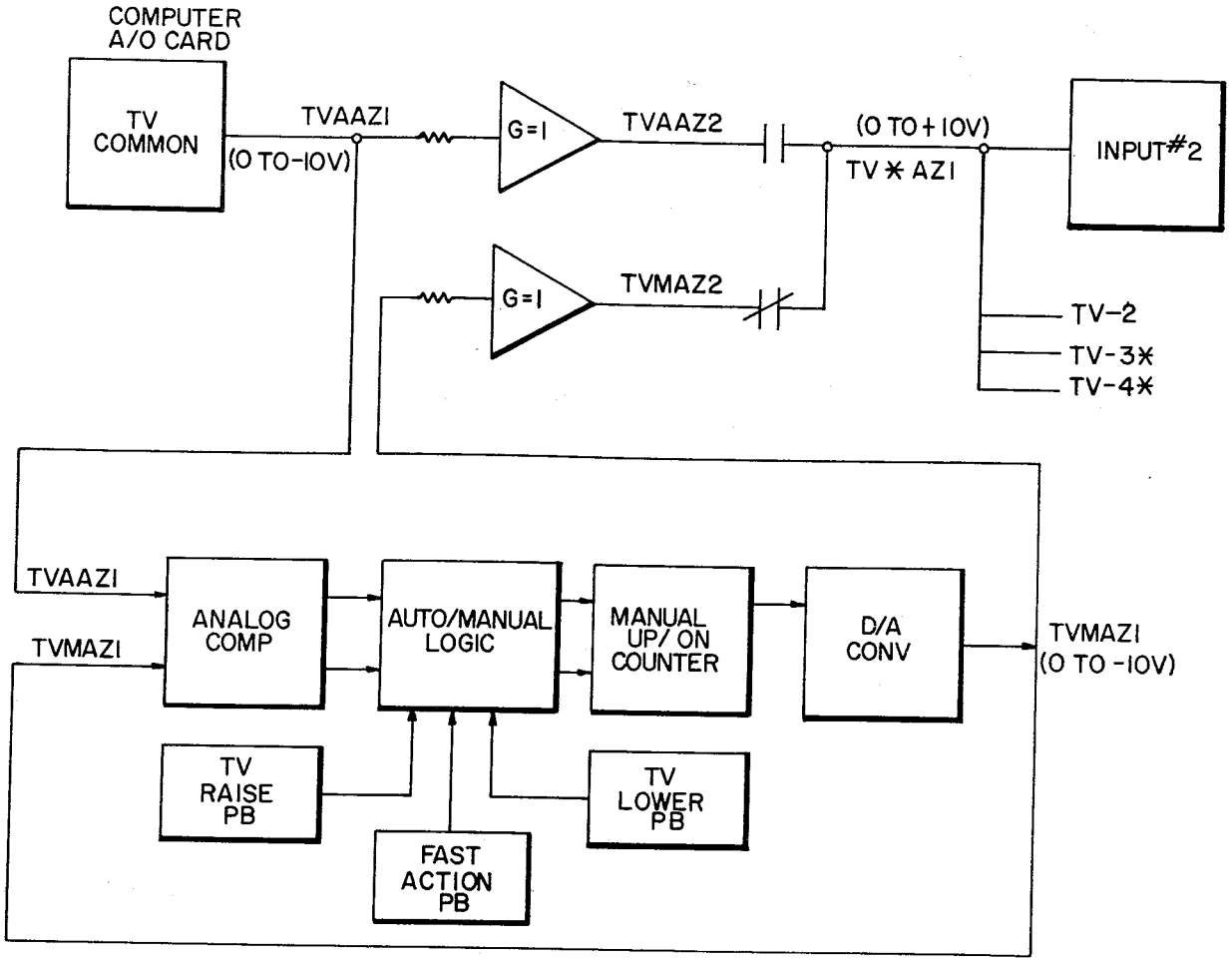
Figure 3C:
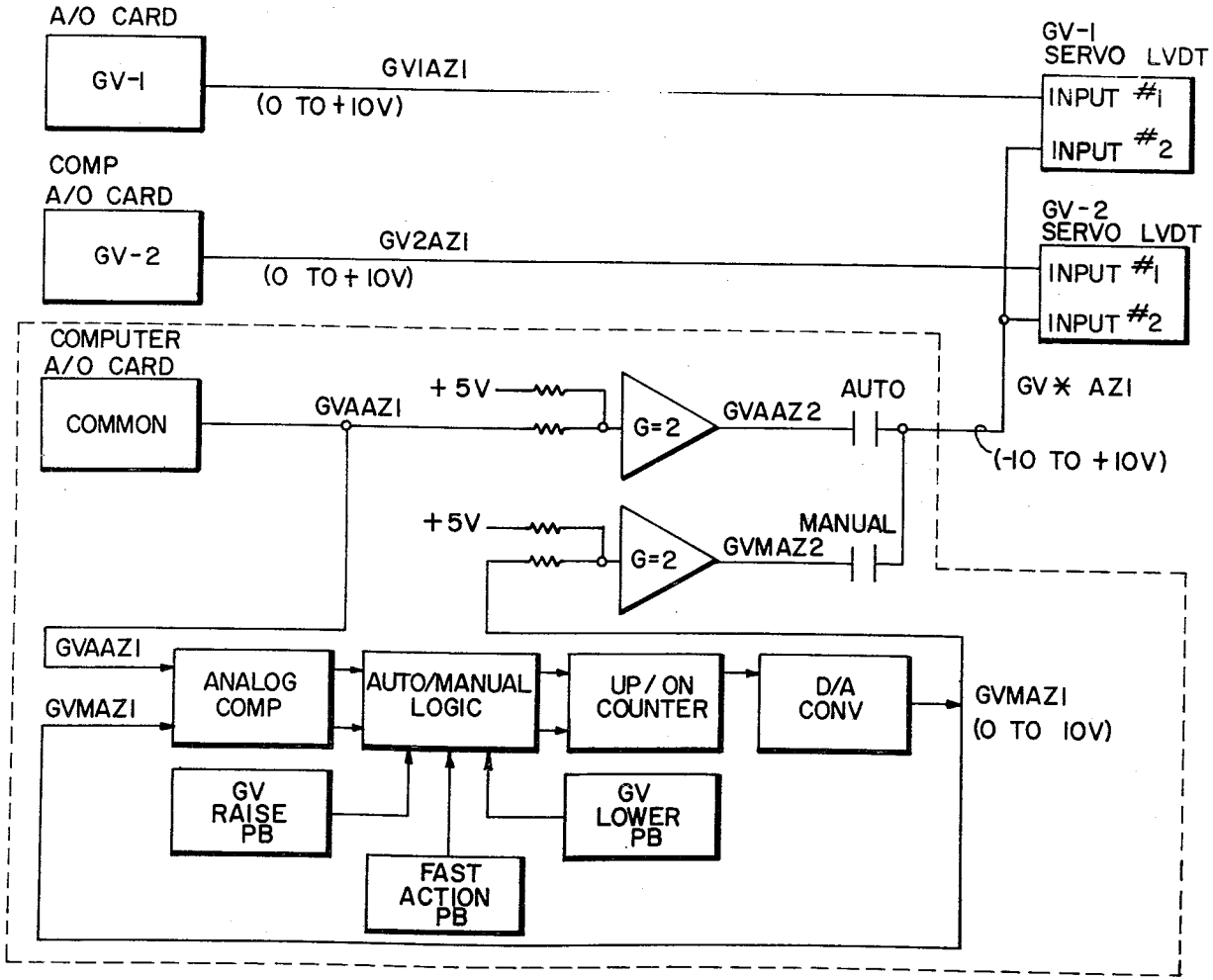

Making reference now to FIGS. 3A-3C, a hardwired digital/analog system forms a part of the DEH control system 1100 (FIG. 2). Structurally, it embraces elements which are included in the blocks 50, 52, 42 and 44 of FIG. 1 as well as additional elements. A hybrid interface 510 is included as a part of the hardwired system. The hybrid interface 510 is connected to actuator system servoamplifiers 414 for the various steam valves which in turn are connected to a manual controller 516, an overspeed protection controller, now shown, and redundant DC power supplies, not shown.

A controller shown in FIG. 3A is employed for throttle valve TV1-TV4 control in the TV control system 50 of FIG. 1. The governor valves GV1-GV8 are controlled in an analogous fashion by the GV control system 52.

While the steam turbine is controlled by the digital computer 210, the hardwired system 511 tracks single valve analog outputs 520 from the digital computer 210. A comparator 518 compares a signal from a digital-to-analog converter 522 of the manual system with the signal 520 from the digital computer 210. A signal from the comparator 518 controls a logic system 524 such that the logic system 524 runs an up-down counter 526 to the point where the output of the converter 522 is equal to the output signal 520 from the digital computer 210. Should the hardwired system 511 fail to track the signal 520 from the digital computer 210 a monitor light will flash on the operator's panel.

When the DEH control system reverts to the control of the backup manual controller 516 as a result of an operator selection or due to a contingency condition, such as loss of power on the automatic digital computer 210, or a stoppage of a function in the digital computer 210, or a loss of a speed channel in the wide range speed control all as described in greater detail infra, the input of the valve actuation system 322 is switched by switches 528 from the automatic controllers in the blocks 50, 52 (FIG. 1) or 220, 222 (FIG. 2) to the control of the manual controller 516. Bumpless transfer is thereby accomplished between the digital computer 210 and the manual controller 516.

Similarly, tracking is provided in the computer 210 for switching bumplessly from manual to automatic turbine control. As previously indicated, the presently disclosed hybrid structural arrangement of software and hardware elements is the preferred arrangement for the provision of improved turbine and plant operation and control with backup capability. However, other hybrid arrangements can be implemented within the field of application of the invention.

D. DEH PROGRAM SYSTEM

DEH Program System Organization, DEH Control Loops And Control Task Program

With reference now to FIG. 4, an overall generalized control system of this invention is shown in block diagram form. The digital electrohydraulic (DEH) control system 1100 operates valve actuators 1012 for the turbine 10. The digital electrohydraulic control system 1100 comprises a digital computer 1014, corresponding to the digital computer 210 in FIG. 2, and it is interconnected with a hardwired analog backup control system 1016. The digital computer 1014 and the backup control system 1016 are connected to an electronic servo system 1018 corresponding to blocks 220 and 222, in FIG. 2. The digital computer control system 1014 and the analog backup system 1016 track each other during turbine operations in the event it becomes necessary or desirable to make a bumpless transfer of control from a digital computer controlled automatic mode of operation to a manual analog backup mode or from the manual mode to the digital automatic mode.

In order to provide plant and turbine monitor and control functions and to provide operator interface functions, the DEH computer 1014 is programmed with a system of task and task support programs. The program system is organized efficiently and economically to achieve the end operating functions. Control functions are achieved by control loops which structurally include both hardware and software elements, with the software elements being included in the computer program system. Elements of the program system are considered herein to a level of detail sufficient to reach an understanding of the invention. More functional detail in various programs is presented in Appendix 2. Further, a detailed listing of a DEH system program substantially conforming to the description presented herein is presented in Appendix 3 in symbolic and machine language. Most of the listing is compiled by a P2000 compiler from instructions written in Fortran IV. A detailed dictionary of system parameters is presented in Appendix 1, and a detailed computer input-/output signal list is presented in Appendix 4. Appendix 5 mainly provides additional hardware information related to the hardwired system previously considered as part of the DEH control system.

As previously discussed, a primary function of the digital electrohydraulic (DEH) system 1100 is to automatically position the turbine throttle valves TV1 through TV4 and the governor valves GV1 through GV8 at all times to maintain turbine speed and/or load. A special periodically executed program designated the CONTROL task is utilized by the P2000 computer along with other programs to be described in greater detail subsequently herein.

With reference now to FIG. 5, a functional control loop diagram in its perferred form includes the CONTROL task or program 1020 which is executed in the computer 1010. Inputs representing demand and rate provide the desired turbine operating setpoints. The demand is typically either the target speed in specified revolutions per minute of the turbine systems during startup or shutdown operations or the target load in megawatts of electrical output to be produced by the generating system 16 during load operations. The demand enters the block diagram configuration of FIG. 5 at the input 1050 of a compare block 1052.

The rate input either in specified RPM per minute or specified megawatts per minute, depending upon which input is to be used in the demand function, is applied to an integrator block 1054. The rate inputs in RPM and megawatts of loading per minute are established to limit the buildup of stresses in the rotor of the turbine-generator 10. An error output of the compare block 1052 is applied to the integrator block 1054. In generating the error output the demand value is compared with a reference corresponding to the present turbine operating setpoint in the compare block 1052. The reference value is representative of the setpoint RPM applied to the turbine system or the setpoint generator megawatts output, depending upon whether the turbine generating system is in the speed mode of operation or the load mode of operation. The error output is applied to the integrator 1054 so that a negative error drives the integrator 1054 in one sense and a positive error drives it in the opposite sense. The polarity error normally drives the integrator 1054 until the reference and the demand are equal or if desired until they bear some other predetermined relationship with each other. The rate input to the integrator 1054 varies the rate of integration, i.e. the rate at which the reference or the turbine operating setpoint moves toward the entered demand.

Demand and rate input signals can be entered by a human operator from a keyboard. Inputs for rate and demand can also be generated or selected by automatic synchronizing equipment, by automatic dispatching system equipment external to the computer, by another computer automatic turbine startup program or by a boiler control system. The inputs for demand and rate in automatic synchronizing and boiler control modes are preferably discrete pulses. However, time control pulse widths or continuous analog input signals may also be utilized. In the automatic startup mode, the turbine acceleration is controlled as a function of detected turbine operating conditions including rotor thermal stress. Similarly, loading rate can be controlled as a function of detected turbine operating conditions.

The output from the integrator 1054 is applied to a breaker decision block 1060. The breaker decision block 1060 checks the state of the main generator circuit breaker 17 and whether speed control or load control is to be used. The breaker block 1060 them makes a decision as to the use of the reference value. The decision made by the breaker block 1060 is placed at the earliest possible point in the control task 1020 thereby reducing computational time and subsequently the duty cycle required by the control task 1020. If the main generator circuit breaker 17 is open whereby the turbine system is in wide range speed control the reference is applied to the compare block 1062 and compared with the actual turbine generator speed in a feedback type control loop. A speed error value from the compare block 1062 is fed to a proportional plus reset controller block 1068, to be described in greater detail later herein. The proportional plus reset controller 1068 provides an integrating function in the control task 1060 which reduces the speed error signal to zero. In the prior art, speed control systems limited to proportional controllers are unable to reduce a speed error signal to zero. During manual operation an offset in the required setpoint is no longer required in order to maintain the turbine speed at a predetermined value. Great accuracy and precision of turbine speed whereby the turbine speed is held within one RPM over tens of minutes is also accomplished. The accuracy of speed is so high that the turbine 10 can be manually synchronized to the power line without an external synchronizer typically required. An output from the proportional plus reset controller block 1068 is then processed for external actuation and positioning of the appropriate throttle and/or governor valves.

If the main generator circuit breaker 17 is closed, the CONTROL task 1020 advances from the breaker block 1060 to a summer 1072 where the REFERENCE acts as a feedforward setpoint in a combined feedforward-feedback load control system. If the main generator circuit breaker 17 is closed, the turbine generator system 10 is being loaded by the electrical network connected thereto.

In the control task 1020 of the DEH system 1100 utilizes the summer 1072 to compare the reference value with the output of speed loop 1310 in order to keep the speed correction independent of load. A multiplier function has a sensitivity to varying load which is objectionable in the speed loop 1310.

During the load mode of operation the DEMAND represents the specified loading in MW of the generator 16 which is to be held at a predetermined value by the DEH system 1100. However, the actual load will be modified by any deviations in system frequency in accordance with a predetermined regulation value. To provide for frequency participation, a rated speed value in box 1074 is compared in box 1078 with a "two signal" speed value represented by box 1076. The two signal speed system provides high turbine operating reliability to be described infra herein. An output from the compare function 1078 is fed through a function 1080 which is similar to a proportional controller which converts the speed error value in accordance with the regulation value. The speed error from the proportional controller 1080 is combined with the feedforward megawatt reference, i.e., the speed error and the megawatt reference are summed in summation function or box 1072 to generate a combined speed compensated reference signal.

The speed compensated load reference is compared with actual megawatts in a compare box or function 1082. The resultant error is then run through a proportional plus reset controller represented by program box 1084 to generate a feedback megawatt trim.

The feedforward speed compensated reference is trimmed by the megawatt feedback error multiplicatively to correct load mismatch, i.e. they are multiplied together in the feedforward turbine reference path by multiplication function 1086. Multiplication is utilized as a safety feature such that if one signal e.g. MW should fail a large value would not result which could cause an overspeed condition but instead the DEH system 1100 would switch to a manual mode. The resulting speed compensated and megawatt trimmed reference serves as an impulse pressure setpoint in an impulse pressure controller and it is compared with a feedback impulse chamber pressure representation from input 1088. The difference between the feedforward reference and the impulse pressure is developed by a comparator function 1090, and the error output therefrom functions in a feedback impulse pressure control loop. Thus, the impulse pressure error is applied to a proportional plus reset controller function 1092.

During load control the megawatt loop comprising in blocks 1082 and 1084 may be switched out of service leaving the speed loop 1310 and an impulse pressure loop operative in the DEH system 1100.

Impulse pressure responds very quickly to changes of load and steam flow and therefore provides a signal with minimum lag which smooths the input response of the turbine generator 10 because the lag dynamics and subsequent transient response is minimized. The impulse pressure input may be switched in and out from the compare function 1090. An alternative embodiment embracing feedforward control with impulse pressure feedback trim is applicable.

Between block 1092 and the governor valves GV1-GV8 a valve characterization function for the purpose of linearizing the response of the values is interposed. The valve characterization function described in detail in Appendix III infra herein is utilized in both automatic modes and manual modes of operation of the DEH system 1100. The output of the proportional plus reset controller function 1092 is then ultimately coupled to the governor valves GV1-GV8 through electro-hydraulic position control loops implemented by equipment considered elsewhere herein. The proportional plus reset controller output 1092 causes positioning of the governor valves GV1-GV8 in load control to achieve the desired megawatt demand while compensation is made for speed, megawatt and impulse pressure deviations from desired setpoints.

Figure 6:
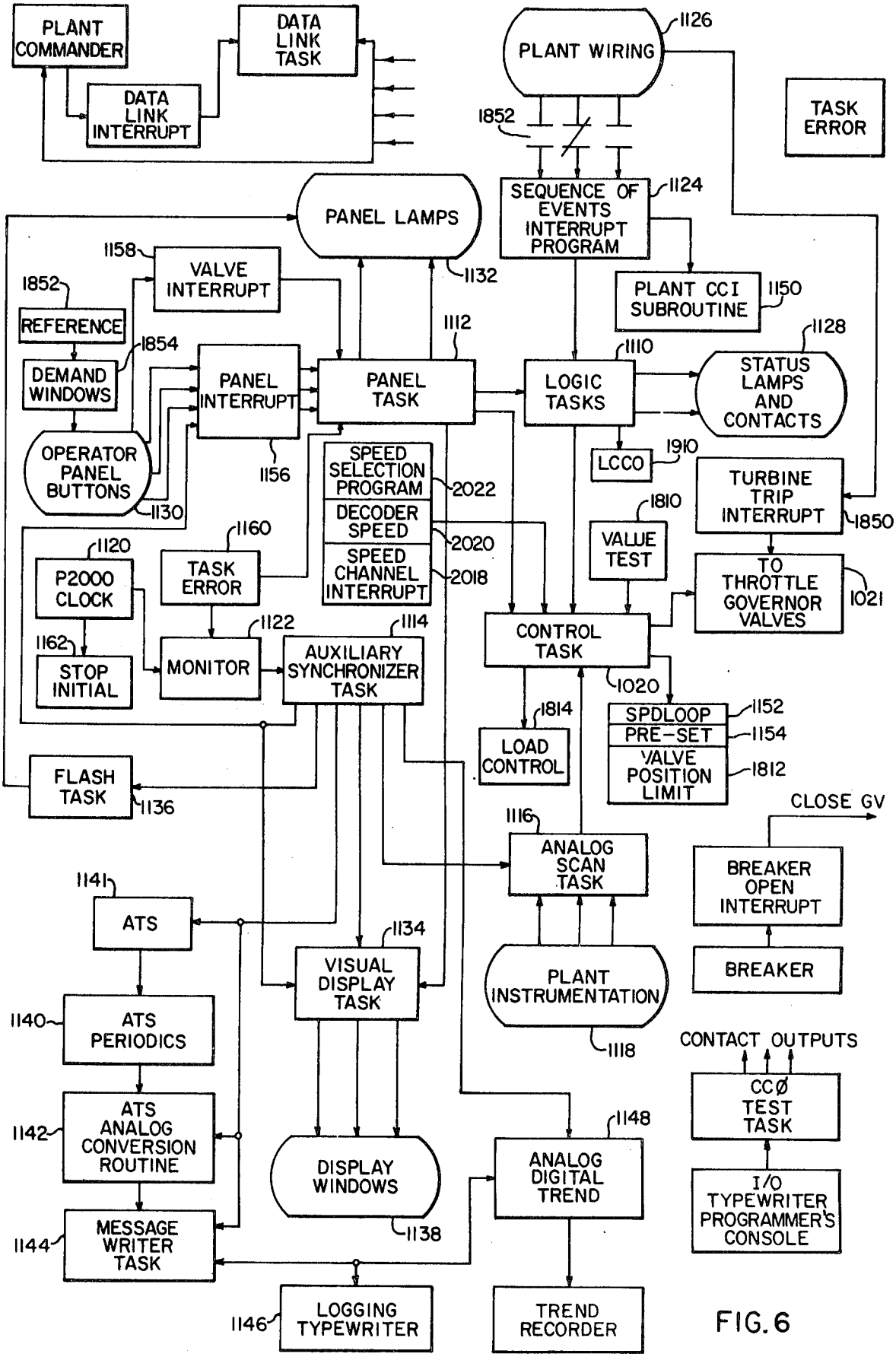
FIG. 6 shows a block diagram of the programs and subroutines of the digital Electro Hydraulic and the automatic turbine startup and monitoring program in accordance with the principles of the invention.

Making reference to FIG. 6, the control program 1020 is shown with interconnections to other programs in the program system employed in the Digital Electro Hydraulic (DEH) system 1100. The periodically executed program 1020 receives data from a logic task 1110 where mode and other decisions which affect the control program are made, a panel task 1112 where operator inputs may be determined to affect the control program, an auxiliary synchronizer program 1114 and an analog scan program 1116 which processes input process data. The analog scan task 1116 receives data from plant instrumentation 1118 external to the computer as considered elsewhere herein, in the form of pressures, temperatures, speeds, etc. and converts such data to proper form for use by other programs. Generally, the auxiliary synchronizer program 1114 measures time for certain important events and it periodically bids or runs the control and other programs. An extremely accurate clock function 1120 operates through a monitor program 1122 to run the auxiliary synchronizer program 1114.

The monitor program or executive package 1122 also provides for controlling certain input/output operations of the computer and, more generally, it schedules the use of the computer to the various programs in accordance with assigned priorities. For more detail on the P2000 computer system and its executive package, reference is made to Appendix 4. In the appendix description, the executive package is described as including analog scan and contact closure input routines, whereas these routines are considered as programs external to the executive package in this part of the disclosure.

The logic task 1110 is fed from outputs of a contact interrupt or sequence of events program 1124 which monitors contact variables in the power plant 1126. The contact parameters include those which represent breaker state, turbine auto stop, tripped/latched state interrogation data states, etc. Bids from the interrupt program 1124 are registered with and queued for execution by the executive program 1111. The control program 1110 also receives data from the panel task 1112 and transmits data to status lamps and output contacts 1128. The panel task 1112 receives data instruction based on supervision signals from the operator panel buttons 1130 and transmits data to panel lamps 1132 and to the control program 1020. The auxiliary synchronizer program 1114 synchronizes through the executive program 111 the bidding of the control program 1020, the analog scan program 1116, a visual display task 1134 and a flash task 1136. The visual display task transmits data to display windows 1138.

The control program 1020 receives numerical quantities representing process variables from the analog scan program 1116. As already generally considered, the control program 1020 utilizes the values of the various feedback variables including turbine speed, impulse pressure and megawatt output to calculate the position of the throttle valves TV1-TV4 and governor valves GV1-GV8 in the turbine system 10, thereby controlling the megawatt load and the speed of the turbine 10.

To interface the control and logic programs efficiently, the sequence of events program 1124 normally provides for the logic task 1110 contact status updating on demand rather than periodically. The logic task 1110 computes all logical states according to predetermined conditions and transmits this data to the control program 1020 where this information is utilized in determining the positioning control action for the throttle valves TV1-TV4, and the governor valves GV1-GV8. The logic task 1110 also controls the state of various lamps and relay type contact outputs in a predetermined manner.

Another important part of the DEH system is the OPERATOR'S PANEL program. The operator communicates through the panel with the DEH control programs by means of various buttons which have assigned functions. When any button is pressed, a special interrupt is generated; this interrupt triggers a PANEL INTERRUPT program which decodes the button pressed, and then bids the PANEL task. The PANEL program processes the button and takes the proper action, which usually means manipulating some panel lamps, as well as passing on the button information to both the LOGIC and the CONTROL tasks.

The Operator's Panel also has two sets of display windows which allow display of all turbine program parameters, variables, and constants. A visual display task presents this information in the windows at the request of the operator through various dedicated display buttons and a numerical keyboard. The visual display values are periodically updated in the windows as the quantity changes.

Certain important turbine operating conditions are communicated to the DEH operator by way of flashing lamps on the panel. Therefore a special FLASH program is part of the DEH system. Its function is to monitor and detect such contingency conditions, and flash the appropriate lamp to alert the operator to the state.

E. TASK PRIORITY ASSIGNMENTS

With reference now to FIG. 7, a table of program priority assignments is shown as employed in the executive monitor. A program with the highest priority is run first under executive control if two or more programs are ready to run. The stop/initializer program function has top priority and is run on startup of the computer or after the computer has been shut down momentarily and is being restarted. The control program 1020 is next in order of priority. The operator's panel program 1130, which generates control data, follows the control task 1020 in priority. The analog scan program 1116 also provides information to the control task 1020 and operates at a level of priority below that of the operator's panel 1130. The automatic turbine starting (ATS) periodic program 1140 is next in the priority list. ATS stands for automatic turbine startup and monitoring program, and is shown as a major task program 1140 of FIG. 6 for the operation of the DEH system 1100. The ATS-periodic program 1140 monitors the various temperatures, pressures, breaker states, rotational velocity, etc. during start-up and during load operation of the turbine system.

The logic task 1110, which generates control and operating mode data, follows in order of operating priority. The visual display task program 1134 follows the logic task program 1110 and makes use of outputs from the latter. A data link program for transmitting data from the DEH system to an external computer follows. An ATS-analog conversion task program 1142 for converting the parameters provided by the ATS-periodic program 1142 to usable computer data follows in order of priority. The flash task program 1136 is next, and it is followed by a programmer's console program which is used for maintenance testing and initial loading of data tapes. The next program is an ATS-message writer 1144 which provides for printout of information from the ATS analog conversion program 1142 on a suitable typewriter 1146. The next program in the priority list is an analog/digital trend which monitors parameters in the turbine system 10 and prints or plots them out for operator perusal. The remaining two programs are for debugging and special applications.

In the preferred embodiment, the stop/initialize program is given the highest priority in the table of FIG. 7 because certain initializing functions must be completed before the DEH system 1100 can run. The auxiliary synchronizer program 1114 provides timing for all programs other than the stop/initialize program while the DEH system 1100 is running. Therefore, the auxiliary synchronizer task program 1400 has the second order of priority of the programs listed. The control program 1020 follows at the third descending order of priority since the governor valves GV1 through GV8 and the throttle valves TV1 through TV4 must be controlled at all times while the DEH system 1100 is in operation.

The operator's panel program 1130 is given the next order of priority in order to enable an operator to exercise direct and instantaneous control of the DEH system 1100. The analog scan program 1116 provides input data for the control program 1020 and, therefore, is subordinate only to the initialize synchronizer control and operator function.

In the preferred embodiment the ATS-periodic program 1140 is next in order of priority. During automatic turbine startup, the scanning of inputs by the ATS-periodic program 1140 is almost on the same order of priority as the inputs to the DEH system 1100. However, the ATS program 1140 in alternative embodiments, could be reduced in its priority, without any considerable adverse effect, because of the relatively limited duty cycle problems in the ATS system.

The logic task 1110 which control the operations of some of the functions of the control task program 1020 is next in order of priority. The visual display task 1134 follows in order of priority in order to provide an operator with a visual indication of the operation of the DEH program 1100. The visual display program 1134 is placed in the relatively low eighth descending order of priority since the physical response of an operator is limited in speed to to 0.2 to 0.5 sec. as to a visual signal. The rest of the programs are in essentially descending order of importance in the preferred embodiment. In alternative embodiments of the inventions, alternate priority assignments can be employed for the described or similar programs, but the general priority listing described is preferred for the various reasons presented.

A series of interrupt programs interrupt the action of the computer and function outside the task priority assignments to process interrupts. One such program in FIG. 6 is the sequence events or contact interrupt program 1124 which suspends the operation of the computer for a very short period of time to process an interrupt. Between the operator panel buttons 1130 and the panel task program 1112 a panel interrupt program 1156 is utilized for signalling any changes in the operator's panel buttons 1130. A valve interrupt program 1158 is connected directly between the operator's panel buttons 1130 and the panel task program 1112 for operation during a valve test or in case of valve contingency situations.

Figure 9:
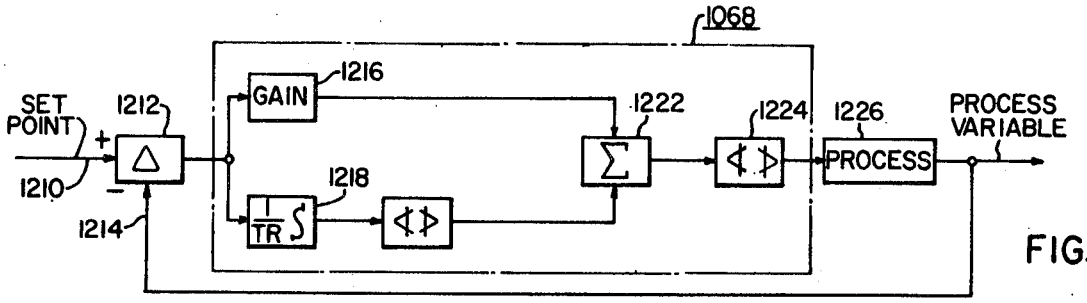
FIG. 9 shows a block diagram of a proportional-plus-reset controller program which is operable in accordance with the principles of the invention.

Proportional plus reset controller subroutine 1154 FIG. 9 is called by the control task program 1020 of FIG. 5 as previously described when the turbine control system is in the speed mode of control and also, for computer use efficiency, when the turbine 10 is in the load mode of control with the megawatt and impulse pressure feedback loops in service. Utilizing the proportional plus reset function 1068 during speed control provides very accurate control of the angular velocity of the turbine system.

In addition to previously described functions, the auxiliary synchronizer program 1114 is connected to and triggers the ATS periodic program 1140, the ATS analog conversion routine 1142 and the message writer 1144. The ATS program 1140 monitors a series of temperature, vibration, pressures, speed, etc. in the turbine system and also contains a routine for automatically starting the turbine system 10. The ATS analog conversion routine 1142 converts the digital computer signals from the ATS periodic program 1140 to analog or digital or hybrid form which can be typed out through the message writer task 1144 to the logging typewriter 1146 or a similar recorder.

The auxiliary synchronizer program 1114 also controls an analog/digital trend program 1148. The analog digital trend program 1148 records a set of variables in addition to the variables of the ATS periodic program 1140.

Ancillary to a series of other programs is a plant CCI subroutine 1150 where CCI stands for contact closure inputs. The plant CCI subroutine 1150 responds to changes in the state of the plant contacts as transmitted over the plant wiring 1126. Generally, the plant contacts are monitored by the CCI subroutine 1150 only when a change in contact state is detected. This scheme conserves computer duty cycle as compared to periodic CCI monitoring. However, other triggers including operator demand can be employed for a CCI scan.

As shown in FIG. 6, the control task 1020 calls ancillary thereto a speed loop task 1152 and the preset or proportional plus reset controller program 1154. Ancillary to the executive monitoring program 1122 is a task error program 1160. In conjunction with the clock program 1120 a stop/initialize program 1162 is used. Various other functions in FIG. 6 are described in greater detail infra.

F. DEH PROGRAMS OR TASKS

Making reference now to FIG. 9, a functional diagram of the proportional plus reset controller task program 1068 of FIG. 5 is shown in greater detail. The proportional plus reset controller subroutine 1068 is called by the control program 1020 of FIG. 5 when the DEH turbine control system 1100 is in the speed mode of control and also when the DEH turbine control system 1100 is in the load mode of control with the megawatt and impulse pressure feedback loops in service. As already indicated utilizing a proportional plus reset function during speed control provides very accurate control of the angular velocity of the turbine system.

The proportional plus reset controller 1068 provides an output which is composed of the sum of two parts. One part of the output is proportional to an input and the other part is an integral of the input. Therefore, instantaneous response is available as well as the capability of zero input error. A setpoint or dynamic reference from a demand source is applied to an input 1210 of a difference function 1212. The difference function 1212 compares the input and the actual controlled process value. An output from the difference function 1212 is fed to a proportional gain function 1216 and to an input of an integrator or integrating function 1218 having a reset time TR. An output from the integrator 1218 is high and low limited by the program as represented by the reset windup prevention function 1220 in order to avoid excessive integrator outputs which could occur with a reset windup.

Proportional and integral outputs from the gain function 1216 and the windup limited integrator 1218 are summed in a summing function 1222. The total output from the summing function 1222 is high and low limited by another function 1224 and fed to a process function 1226 thereby limiting the total output to a useful output range.

Figure 10:
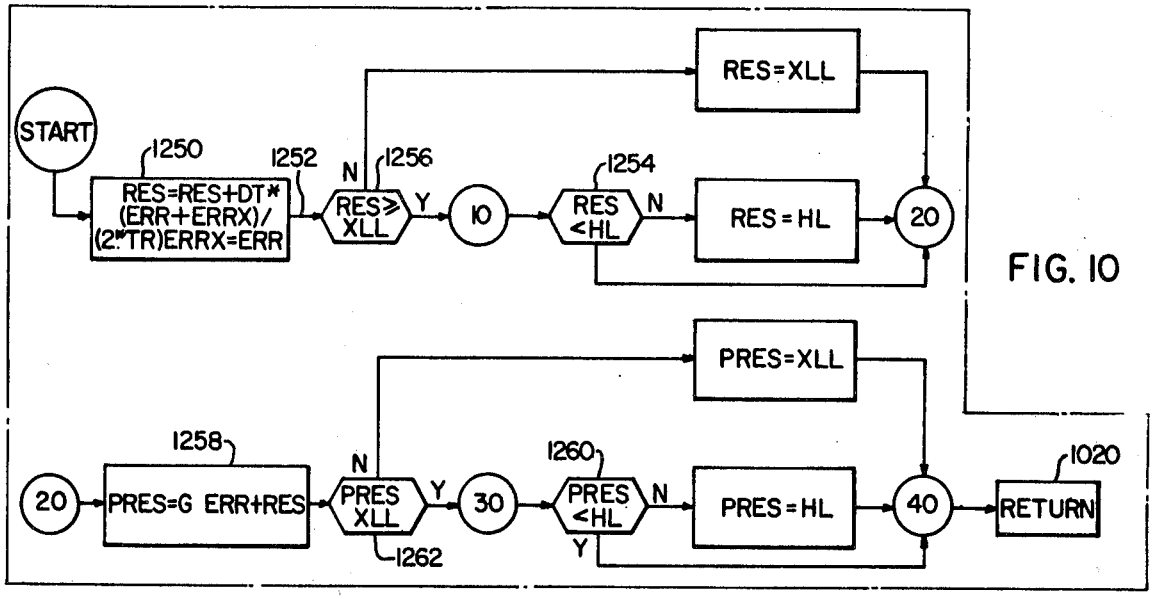
FIG. 10 shows a flow chart of the proportional-plus-reset subroutine (PRESET) which is operable in accordance with the principles of the invention.

Making reference now to FIG. 10, a pictorial representation of a flow chart for the proportional plus reset controller program is shown. In the preferred embodiment the Preset program is designed such that a call from the control program 1030 provides a list of variables necessary to evaluate the controller 1068 output. The structure of the subroutine is indicated by the Fortran statement given below.

SUBROUTINE PRESET (ERR, ERRX, G, TR, HL, XLL, RES, PRES)

The variables in the above equation are defined as follows:

| FORTRAN Variables | English Language Equivalents |
|---|---|
| ERR | The current input |
| ERRX | The last input |
| G | The controller proportional gain |
| TR | The controller reset time |
| HL | The controller high limit |
| XLL | The controller low limit |
| RES | The controller integral output |
| PRES | The controller total output. |

Again making reference to FIG. 10, where standard FORTRAN notation is used, the Preset subroutine 1068 first evaluates the integral part of the controller output according to equation:

$$Y(N) = Y(N-1) + \frac{DT}{2*TR}*[X(N) + X(N-1)].$$

The subroutine 1068 next saves the current input ERR in storage location ERRX 1250 for the following call to the subroutine 1068. The controller integral output RES 1252 is then checked against the high limit 1254 and the low limit 1256 to prevent reset/windup. The proportional part of the output is computed and added to the integral part of the output integrator 1218 to form the total output PRES 1258. PRES 1258 is checked against high limit 1260 and low limit 1262 after which the proportional plus reset controller subroutine 1068 returns to the control task 1020.

As previously considered, the proportional plus reset controller subroutine 1068 is used by the control task program 1020 during three different phases of operation of the turbine system. During startup of the turbine system 10, the proportional plus reset controller subroutine program 1068 is used as a speed controller in order to regulate and hold the speed of the turbine 10 at a predetermined value or at a predetermined acceleration rate. Because of the integral function of the proportional plus reset controller subroutine program 1068 the speed of the turbine system 10 can be held to within 1 rpm. Also, in order for an operator to keep the speed of the turbine system 10 at a predetermined value, an error offset input signal typical of a purely proportional system is not required. Therefore, the reference and the controlled variable, both turbine speed in this case, will be equal. The proportional plus reset controller subroutine program 1068 is also used in the megawatt controller feedback loop and the impulse chamber pressure controller feedback loop.

During turbine startup, the quantity REFDMD is the internal speed reference while WS is the actual turbine speed. GS1 and T1 are the proportional gain and reset time, HLS and 0. are the high and low limits. RESSPD is the integral part of the output, SPDSP is the total output, and RESSPDX is the last value of the input.

In the megawatt controller during megawatt loop operation, REF1 is the megawatt set point, MW is the megawatt feedback, and GR2 is a ranging gain to convert from engineering units to per-unit form. GL2 and T2 are the proportional gain and the reset time, while HEL and LEL are high and low limits. RESMW is the integral output, Y is the total output, and RESMWX is the last input.

With impulse pressure loop operation, PISP is the set point for the impulse pressure controller, PI is the feedback and GL3 and T3 are the proportional gain and the reset time. GR4 and 0. are the high and low limits, RESPI is the integral output, VSP is the total output, and RESPIX is the last input.

2. SPEED LOOP SUBROUTINE

Figure 11:
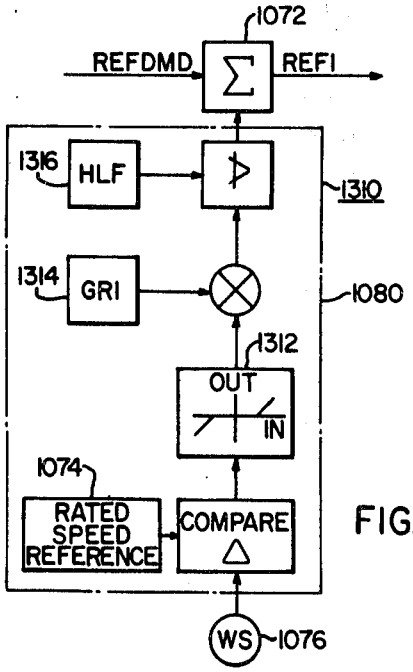
FIG. 11 shows a block diagram of a proportional controller function with dead band which is operable in accordance with the principles of the invention.

Making reference not to FIG. 11, a speed loop program 1310 which functionally is part of the arrangement shown in FIG. 5 is shown in greater detail. The speed loop (SPDLOOP) program 1310 normally computes data required in the functioning of the speed feedback loop in the load control comprising as shown in FIG. 5 the rated speed reference 1074, the actual turbine speed 1076, the compare function 1078, the proportional controller 1080 and the summing function 1072. During the load control, the speed feedback loop adjusts the load reference (and thus the governor valves) to correct for any turbine speed deviation from rated speed. The speed feedback loop uses a proportional controller to accomplish this function. The speed loop subroutine 1310 is called upon to perform speed control loop functions by the control program 1020. In FIG. 11, the functioning of the proportional controller 1080 is shown in detail. The error output from the compare function 1078 is fed through a deadband function 1312. A proportionality constant (GR1) 1314 and a high limit function (HLF) 1316 are included in the computation.

The speed loop (SPDLOOP) subroutine is called by the control task during the load control mode and when switching occurs between actual speed signals. Subroutine form reduces the requirement for memory storage space thereby reducing computer the expense required for operation of the DEH system 1100.

The deadband function 1312 provides for bypassing small noise variations in the speed error generated by the compare function 1078 so as to prevent turbine speed changes which would otherwise occur. Systems without a deadband continuously respond to small variations which are random in nature resulting in undue stress in the turbine 10 and unnecessary, time and duty cycle consuming operation of the control system. A continuous hunting about the rated speed due to the gain of the system would occur without the deadband 1312. The speed regulation gain GR1 at 1314 is set to yield rated megawatt output power speed correction for a predetermined turbine speed error. The high limit function HLS at 1316 provides for a maximum speed correction factor.

The turbine speed 1076 is derived from three transducers. The turbine digital speed transducer arrangement is that disclosed in greater element and system implementation detail in the aforementioned Reuther Application Ser. No. 412,513. Briefly, in the preferred embodiment for determining the speed of the turbine, the system comprises three independent speed signals. These speed signals consist of a very accurate digital signal generated by special electronic circuitry from a magnetic pickup, an accurate analog signal generated by a second independent magnetic pickup, and a supervisory analog instrument signal from a third independent pickup. The DEH system compares these signals and through logical decisions selects the proper signal to use for speed control or speed compensated load control. This selection process switches the signal used by the DEH control system 1100 from the digital channel signal to the accurate analog channel signal or vice versa under the predetermined dynamic conditions. In order to hold the governor valves at a fixed position during this speed signal switching the control program 1020 uses the speed loop subroutine 1310 and performs a computation to maintain a bumpless speed signal transfer.

Figure 12:
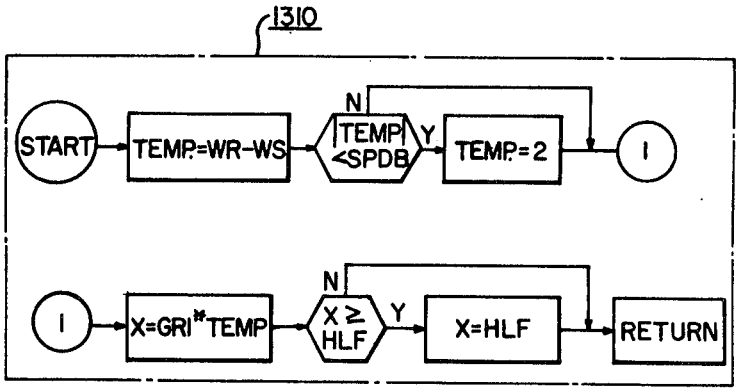
FIG. 12 shows a flow chart of a speed loop (SPDLOOP) subroutine which is operable in accordance with the principles of the invention.

Making reference to FIG. 12, the speed loop (SPDLOOP) subroutine flow chart 1310 is shown in greater detail. Two FORTRAN statements signify the operations of the speed loop subroutine program flow chart 1310. These statements are:

CALL SPDLOOP
REF1 = REFDMD + X

Variables in the flow chart 1310 are defined as follows:

| FORTRAN VARIABLES | ENGLISH LANGUAGE EQUIVALENT |
|---|---|
| REFMD | Load reference |
| WR | The turbine rated speed |
| REF1 | Corrected load reference |
| WS | The actual turbine speed |
| TEMP | Temporary storage location variable |
| SPDB | The speed deadband |
| GR1 | The speed regulation gain (normally set to yield rated megawatt speed correction for a 180 rpm speed error) |
| X | Speed correction factor |
| HLF | The high limit function. |

3. PLANT CONTACT CLOSURE INPUT (PLANTCCI) SUBROUTINE

Figure 13:
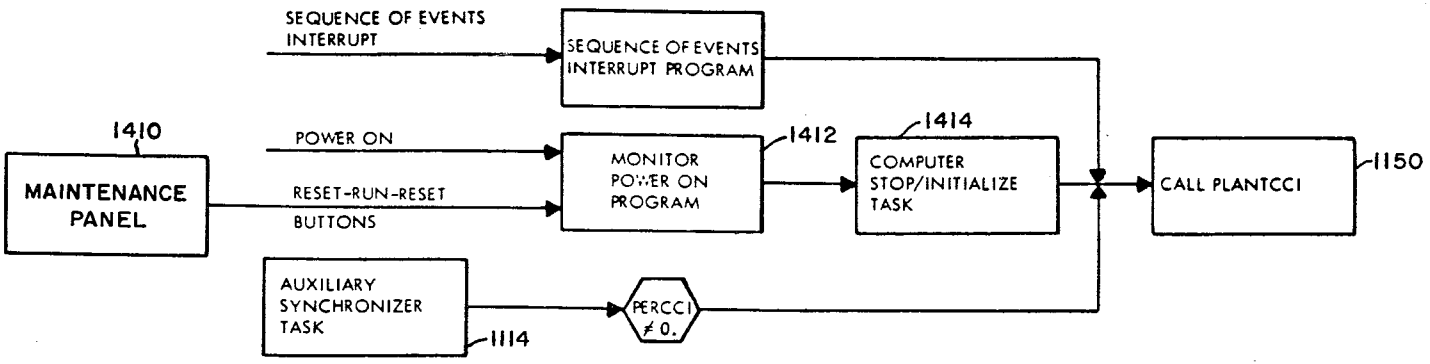
FIG. 13 shows a block diagram of a subroutine for scanning contact close inputs of the Digitial Electro Hydraulic System which is operable in accordance with the principles of the invention.

A plant contact closure input subroutine 1150 as shown in FIG. 6 scans all the contact inputs tied to the computer through the plant wiring 1126 and sets logic data images of these in designated areas within the memory 214 of the computer 210. Various situations call for the PLANTCCI subroutine. The most common case represents a basic design feature of the DEH system; that is, the situation in which a change of state of any contact input triggers a sequence of events interupt. A corresponding interrupt program then calls the PLANTCCI subroutine to do a scan of all contact inputs and to update the computer contact image table. Thus (under normal conditions) a contact scan is carried out only when necessary. A block diagram illustrating the operation of the plant contact closure input subroutine 1150 is shown in FIG. 13. The plant contact closure input subroutine 1150 is also utilized when power to the computer 210 is turned on or when the computer buttons reset-run-reset are pressed on a maintenance panel 1410. Under these circumstances, a special monitor power-on routine 1412 is called upon. This program executes the computer STOP/INITIALIZE task 1414 described previously, which in turn calls the plant contact closure input subroutine 1150 for performance of the initializing procedure.

The operator can also call the plant contact closure input subroutine 1150 through the auxiliary synchronizer program 1114, if desired, whereby a periodic scan of the entire computer CCI system is implemented for checking the state of any one or group of relays in the CCI system. This call is contingent upon the entry of a non-zero value for the constant PERCCI from the DEH Operator's Panel keyboard.

4. AUXILIARY SYNCHRONIZER PROGRAM

Figure 14:
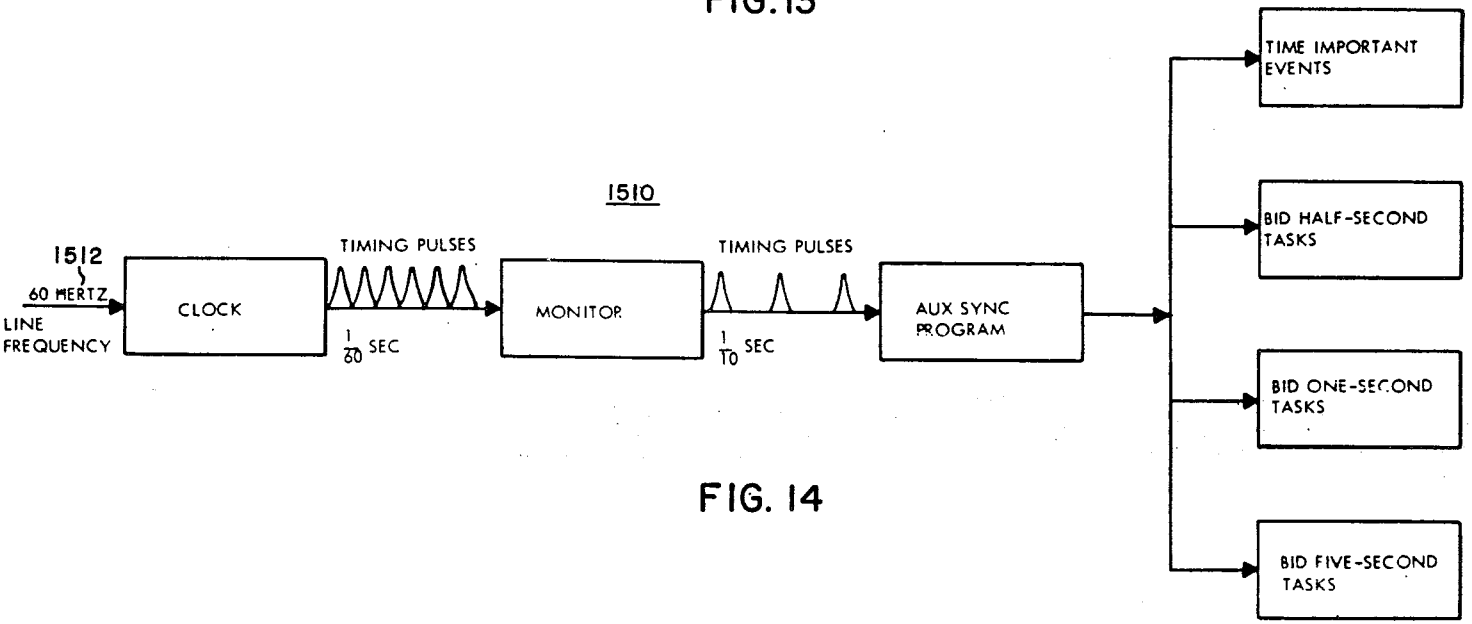
FIG. 14 shows a block diagram of an auxiliary synchronizer computer program which is operable in accordance with the principles of the invention.

With reference to FIG. 14, the block diagram shows an overall scheme which illustrates the operation of the auxiliary synchronizer program 1510. The auxiliary synchronizer program 1510 has two functions. It performs accurate counting to determine the time duration of important events to be described in more detail and it synchronizes the bidding for execution of all periodic programs in the digital electrohydraulic system 1100 on a predetermined schedule. The AUX SYNC task is on priority level $E_{16}$ ($14_{10}$) and is initiated by the 60 Hz synchronizing program of the Monitor every 1/10 sec. Highly accurate and stable timing is provided by a clock to align all parts of the system in a repetitive working pattern. Such timing sources are called clocks or synchronizers. Clocks may generate their timing pulses in a number of ways; the most common clocks consist either of a very accurate electronic oscillator, or a timing circuit triggered by the 60 Hz supply frequency to the computer.

The DEH control system utilizes the line frequency as its timing source. As shown in FIG. 14, a clock pulse is generated every cycle (1/60 sec), and triggers a counting circuit in the computer Monitor system. The Monitor is initialized to generate an interrupt every six cycles (1/10 sec). When this interrupt occurs, the Monitor executes its own internal scheduling functions and then bids the AUX SYNC task to run. AUX SYNC proceeds to carry out its various timing calculations and bids all remaining periodic DEH programs.

OPERATOR'S PANEL AND FLASH PROGRAM

Figure 15:
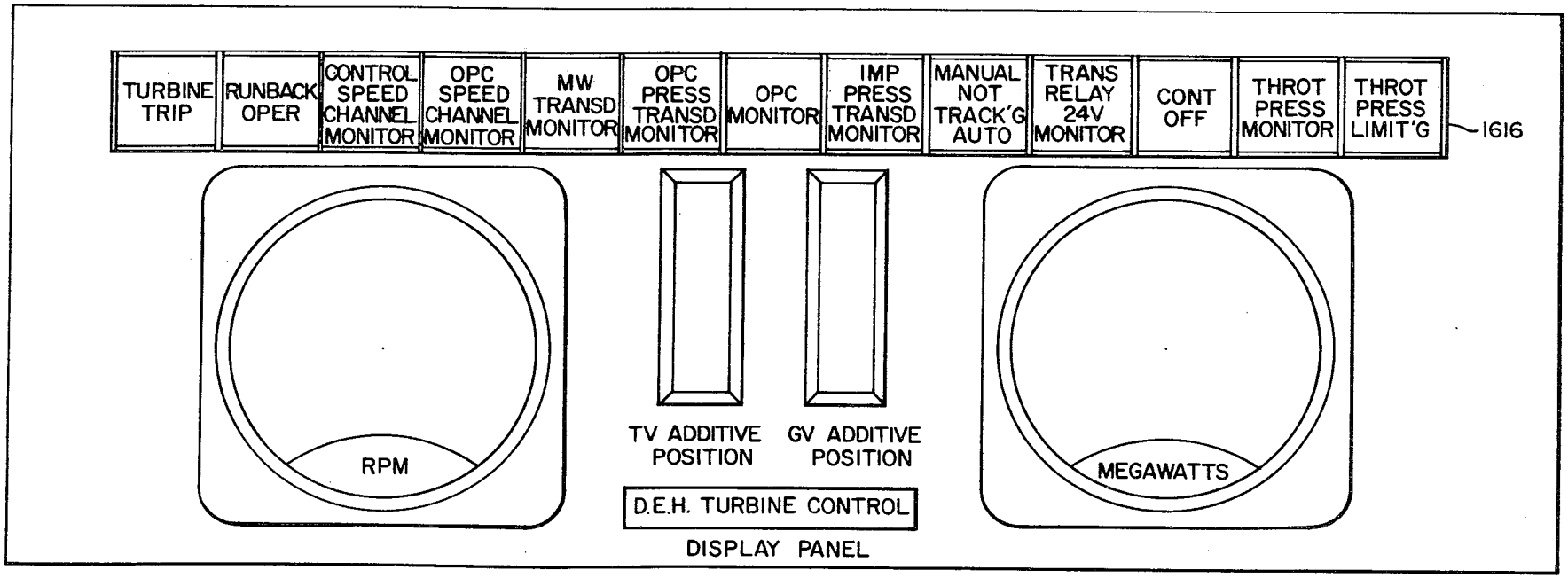
FIG. 15 shows a view of a part of an operator's control panel which is operable in accordance with the principles of the invention.
Figure 16:
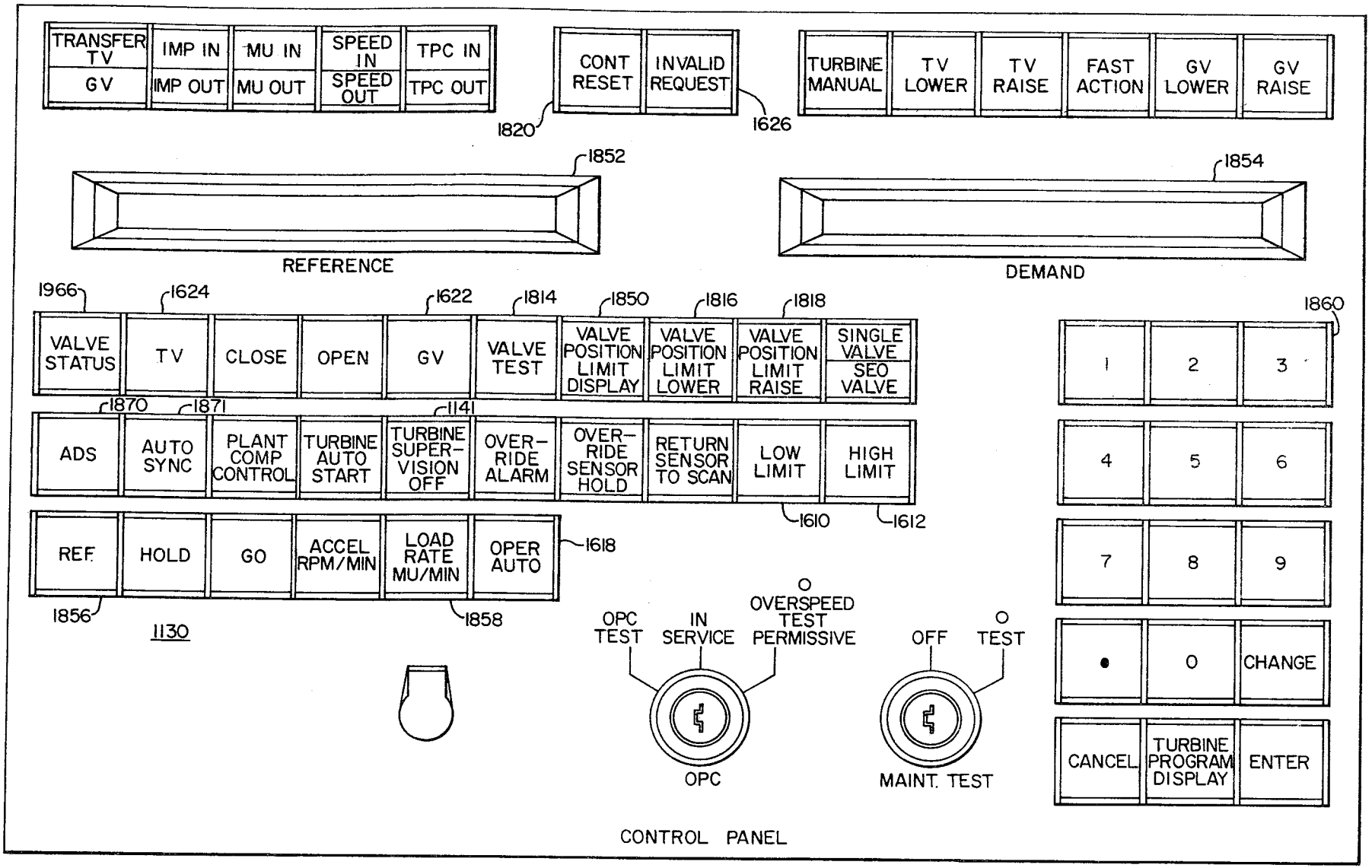
FIG. 16 shows a view of a part of the operator's control panel which is operable in accordance with the principles of the invention.
Figure 17:
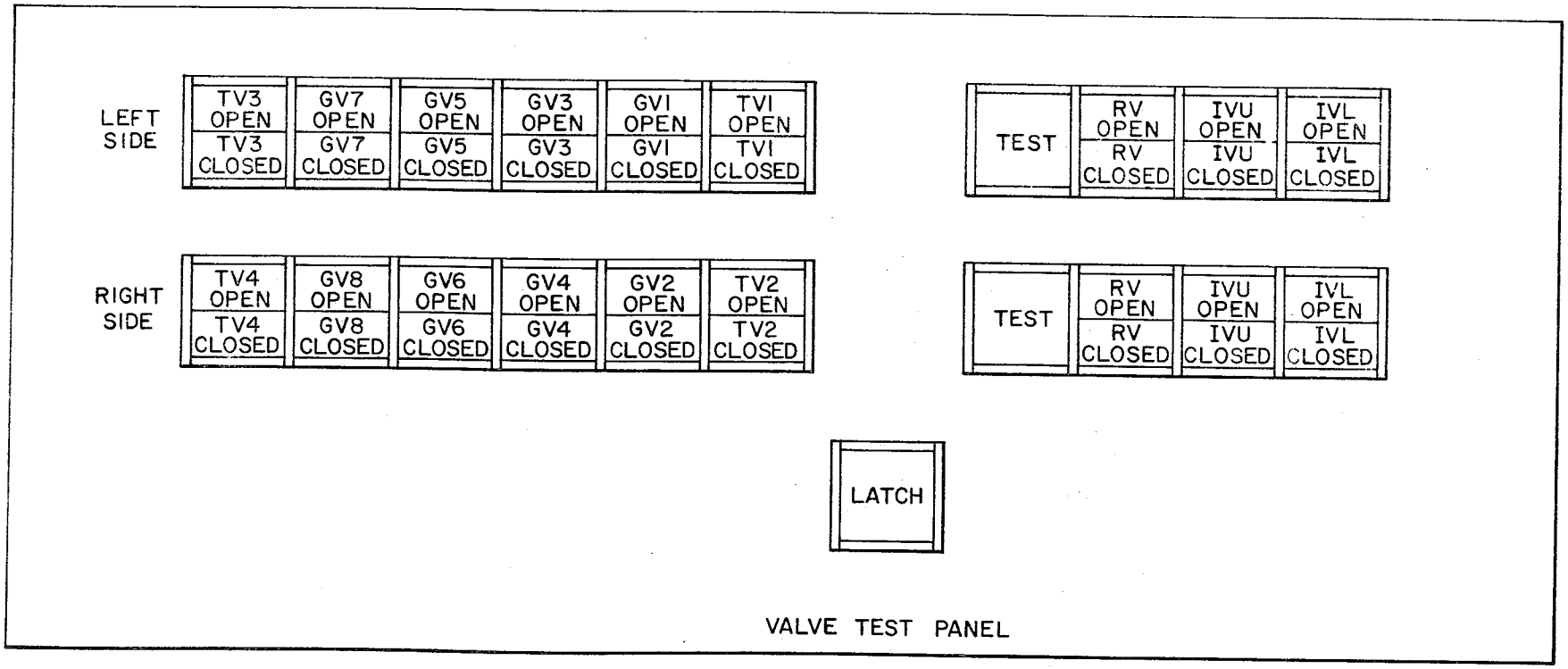
FIG. 17 shows a view of a portion of the operator's control panel which is operable in accordance with the principles of the invention.

Referring now to FIGS. 15, 16 and 17, the control panel 1130 for the digital electrohydraulic system 1100 is shown in detail. Specified functions have control panel buttons which flash in order to attract the attention of an operator. The FLASH task has two functions: it flashes appropriate lights to alert the operator to various important conditions in the DEH system, and it sets contact outputs to pass these same conditions to the Analog Backup and Boiler Control Systems. The FLASH task is on priority level 5 and is bid by the AUX SYNC task every ½ sec. The concept behind the FLASH task is that flashing will attract the operator's attention much more quickly than simply maintaining a steady on condition. Most of the flashing lights indicate contingency conditions; a few indicate such things as invalid keyboard entries or that the DEH system is ready to go on automatic control. The flashing frequency is set at ½ sec on and ½ sec off as long as the condition exists. At the termination of the flashing condition, the corresponding lights and contacts are turned off.

A total of nine conditions are continually monitored for flashing by the FLASH task. These are listed below with a brief description of each.

| | | |
|---|---|---|
| 1. | Reference Low Limit | — The turbine load reference is being limited by the low load limit. |
| 2. | Reference High Limit | — The turbine load reference is being limited by the high load limit. |
| 3. | Valve Position Limit | — The turbine governor valve output is being limited by the valve position limit. |
| 4. | Throttle Pressure Limit | — The turbine load reference is being run back because throttle pressure is below set point. No light is flashed in this case but a contact output is set during the throttle pressure limiting. |
| 5. | DEH Ready for Automatic | — The DEH control system has tracked the manual backup system and is ready to go on automatic control. |
| 6. | Valve Status Contingency | — While on automatic control, the DEH system has detected a valve LVDT position not in agreement with its corresponding analog output. |
| 7. | Governor Valve Contingency | — A governor valve LVDT position is not in agreement with its analog output. |
| 8. | Throttle Valve Contingency | — A throttle valve LVDT position is not in agreement with its analog output. |
| 9. | Invalid Request | — An invalid keyboard entry has been made. |

In order to determine whether to flash a light or to suppress flashing, the FLASH task maintains two arrays in core memory. One of these is called LIMIT and contains the current value of the nine limiting or flashing conditions listed above, as they are set by various other DEH programs. The second array is called OLDLIMIT and is an image of the immediate past value of the LIMIT array. These two arrays are examined every ½ sec by the FLASH task according to the following table of combinations:

FLASH TASK LAMP COMBINATIONS

| LIMIT | OLDLIMIT | Action |
|---|---|---|
| 0 | 0 | Do Nothing |
| 0 | 1 | Turn Light Off |
| 1 | 0 | Turn Light On |
| 1 | 1 | Turn Light Off |

After the proper action is taken by the FLASH task, the OLDLIMIT array is then updated to agree with the current LIMIT array for the next pass through the task ½ sec later.

A third array called CCOFLAG is also maintained by the FLASH task in order to set contact outputs when a limiting condition exists. The contact outputs are not set and reset regularly (as are the flashing lights) but rather the contacts are set and remain on as long as the flashing condition exists. When the flashing condition ceases the contacts are reset. A table of combinations illustrating this action

FLASH TASK CONTACT COMBINATIONS

| LIMIT | CCOFLAG | Action |
|---|---|---|
| 0 | 0 | Do Nothing |
| 0 | 1 | Reset Contact |
| 1 | 0 | Set Contact |
| 1 | 1 | Do Nothing |

It should be noted that only the first five flash conditions listed above have contact outputs associated with them; the remaining four simply flash Operator's Panel lights.

The control of the operation of the DEH control system 1100 is greatly facilitated for the operator. by the novel layout of the operator's panel 1130, the flashing and warning capabilities thereof, and the interface provided with the turbine control and monitor functions through the pushbutton switches. In addition, simulated turbine operation is provided by the DEH system for operator training or other purposes through the operation of the appropriate panel switches during turbine down time. Further, it is noteworthy that manual and automatic operator controls are at the same panel location for good operator interface under all operating conditions. More detail on the functioning of the panel pushbuttons is presented in Appendix 2 and elsewhere in the description of the DEH programs herein.

In addition the layout of the panel 1130 of FIGS. 15, 16 and 17 is unique and very efficient from operation and operator interface considerations. The control of the DEH system 1100 by the buttons of the panel 1130 and the software programs thereto provides improved operation of the computer 210 and turbine generator 10.

Software details of the panel 1130 interface are available in the appendices 3,4,5 and 6.

In the field-installation phase of computer control systems, checkout of all parts of the system can be a tedious and frustrating chore. Debugging of programs, computer hardware and plant wiring is often a slow and painful process, and isolation of problems to one of these areas is sometimes difficult. It is during this time that the CCO TEST task provides a powerful tool for helping to bring the DEH system to full operating capabilities quickly.

The CCO TEST task is patterned along the lines of the DEH Input/Output (I/O) listing. The I/O list has a description of all contact outputs in numerically increasing order, from C001 to C224. The list includes a verbal description of the contact output function, its bit position, hardware word, set channel, and cabinet-half-shell terminal connection information. Since each contact output is identified by its C-number, to set or reset a contact or group of consecutive contacts, it is necessary only to type in the contact number(s) from the Programmer's Console and bid the CCO TEST task. Since analog outputs are essentially groups of contact outputs, the CCO TEST task may also be used to set any value on an analog output. This allows additional soft-ware and hardware testing prior to interfacing of the entire system.

5. SEQUENCE OF EVENTS INTERRUPT PROGRAM

Once the PLANTCCI subroutine identifies the plant condition that changed state and activated the sequence of events program 1124 the execution of an appropriate function program may be initiated in accordance with the task priorities. Contact inputs scanned by the CCI subroutine are set forth in the input/output signal list in Appendix 4.

6. BREAKER OPEN INTERRUPT PROGRAM

Referring now to FIG. 1, if the breaker 17 opens thereby removing electrical load 19 from the generator 16, the turbine system 10 will begin to accelerate. The acceleration will overspeed the turbine generator system 10 and damage the turbine generator system 10 if it is not checked. It is mandatory that the turbine governor valves be closed an instant after the breaker opens, to cut off steam flow. The control system then reverts to speed control and positions the governor valves to maintain synchronous speed. In order to restrict turbine overspeed when the breaker 17 opens, the breaker open contact is used to produce an interrupt. The Monitor interrupt handler then runs a BREAKER OPEN INTERRUPT program 1710 which immediately closes the governor valves by setting the appropriate analog output to zero. An independent hydraulic overspeed protection system shown in Ser. No. 189,322 by Fiegbein and Csanady also acts directly under predetermined conditions to close the governor valves GV1-GV8 and the throttle valves TV1-TV4 by dumping the hydraulic fluid in the valve actuators thereby giving additional protection to the turbine system 10. When the hydraulic overspeed protection system reacts to a breaker open operation (i.e. a full load rejection), the turbine steam valves are directly and immediately closed and the DEH system functions on a following basis to update its valve position outputs to call for valve closure. When a partial load rejection occurs, i.e. the breaker remains closed, a control strategy like that described in the aforementioned Birnbaum Braytenbah and Richardson Patent 3,552,872 is effected by the DEH system.

7. TASK ERROR PROGRAM

A task error program 1810 shown in FIG. 6 has supervisory control over all the other programs in the DEH system 1100. If any program is not functioning properly in correspondence to certain predefined error conditions, the task error program 1810 will switch the DEH system 1100 to manual control thereby preventing any accident, overload, underload, overspeed, or underspeed from happening. Thus, the TASK ERROR program 1810 switches control of the turbine from automatic to manual if certain important control tasks are disabled by the Monitor during input/output activity. The TASK ERROR program 1810 is initialized by the Monitor error handler.

The P2000 Monitor is composed of a variety of programs which handle all I/O activity for the DEH system. Thus, when some turbine control program wishes to use the I/O system, it calls the proper Monitor handler with a set of arguments describing the function to be performed. The handler then carries out the request and returns to the calling task at the completion of the function. However, in usual applications, if the handler finds erroneous information in the arguments passed along by the calling task, then the I/O request is ignored and the calling task is disabled. An example of such an error is a zero, negative or non-existent register number when calling the contact output handler. An example of the usual operation of the P2000 Monitor in this particular case, i.e. in the DEH system, would be when a turbine operating program such as the panel task 1112 calls to use an input/output system such as the panel lamp program 1132. The panel task 1112 calls the monitor program 1122 with a set of arguments describing the function to be performed. The monitor program 1122 then carries out the request and returns to the panel task program 1112 at the completion of the function. However, if the monitor program 1122 finds erroneous information in the arguments or data passed along by the panel task 1112 then the input/output request for the panel lamp 1132 is ignored and the panel task 1112 is disabled. A monitor reference manual, TP043, of the Computer and Instrumentation Division of the Westinghouse Electric Corporation describes in detail all possible error conditions.

TURBINE TRIP INTERRUPT program provides for throttle and governor valve closure immediately after the turbine latch mechanism is released. The TURBINE TRIP INTERRUPT program is initiated by the Monitor interrupt handler.

The mechanical latching mechanism of a turbine has a series of interlocks which are designed to trip the turbine off the line when any serious discrepancy is found in the system. Such factors as hydraulic fluid system, mechanical levers, emergency trip button, and solenoids operated by detection circuits may unlatch the turbine. When this happens, all throttle and governor valves must be closed to cut off steam flow immediately, after which the turbine begins to decelerate.

8. TURBINE TRIP INTERRUPT PROGRAM

In FIG. 6, a turbine trip interrupt program 1850 is shown coupled to the plant wiring 1126 and to the throttle valves TV1-TV4 and the governor valves GV1-GV8 1021. If the turbine system 10 reaches a trip condition, and reaches a predetermined speed for example 105% of synchronous speed, a latch open contact 1852 changes state and indicates a trip to the turbine trip interrupt program 1850 by means of an interrupt signal. The Monitor interrupt handler then runs the TURBINE TRIP INTERRUPT program, which immediately calls for throttle and governor valve closure. Simultaneously the analog backup system detects the trip condition and provides a large closing bias voltage to the throttle and governor valve servo system, thus assuring via redundant circuits that all valves are closed. By closing all the valves in the turbine system 10, dangerous turbine overspeed and other conditions are avoided.

9. PANEL INTERRUPT PROGRAM

The PANEL INTERRUPT program responds to Operator's Panel pushbutton requests by decoding the pushbutton identification and bidding the PANEL task to carry out the appropriate response. The PANEL INTERRUPT program is initiated by the Monitor interrupt handler.

The DEH turbine control system is designed to provide maximum flexibility to plant personnel in performing their function of operating the turbine. This flexibility is evidenced by an Operator's Panel with an array of pushbuttons arranged in functional groups, and an internal software organization which responds immediately to pushbutton requests by the operator. The heart of this instant response is the interrupt capability of the DEH control system.

Pressing any panel pushbutton activates a diode-decoding network which identifies the pushbutton, sets a group of six contacts to an appropriate coded pattern, and generates an interrupt to the computer. The Monitor interrupt handler responds within microseconds and runs the PANEL INTERRUPT program, which does a demand contact input scan of the special panel pushbutton contacts and bids the PANEL task to carry out the function requested by the operator.

10. VALVE TEST, VALVE POSITION LIMIT AND VALVE INTERRUPT PROGRAM

Certain valve testing and limiting functions have been a traditional turbine control feature over the years to provide assurance of the emergency performance of valves and to give the operator a final override on the control valve position. Thus, on line testing of throttle valves periodically will detect potential malfunctions of the throttle valve mechanism which could be dangerous if not corrected. In addition, valve position limiting of the governor valves during on line operation provides a manual means of limiting steam flow from the Operator's Panel.

In the DEH control system these two important functions are initiated by appropriate pushbuttons on the panel. As long as the operator presses one of these pushbuttons, the proper action is carried out by the CONTROL program. When the operator releases any of these pushbuttons, this generates a special interrupt to terminate the action which has been performed.

Referring again to FIG. 6, a valve test program 1810 and a valve position limit program 1812 are subroutines of the control task program 1020. The valve test program 1810 tests the operation of any predetermined valve or valves such as the throttle valves TV1 through TV4 by the operator pressing a valve test button 1814 of FIG. 16 on the operator's panel 1130. The valve position limit program 1812 of the control task 1020 operates when an operator presses either of the two buttons, valve position limit lower 1816 or valve position limit raise 1818 of FIG. 16.

Referring again to FIG. 16, upon the release of the valve test button 1814, the valve position limit lower button 1816 or the valve position limit raise button 1818 by an operator, the valve interrupt program 1158 shown in FIG. 6, is run by the monitor program 1122. The monitor program 1122 runs the valve interrupt program 1158 and thereby resets various flags and counters thus signaling to the control task 1020 that the action is to cease.

11. STOP/INITIALIZER PROGRAM

The STOP/INITIALIZE task 1162 (FIG. 6) initializes the DEH system to a known starting condition after the computer has stopped for any reason. (Note that stop here includes placing the computer out of sync.) The STOP/INITIALIZE task is assigned the highest priority level $F_{16}$ ($15_{10}$) and is bid by special insert instructions in the Monitor POWER-ON routine.

To control a continuously operating process successfully, a computer must be designed to run for very long periods of time without stopping. However, it must be recognized that power failures, computer hardware malfunctions of program errors will eventually cause all control computers to stop at some time in their operation. At these times, backup systems take over the process while the necessary maintenance is done on the computer or its software.

In FIG. 6, a stop/initializer program 1162 is shown ancillary to the clock program 1120. Should the DEH system 1100 have a power failure or be turned off, the stop/initializer program 1162, which has the highest priority (FIG. 9) of any program in the DEH system 1100, starts to run. Within the time that the voltages of the power supplies, not shown, decay to an unusable limit, the stop/initializer program 1162 sets the DEH system 1100 into a known state for the impending stop. Upon restarting, the stop/initializer program 1162 resets the system to the known state, i.e. it sets all contact and analog outputs to the throttle valves TV1 through TV4 and the governor valves GV1 through GV8 shown in box 1021 at reset position; all internal counters and logic states are reset; certain systems counters are set to starting values; a scan of all contact inputs from the plant wiring 1126 is carried out and the logic program 1110 is executed to align the DEH system 1100 to existing plant conditions. Finally, the controller reset lamp 1820 on the operator's panel 1130 as shown in FIG. 16 is turned on and the DEH system 1100 is ready to restart.

When the operator presses the CONTROLLER RESET button, thus acknowledging the fact that the DEH system is operational again, all periodic programs begin to execute regularly and the control system tracks to the existing plant conditions. Operation from this point on is identical in all respects to normal execution of the DEH control system programs.

12. VISUAL DISPLAY PROGRAM

Visual display of numerical information which resides in memory has been a traditional function of control computer systems. This feature provides communication between the operator and the controller, with both display and changing of internal information usually available. Continuous display of a quantity provides visual indication of trends, patterns and dynamic response of control system variables; periodically updated values of the displayed quantity are entered into the windows so that fast changes may readily be observed by operating and technical personnel.

The DEH control system has provision for visual display of six important control quantities through dedicated individual pushbuttons. In addition, complete valve status (i.e. position) may be displayed through a group of appropriate pushbuttons; all remaining control system variables, parameters or constants may be displayed through another pushbutton, in conjunction with keyboard-entered dictionary addresses which select the desired quantity for display.

The visual display program 1134 as shown in FIG. 6 is connected with the panel interrupt program 1156 and the auxiliary synchronizer program 1114. The visual display program 1134 controls the display windows 1138 with a reference window 1852 and a demand window 1854. The demand window 1854 and the reference window 1852 are also shown in FIG. 16 as part of the operator's panel 1130. By pressing an appropriate button such as the reference button 1856 a reference value will be displayed in the reference window 1852 and a demand value will be displayed in the demand window 1854. Similarly, for example, if a valve position limit display button 1858 is pressed a valve position limit value will be displayed in the reference window 1852 and the corresponding valve variable being limited is displayed in the demand window 1854. Upon pressing the load rate button 1858 the load rate will be displayed in the reference window 1852. In addition, a keyboard 1860 has the capability through an appropriate program to select virtually any parameter or constant in the DEH system 1100 and display that parameter in the reference window 1852 and the demand window 1854.

13. ANALOG SCAN PROGRAM

In order to carry out its function, a computer control system must be provided with input signals from the process or plant variables which are to be controlled. However, the vast majority of real process variables (for example pressure, temperature and position) are analog or continuous in their natural form, whereas the organization and internal structure of computers is digital or discontinuous in nature. This basic difference in information format between the controller and the controlled process must be overcome with interfacing equipment which converts process signals to an appropriate computer numerical value.

A device which can accomplish this function is the analog-to-digital (A/D) converter. The A/D converter provides the interface between plant analog instrumentation and the digital control system. Normally the analog signal as picked up from a transducer is in the millivolt or volt range, and the A/D converter produces an output bit pattern which may be stored in computer memory. A/D converters can only convert a limited number of analog inputs to digital form in a given interval of time. The usual method of stating this limit is to indicate the number of points (analog inputs) which can be converted in 1 sec. Thus, the A/D converter used in the DEH system has a capacity of 40 pps. Since the total number of analog inputs to the DEH system may be as high as 224, depending on the type of turbine to be controlled and the control system options selected, most of these must be scanned at a reduced frequency.

The nature of the plant variables which represent the analog inputs, and the sampling frequency of control programs using these inputs, are normally considered when one determines the scanning frequency of various analog input signals. In the DEH system, the control programs execute once a second and the primary analog signals used by the control system are generated megawatts, impulse pressure, throttle pressure, turbine speed and valve position. Since each of these variables may change a significant amount in a few seconds, all of these are scanned once a second. On the other hand, the majority of the analog inputs to the ATS program are temperatures which require minutes before significant changes in them may be observed. Consequently, all temperatures in the DEH system are scanned once a minute. The ATS program also requires a group of vibrations, which are scanned once every 5 sec, and a group of miscellaneous variables which are scanned once every 10 sec.

Figure 19:
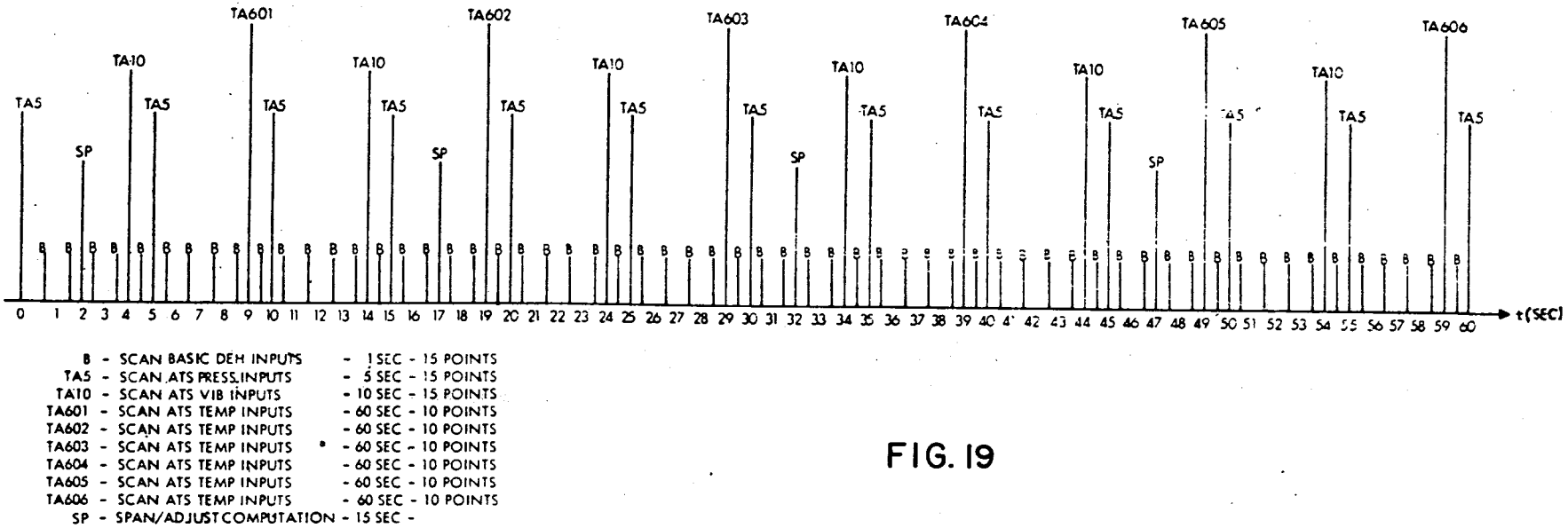
FIG. 19 is a timing chart of the various programs and functions within the Digitial Electric Hydraulic System which is operable in accordance with the principles of the invention.

A timing diagram, or scan-frequency chart, is shown in FIG. 19 to indicate the complete analog scanning system for an end-bar-lift turbine having two throttle valves and two governor valves. The scanning pattern has been designed so that the A/D converter and the DEH computer system have an approximately uniform distribution of activity. A close look at FIG. 19 will indicate that once every 15 sec the analog scan system performs what is known as a SPAN/ADJUST operation. The purpose of this is to adjust the analog input bit patterns to account for drift in the A/D converter electronic circuitry and to account for the frequency variations, since the A/D converter operates on a voltage to frequency conversion principle.

The analog scan program 1116, shown in FIG. 6 periodically scans all analog inputs to the DEH system 1100 for control and monitoring purposes. The function of the analog scan program 1116 is performed in two parts. The first part of the analog scan program 1116 comprises the scanning of a first group of analog inputs. Values of scanned inputs are converted to engineering units and the values are checked against predetermined limits as required for computations in the DEH computer.

The second part of the function of the analog scan program 1116 comprises the scanning of the analog inputs required for the automatic turbine startup program as shown in FIG. 6. Conversion and limit-checking of this latter group of inputs is performed by another program. The automatic turbine startup program is shown in FIG. 6 as the ATS periodic program 1140, the ATS analog conversion routine 1142 and the ATS message writer program 1144.

Figure 18:
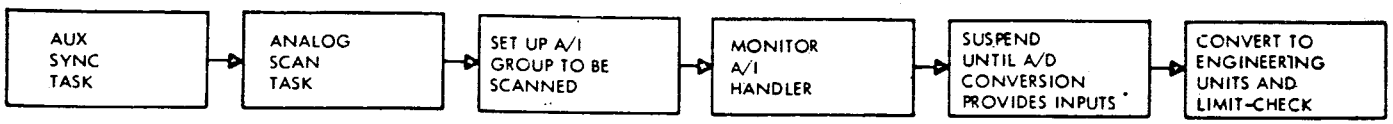
FIG. 18 is a block diagram of an analog scan system which is operable in accordance with the principles of the invention.

A functional organization diagram of the ANALOG SCAN task is shown in FIG. 18. The AUX SYNC task bids the ANALOG SCAN program every ½ sec. The ANALOG SCAN task then selects the appropriate group of inputs to be scanned, according to the timing diagram of FIG. 19, and calls the analog input handler portion of the Monitor. This handler triggers the A/D converter hardware to scan these points and suspends the ANALOG SCAN task until the bid patterns are available. The handler then restarts the ANALOG SCAN task, which converts the input bit patterns to engineering units, does appropriate limit-checking and makes logical decisions, and then exists until the next call from the AUX SYNC task, ½ sec later.

14. LOGIC TASK

The LOGIC task determines the operational status of the DEH turbine control system from information provided by the plant, the operator, and other DEH programs.

Figure 20:
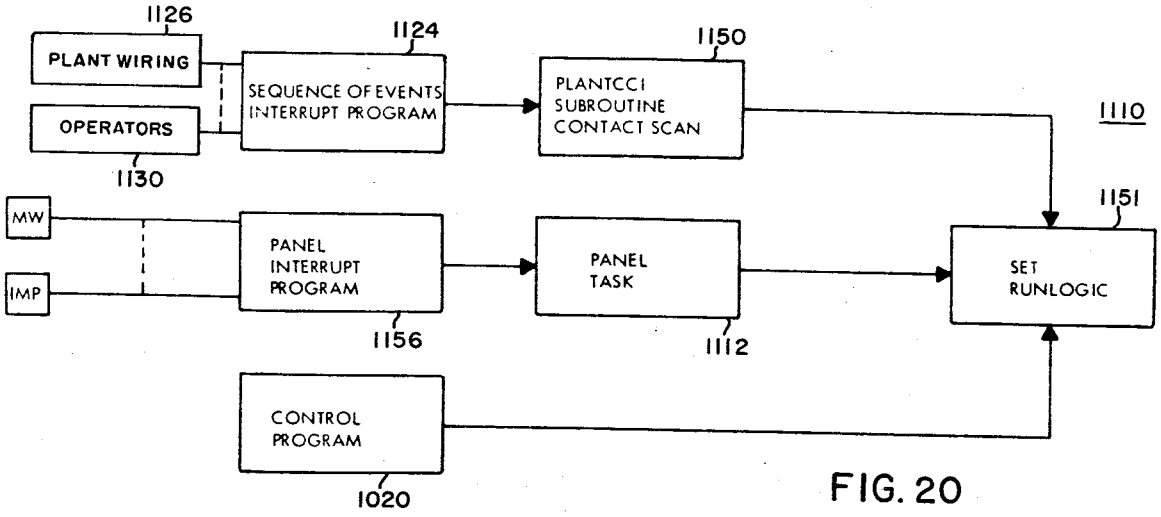
FIG. 20 is a block diagram of conditions which cause initiation of a logic program which is operable in accordance with the principles of the invention.
Figure 21:
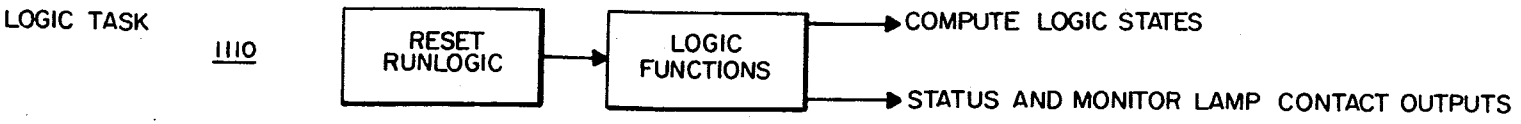
FIG. 21 is a simplified block diagram of a portion of the logic function which is operable in accordance with the principles of the invention.
Figure 22:
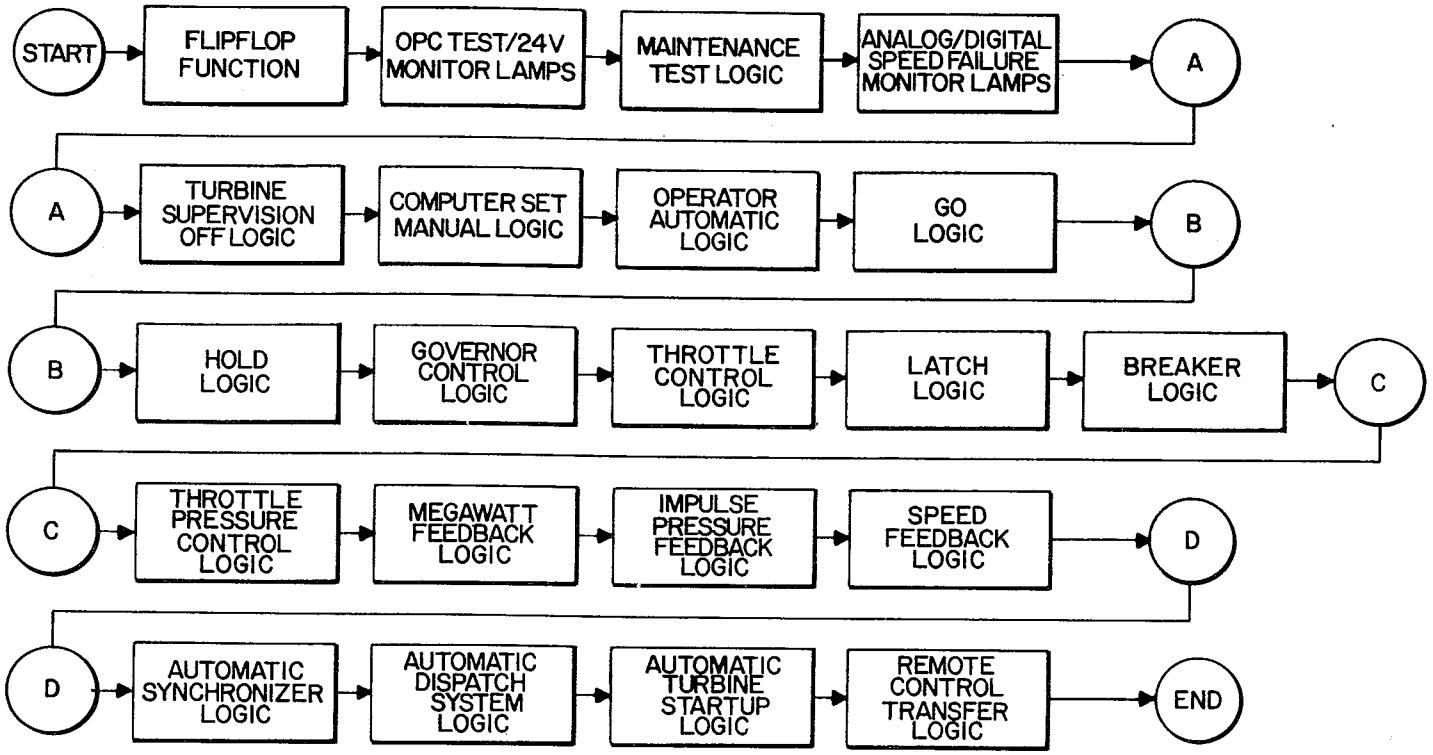
FIG. 22 is a block diagram of the logic program which is operable in accordance with the principles of the invention.

Referring now to FIG. 20, a block diagram representing the operation of the logic task 1110 is shown. A contact input from the plant wiring 1126 triggers the sequence of events or interrupt program 1124 which calls upon the plant contact closure input subroutine 1150 which in turn requests that the logic program 1110 be executed by the setting of a flag called RUN- LOGIC 1151 in the logic program 1110. The logic program 1110 is also run by the panel interrupt program 1156 which calls upon the panel task program 1112 to run the logic program 1110 in response to panel button operations. The control task program 1020 in performing its various computations and decisions will sometimes request the logic program 1110 to run in order to update conditions in the control system. In FIG. 21, the functioning of the logic program 1110 is shown. FIG. 22 shows a more explicit block diagram of the logic program 1110.

The mechanism for actual execution of the LOGIC program is provided by the AUX SYNC task, which runs every 1/10 sec and carries out the scheduled and demand bidding of various tasks in the DEH system. AUX SYNC checks the state of the RUNLOGIC flag and, if it is set, bids the LOGIC task immediately. Thus, the maximum response time for LOGIC requests is 1/10 sec; on the average the response will be much faster than this.

In order to allow immediate rerunning of the LOGIC task should system conditions require, the LOGIC program first resets RUNLOGIC. Thus any other program may then set RUNLOGIC and request a bid which will be carried out by the AUX SYNC program within 1/10 sec. There are two major results of the LOGIC task: the computation of all logic states necessary for proper operation of the DEH system, and the processing of all status and monitor lamp contact outputs to inform the plant control system and operating personnel of the state of the DEH system.

The logic program 1110 controls a series of tests which determine the readiness and operability of the DEH system 1100. One of these tests is that for the overspeed protection controller which is part of the analog backup portion of the hardwired system 1016 shown in FIG. 4. Generally, the logic program 1110 is structured from a plurality of subroutines which provide the varying logic functions for other programs in the DEH program system, and the various logic subroutines are all sequentially executed each time the logic program is run.

LOGIC CONTACT CLOSURE OUTPUT SUBROUTINE

The logic task 1110 includes a subroutine called a logic contact closure output subroutine 1910 (FIG. 20) therein. The logic contact closure output subroutine 1910 updates all the digital outputs to the status lamps and contacts 1128 for transmission thereto. The logic program 1110 handles a great number of contact outputs thereby keeping the output logic states of the DEH computer current. In addition, certain logical variables, which are normally set by the PANEL task, must be aligned by the LOGIC task with conditions as they exist instant by instant in the power plant. To do these functions in-line for each contact output in the LOGIC task would take considerable core storage to accommodate the individual situations. Thus, the logic contact closure output subroutine 1910 reduces the total storage requirements otherwise required for the logic program 1110.

MAINTENANCE TEST

In order to take advantage of the full flexibility, adjustability and dynamic response of the DEH system 1100 a maintenance test system 1810 is provided. The maintenance test program 1810 allows an operator to change, adjust or tune a large number of operational parameters and constants of the DEH system 1100. The constants of the DEH system 1100 can therefore be modified without extensive adjustment or reprogramming. An operator is able to optimize the DEH system 1100 from the control panel 1130 as shown in FIGS. 15 and 16 which allows for an essentially infinite variability in the choice of constants. Great flexibility and control is therefore available to an operator.

In addition, the maintenance test program 1810 allows an operator to use a simulation mode for operator training purposes.

TURBINE SUPERVISION OFF LOGIC

In the DEH control system, the ATS program 1141 is an optional feature which automatically accelerates the turbine during speed control and performs monitoring functions during load control. When this option is purchased by the user, the operator's panel has an extra back-lighted pushbutton which allows these turbine supervisory functions to be turned on or off at the operator's discretion. In addition to this off-on control, another mechanism exists to turn off the supervision programs. To understand this method, it is first necessary to realize that supervision means monitoring of a large number of analog inputs which represent various turbine metal and steam temperatures, steam pressures, and turbine mechanical vibrations. These analog inputs are converted to digital signals by an electronic analog-to-digital (A/D) converter and an analog scan program. As happens with any device occasionally, the A/D converter may be out of service for a short interval of time; since all analog inputs are then meaningless, it is necessary to immediately turn the turbine supervision programs off.

When the supervisory programs are off, whether due to the operator pressing the pushbutton or due to the A/D converter being out of service, the lamp behind the pushbutton is turned on. To place the supervisory programs back on, it is only necessary to press the button again and, assuming the A/D converter is in service, the lamp will be turned off.

COMPUTER SET MANUAL LOGIC

When the DEH system is in automatic control, it is possible for certain conditions to occur which require transfer to manual operator control. One of these is the case in which the maintenance test switch is moved to the test position. Even though a wired connection places the control in manual operation, the DEH LOGIC program sets a contact output requesting transfer to manual as a backup. The second situation occurs when the turbine is on automatic speed control and all speed input signals fail, as determined by the speed selection program in the CONTROL task. This speed channel failure will also require transfer to manual operation by a contact output from this LOGIC task.

BREAKER LOGIC

The state of the main circuit breaker which connects the generator to the power system determines a primary control strategy of the DEH system. When the breaker is open, the DEH system is on speed control and thus positions the throttle and governor valves to maintain speed demand as requested by the operator, an automatic startup program, or an automatic synchronizer. When the breaker is closed, the DEH system is on load control and thus positions the governor valves to maintain load demand as requested by the operator or by an automatic dispatching system.

The function of the breaker logic program is to detect changes in the state of the main breaker and take the appropriate action. When the breaker opens, it is necessary to reset the breaker flip-flop to place the DEH control system on speed control; in addition, both the REFERENCE and DEMAND are set to synchronous speed, and the speed integral controller is reset to zero. The control system will then position the governor valves to maintain synchronous speed. When the breaker closes and the unit is synchronized to the line, the breaker logic program must set the breaker flip-flop to place the DEH system on load control; in addition both the REFERENCE and DEMAND are set to pick up an initial megawatt load so that the turbine does not tend to motor. The control system will then position the governor valves to maintain this initial load.

Referring again to FIG. 1, upon synchronization of the turbine system 10 with a power grid, not shown, the governor valves GV1 through GV8 must allow sufficient steam to flow through the turbine system 10 to overcome turbine system losses. Otherwise, upon synchronization of the generator 16 with other generators in the power grid by closing the breakers 17, the turbine system 10 would as already indicated have a tendency to motor. The DEH control system 1100, in order to prevent motoring and subsequent damage to the low pressure turbine section 24, automatically opens the governor valves GV1 through GV8 such that a predetermined load is picked up by the generator 16 upon synchronization.

Figure 23:
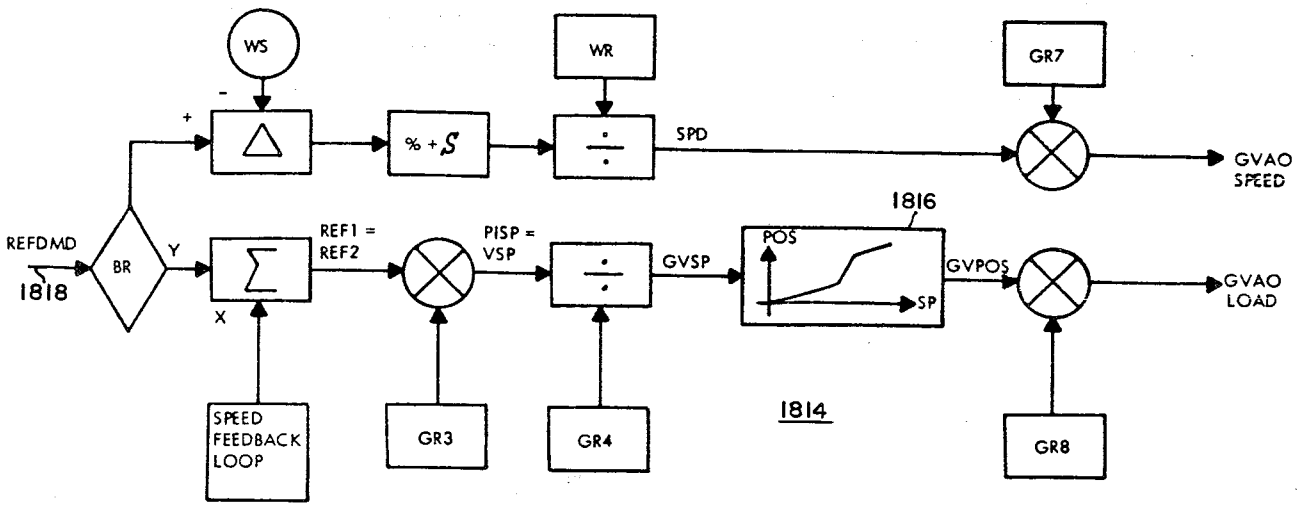
FIG. 23 is a block diagram of a load control system which is operable in accordance with the principles of the invention.

The value of the initial megawatt pickup is defined as MWINIT upon synchronization is entered from the keyboard 1860 in FIG. 16 and is typically set at about 5% of the rating of the turbine-generator 10. In the load control system 1814, as shown in FIG. 23, the actual megawatt pickup is modified by a factor which is the ratio of the rated throttle pressure to the existing throttle pressure at synchronization. This factor is utilized by the DEH system 1100 in maintaining approximately the same initial megawatt load pickup whether the turbine system 10 is synchronized at rated throttle pressure or at some lower or even higher throttle pressure.

A second condition must be handled by the breaker logic program to properly position the governor valves in picking up initial load. This concerns the fact that the governor valves just prior to synchronizing will be at some small position necessary to maintain synchronous speed. Then immediately after synchronization the initial megawatt pickup must be added to the existing valve position. Since the existing position is computed by the speed control program and the new position will be computed by the load control program, then an equivalent load position must be computed from the existing speed position. Reference is made to Appendix 3 for details on the Breaker Logic Program.

MEGAWATT FEEDBACK LOGIC

Megawatt feedback is one of the two major loops used on turbine load control to maintain the governor valves at the correct position. The other feedback is impulse pressure; between these two loops it is possible to adapt the computer outputs to account for valve non-linearities and to assure that the megawatt setting in the reference window is actually being supplied by the turbine/generator.

The megawatt feedback logic places the megawatt loop in service on request from an operator's panel pushbutton, providing all permissive conditions are satisfied, and removes the loop from service from the operator's panel pushbutton or when any condition exists which requires removing the megawatt feedback. Placing the loop in service or removing it is done bumplessly, so that the governor valves remain at the same position. In addition, the REFERENCE and DEMAND values are automatically adjusted to agree with the new state of the DEH control system.

Figures 25, 26:
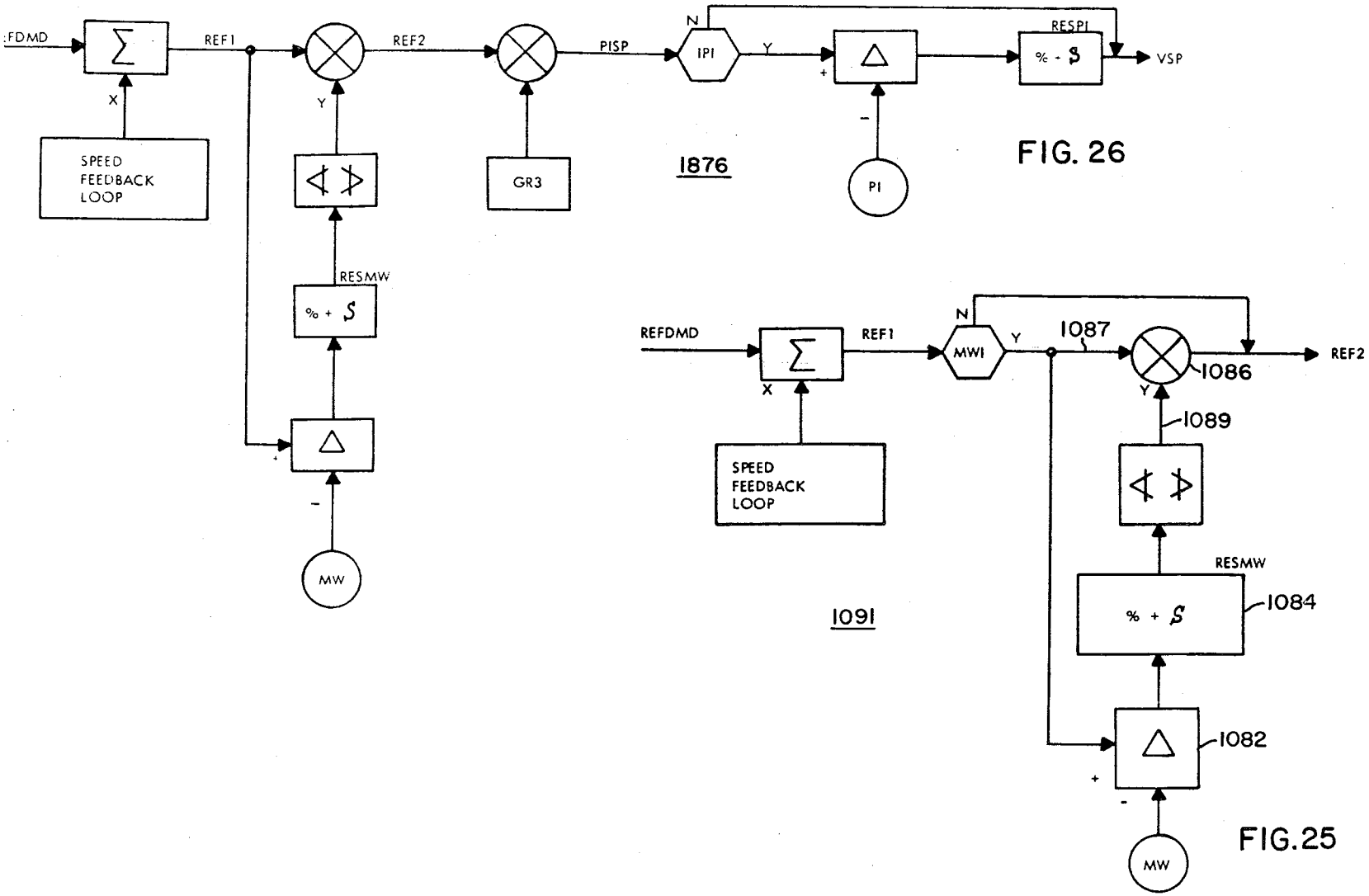
FIG. 25 is a block diagram of a megawatt feedback loop subroutine which is operable in accordance with the principles of the invention.
FIG. 26 is a block diagram of an impulse pressure loop with a megawatt loop in service which is operable in accordance with the principles of the invention.

Referring to FIG. 25, a block diagram of the megawatt feedback loop is shown in greater detail than in FIG. 5. It should be noted that the speed compensated reference 1087, at the input of multiplication function 1086, is multiplied by the megawatt compensation 1089. The multiplication of the signals instead of a differencing provides an additional safety feature since the loss of either of the signals 1087 or 1089 will produce a zero output rather than a runaway condition.

IMPULSE PRESSURE FEEDBACK LOGIC

Impulse pressure feedback is the other of the two major loops used in the turbine load control to maintain the governor valves at the correct position. The impulse pressure feedback logic places the impulse pressure feedback loop in service on request from an operator's panel pushbutton, providing all permissive conditions are satisfied, and removes the loop from service on request from the operator or when any condition exists which requires removing impulse pressure feedback. Placing the loop in service or removing it is done automatically and bumplessly, so that the governor valves remain at the same position. With a digital computer, bumpless transfer is achieved without the use of elaborate external circuitry because of the digital computational nature of the machine. A value can be computed instantaneously and inserted in the integrator 1218 of the proportional plus reset controller subroutine 1068 as shown in FIG. 9. In the preferred embodiment of the Digital Electro-Hydraulic control system 1100, the proportional plus reset controller 1168 is utilized by the following functions: the megawatt feedback loop 1091, the impulse pressure feedback loop 1816 and the speed feedback loop made up of the rated speed reference 1074, the compare function 1076 and the actual turbine speed function 1076.

During the process of accelerating a turbine on automatic speed control, the normal steps of operation may be summarized as follows: latch and roll the turbine on throttle control, accelerate to near synchronous speed, transfer to governor valve control, accelerate to synchronous speed, and synchronize the turbine with the power system. Most turbines are brought on the line with conventional automatic synchronizing equipment which carefully matches turbine conditions with power system conditions before automatically closing the main generator breaker.

Figure 27:
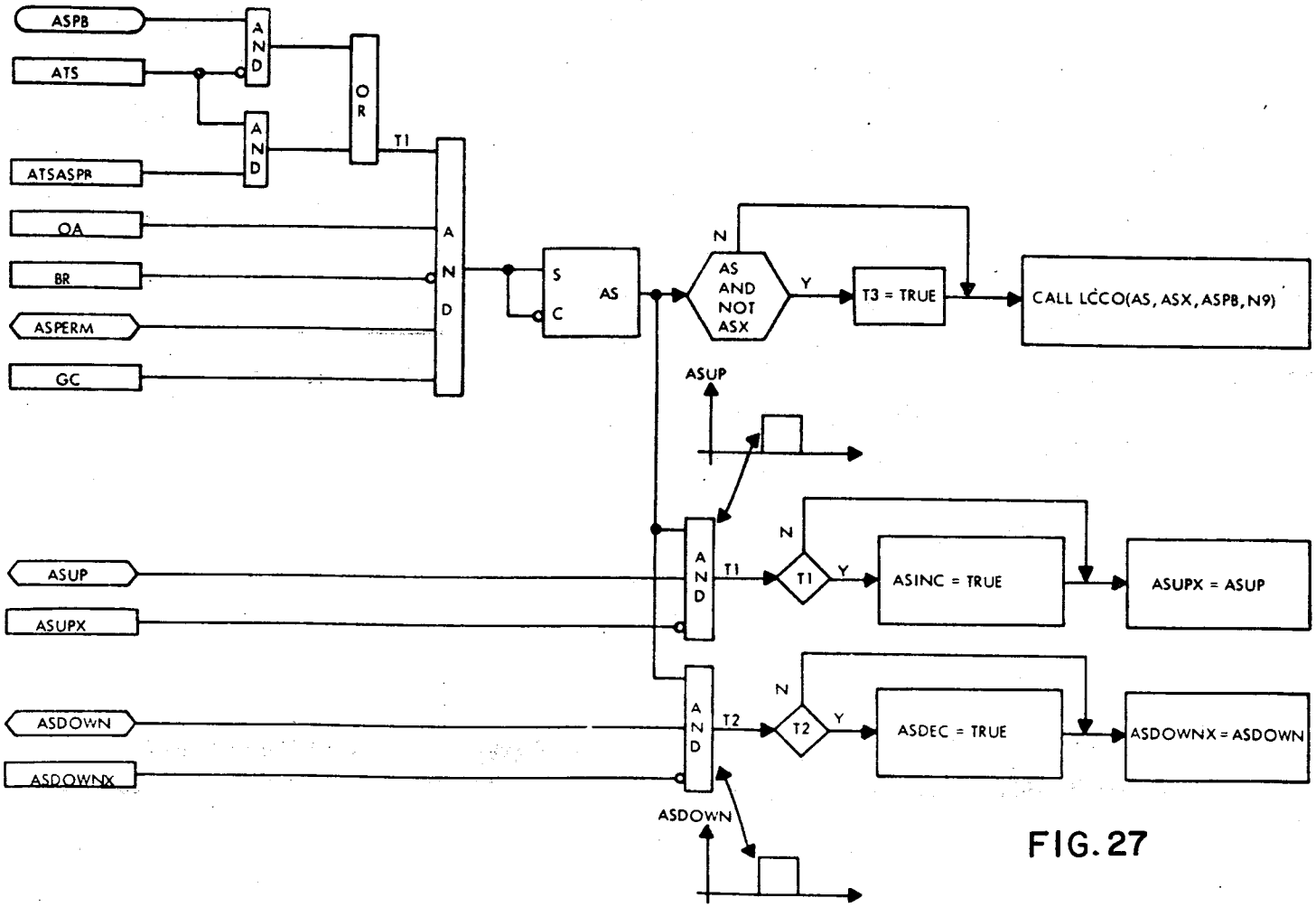
FIG. 27 is a flow chart of an automatic synchronize logic program which is operable in accordance with the principles of the invention.

The DEH control system 1100 provides an interface with synchronizing equipment by turning over supervision of the turbine reference and demand to the automatic synchronizer, which provides raise and lower pulses to the DEH system via contact inputs. Each pulse will raise and lower the turbine speed reference one rpm, thus providing the mechanism for adjusting the turbine speed to the power system. Provision has been made in the DEH system to allow selection of the auto sync mode through a pushbutton on the operator's panel or from an automatic turbine startup program, while the auto sync mode may be rejected by simply pressing the OPER AUTO pushbutton on the panel. The automatic synchronizer (auto sync) logic program detects those conditions concerned with auto sync, and sets all logical conditions accordingly, The turbine 10 operates in accordance with actions generated by the DEH control program in response to the synchronizer signals. FIG. 27 shows a flow chart of the automatic synchronizer logic program.

Because of the extreme accuracy of the ATS program 1141 in controlling the speed of the turbine 10 synchronization can be and preferably is performed without external automatic synchronizer equipment.

AUTOMATIC DISPATCH LOGIC

During the process of operating a turbine on automatic load control, the normal method of changing load is by entering new values of load demand from the keyboard, as described in the operating instructions. Then by using the GO and HOLD pushbuttons in conjunction with the load rate pushbutton, the operator may supervise the loading on the turbine which is actually carried out by the DEH system of control programs. This will result in the desired load being supplied to the power system by the turbine/generator.

Figure 28:
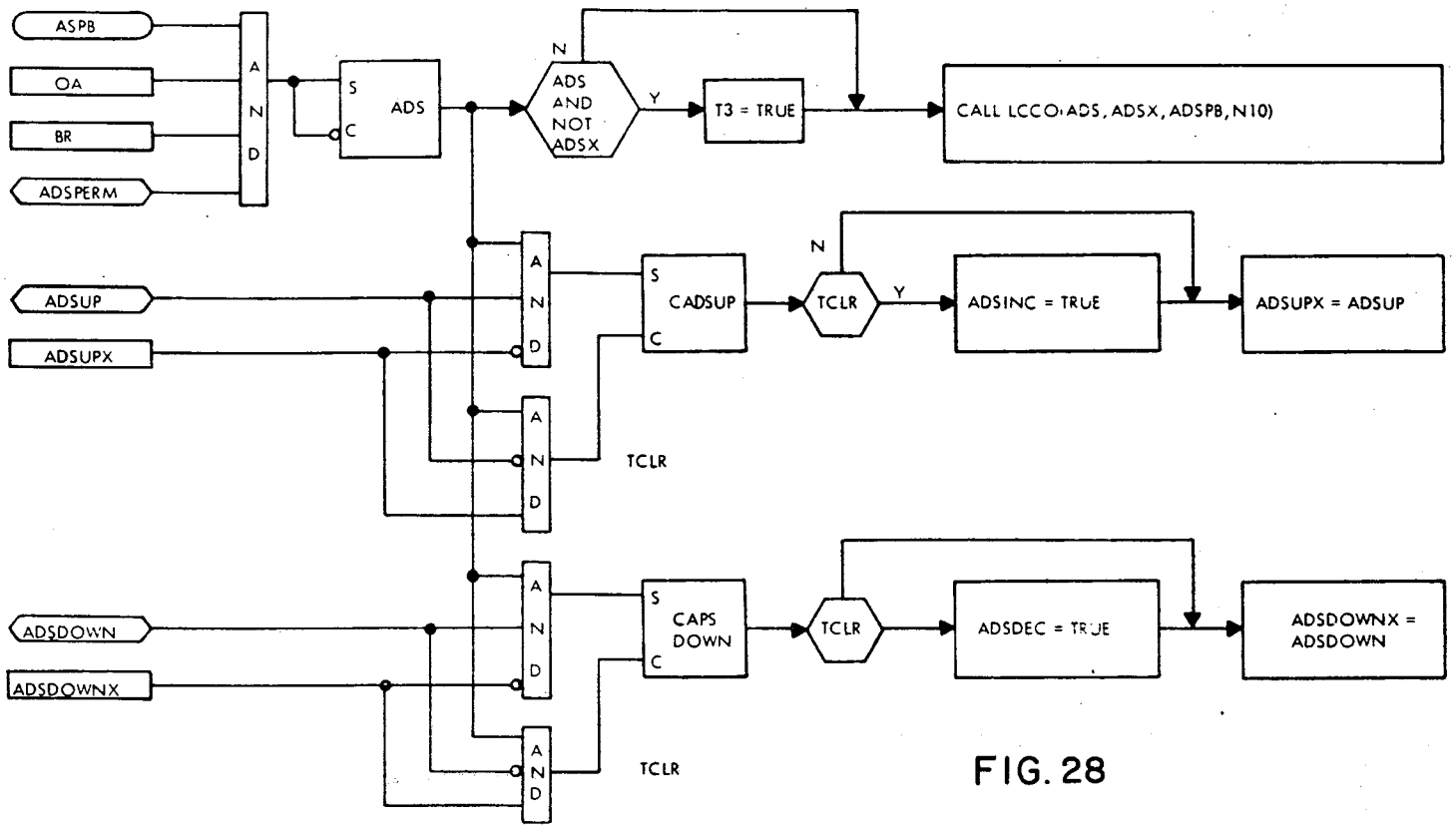
FIG. 28 is a flow chart of an automatic dispatch logic program which is operable in accordance with the principles of the invention.

Another method of supervising load on the turbine is through use of a remote automatic dispatching system. By turning over supervision of the turbine reference to an ADS operating mode, which provides raise and lower pulses whose width determines the requested load change, the DEH control system allows the turbine loading to be coordinated by a central dispatching office which can allocate total utility load on an economic basis to all units in the power system. Provision has been made in the DEH system to allow selection of the automatic dispatch mode through a pushbutton 1870 (FIG. 16) on the operator's panel; in addition, the ADS mode may be rejected by simply pressing the operator automatic pushbutton on the panel. The automatic dispatch logic program detects those conditions concerned with ADS, and sets all DEH states accordingly. A flow chart for the automatic dispatch logic program is shown in FIG. 28. It is triggered into operation on demand for automatic dispatch on order to interface the remote data with the DEH system.

AUTOMATIC TURBINE STARTUP (ATS) LOGIC

Modern methods of starting up turbines and accelerating to synchronous speed require careful monitoring of all turbine metal temperatures and vibrations to assure that safe conditions exist for continued acceleration. Until recently, these conditions have been observed by plant operators visually on various panel instruments. However, all of the important variables are rarely available from the plant instrumentation, and even if they were, the operator can not always be depended upon to make the right decision at a critical time. In addition to these factors, it is impossible to instrument the internal rotor metal temperatures, which are extremely important for indicating potentially excessive mechanical stresses.

To improve the performance at startup, automatic turbine accelerating programs have been written and placed under computer control. Such programs monitor large numbers of analog input signals representing all conceivable turbine variables, and from this information the program makes decisions on how and when to accelerate the unit. In addition, these programs numerically solve the complex heat distribution equations which describe temperature variations in the critical rotor metal parts. From these thermal computations it is possible to predict mechanical stresses and strains, and then to automatically take the proper action in the acceleration of the turbine.

The DEH system has such an automatic turbine startup program available as an optional item. Besides supervising the acceleration as described above, the program provides various messages printed on a typewriter to keep the operator informed as to the turbine acceleration progress. In addition, a group of monitor lamps are operated to indicate key points in the startup stages and to indicate alarm or contingency conditions. The automatic turbine startup logic program detects those conditions concerned with this DEH feature and sets all logical states accordingly.

REMOTE TRANSFER LOGIC

In the DEH turbine control system philosophy, the operator has overall autority in a control system hierarchy which has three general states: manual operation, operator automatic control, and remote automatic control. The manual operating mode is a contingency state which is used only when the computer is not available, as when the software control system is being tuned or modified. The operator automatic mode is the normal operating state during which speed/load demand and all other operating data are entered and displayed from the keyboard by the operator. Remote automatic control modes are those in which speed/load demand and rate are supervised from a source outside the basic DEH system.

The DEH Operator's Panel is the focal point of turbine operation; it has been designed to make use of the latest digital techniques to provide maximum operational capability. The Operator's Panel provides the primary method of communicating information and control action between the operator and the DEH Control System. This is accomplished through a group of pushbuttons and a keyboard (which together initiate a number of diverse actions), and two digital displays (which provide the operator with visual indication of internal DEH system numerical values).

When pressed, any of the buttons on the Operator's Panel provide momentary action during which a normally-open contact is connected to an electronic diode matrix. Operation of a button energizes a common computer interrupt for the Operator's Panel and applies voltage to a unique combination of 6 contact inputs assigned as a pushbutton decoder. The diode matrix may be used to identify up to 60 pushbuttons. When a button is pressed, the associated interrupt is read within 64 $\mu$ sec, and the corresponding contact inputs scanned and stored in computer memory as a bit pattern for further processing.

Each of the buttons on the panel are backlighted. When a button is pressed and appropriate logical conditions exist, the lamp is turned on to acknowledge to the operator that the action he initiated has been carried out. Should the proper logical conditions not be set, the lamp is not turned on. This informs the operator that the action he requested cannot be carried out.

A few of the buttons are of the digital push-push type which when pushed once initiate an action, and when pushed again suppress that action. Some of these buttons also contain a split lens which indicates one action in the upper half of the lamp and another (usually opposite) action in the lower lens. In addition, certain button backlights are flashed under particular operating circumstances and conditions.

The buttons and keys on the Operator's Panel may be grouped in broad functional groups according to the type of action associated with each set of buttons. A brief description of these groups follows:

1. CONTROL SYSTEM SWITCHING - These buttons alter the configuration of the DEH Control System by switching in or out certain control functions. Examples are throttle pressure control and impulse pressure control.

2. DISPLAY/CHANGE DEH SYSTEM PARAMETERS - These buttons allow the operator to visually display and change important parameters which affect the operation of the DEH system. Examples are the speed and load demand, high and low load limits, speed and and rate settings, and control system tuning parameters.

3. OPERATING MODE SELECTION - This group of buttons provides the operator with the ability to select the turbine operating mode. Examples are permitting an Automatic Synchronizer or an Automatic Dispatch System to set the turbine reference, or selecting local operator automatic control of the turbine (which includes hold/go action).

4. VALVE STATUS/TESTING/LIMITING - This group of buttons allows valve status information display, throttle/governor valve testing, and valve position limit adjustment.

5. AUTOMATIC TURBINE STARTUP - This group of buttons is used in conjunction with a special DEH program which continuously monitors important turbine variables, and which also may start up and accelerate the turbine during wide-range speed control.

6. MANUAL OPERATION - These buttons allow the operator to manually control the position of the turbine valves from the Operator's Panel. The DEH PANEL task has no direct connection with this group of buttons.

7. KEYBOARD ACTIVITY - These buttons and keys allow numerical data to be input to the DEH system. Such information may include requests for numerical values via the display windows, or may adjust system parameters for optimum performance.

Figure 31:
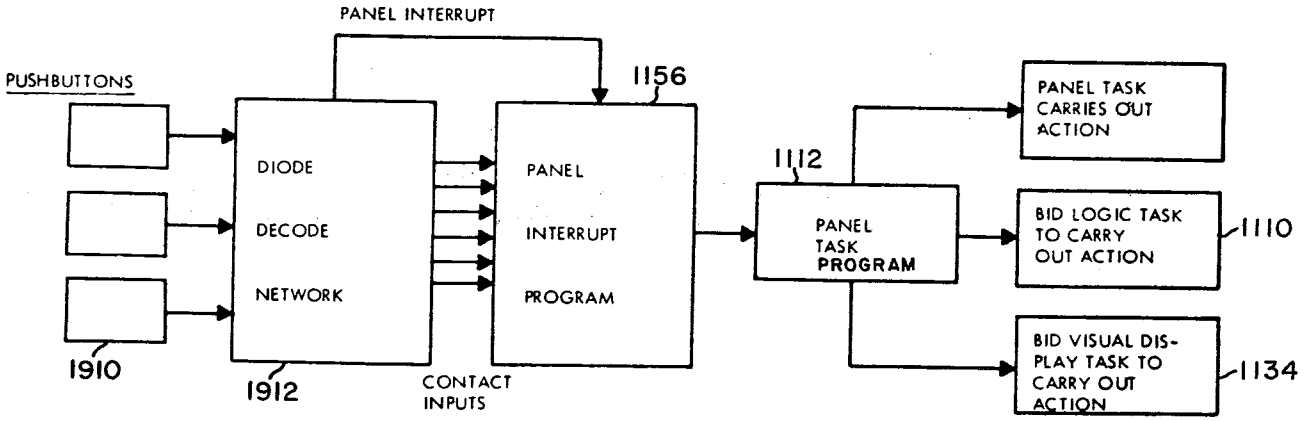
FIG. 31 is a block diagram showing a panel task interaction function which is operable in accordance with the principles of the invention.
Figure 32:
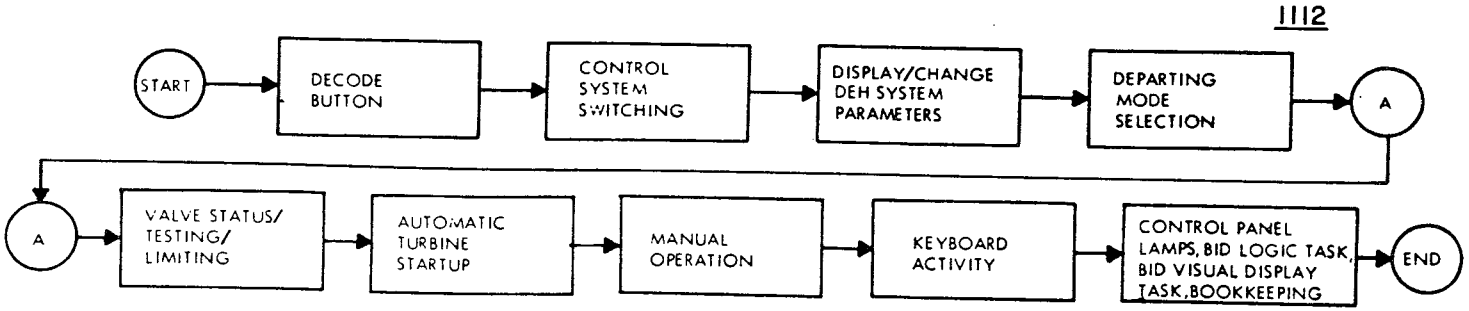
FIG. 32 is a block diagram of a panel program which is operable in accordance with the principles of the invention.

The panel task 1112 responds to the buttons pressed on the operator's panel 1130 by an operator of the DEH control system 1100. The control panel 1130 is shown in FIGS. 15 and 16. Referring now to FIGS. 31 and 32, the interactions of the panel task 1112 are shown in greater detail. Pushbuttons 1110 are decoded in a diode decoding network 1912 which generates contact inputs to activate the panel interrupt program 1156. The panel interrupt program scans the contact inputs and bids the panel task 1112 whereby the pressed button is decoded and either the panel task 1112 carries out the desired action or the logic task 1110 is bid or the visual display task 1134 is called to carry out the desired command.

Automatic control of turbine speed and load requires a complex, interacting feedback control system capable of compensating for dynamic conditions in the power system, the boiler and the turbine-generator. Impulse chamber pressure and shaft speed from the turbine, megawatts from the generator, and throttle pressure from the boiler are used in the controlled operation of the turbine.

In addition to the primary control features discussed above, the DEH system also contains provisions for high and low load limits, valve position limit, and throttle pressure limit; each of these can be adjusted from the Operator's Panel. A number of auxiliary functions are also available which improve the overall turbine performance and the capabilities of the DEH system. Brief descriptions of these follow:

1. Valve position limit adjustment from the Operator's Panel.

2. Valve testing from the Operator's Panel.

3. Speed signal selection from alternate independent sources.

4. Automatic instantaneous, and bumpless operating-mode selection from the Operator's Panel.

5. A continuous valve position monitor and contingency-alert function for the operator during automatic control.

6. A digital simulation and training feature which allows use of the Operator's Panel and most of the DEH system at any time on manual control, without affecting the turbine output or valve position. This powerful aid is used for operator and engineer training, simulation studies, control system tuning or adjustment, and for demonstration purposes.

In order to achieve these objectives, the CONTROL task is provided with analog inputs representing the various important quantities to be controlled, and also is supplied with contact inputs and system logical states.

Figure 33:
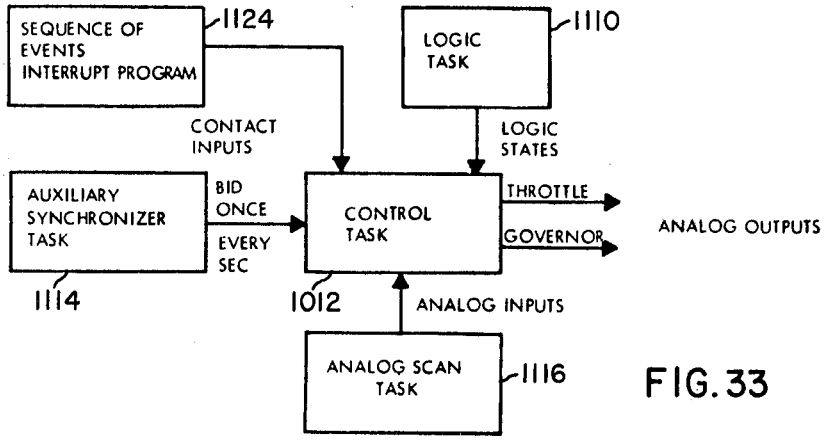
FIG. 33 is a block diagram showing a control task interface which is operable in accordance with the principles of the invention.
Figure 34:
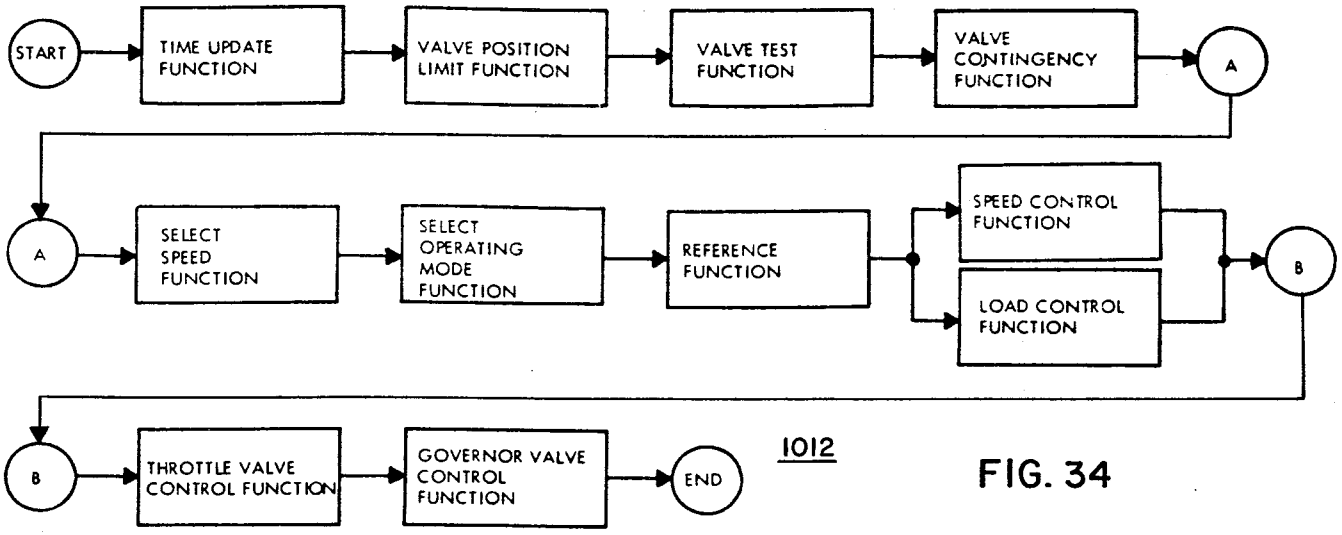
FIG. 34 is a block diagram showing a control program which is operable in accordance with the principles of the invention.

The control program 1012 and related programs are shown in greater detail in FIG. 33. In the computer program system, the control program 1012 is interconnected with the analog scan program 1116, the auxiliary sync program 1114, the sequence of events interrupt program 1124 and the logic task 1110. FIG. 34 shows a block diagram of the control program 1012. The control program 1012 accepts data from the analog scan program 1116, the sequence of events interrupt program 1124 and is controlled in certain respects by the logic program 1110 and the auxiliary synchronizing program 1114. The control program 1012, upon receiving appropriate inputs, computes the throttle valve TV1-TV4 and the governor valve GV1-GV8 outputs needed to satisfy speed or loud demand.

The control program 1012 of the DEH control system 1100 functions, in the preferred embodiment, under three modes of DEH system control. The modes are manual, where the valves GV1-GV8 and TV1-TV4 are positioned manually through the hardwired control system and the DEH control computer tracks in preparation for an automatic mode of control. The second mode of control is the operator automatic mode, where the valves GV1-GV8 and TV1-TV4 are positioned automatically by the DEH computer in response to a demand signal entered from the keyboard 1130, of FIG. 16. The third mode of control is remote automatic mode, where the valves GV1-GV8 and TV1-TV4 are positioned automatically as in the operator automatic mode but use the automatic turbine startup program 1141 or an automatic synchronizer or an automatic dispatch system for setting the demand value.

SPEED SELECTOR FUNCTION

When operating a steam turbine, the single most important variable which must be controlled is shaft speed. During load operation, speed regulation is necessary to help the power system maintain line frequency. During wide-range speed control, precise speed control is doubly important to bring the unit to synchronous speed and to overcome critical speed points at which excessive vibrations may cause a turbine trip. To accomplish such demanding control objectives, it is necessary to provide high-accuracy speed input signals to the control system so that exact valve position outputs may be computed by the speed controllers.

The DEH Control System has three independent speed signals available; these are used to achieve the precision required in speed control. The first of these (which is called the digital speed) is generated by a magnetic pickup, shaped and counted by specially-designed electronic printed circuitry, and passed on to the DEH Control System in the form of a digital numerical value. The second speed signal (which is called the analog speed) is generated by an identical independent magnetic pickup, processed in the analog packup circuitry for use there, and passed on to the DEH system as the analog input. The third speed signal (which is called the supervisory speed) is also generated by its own magnetic pickup, processed by supervisory instrumentation methods, and passed on to the DEH Control System as an analog input.

Figure 35:
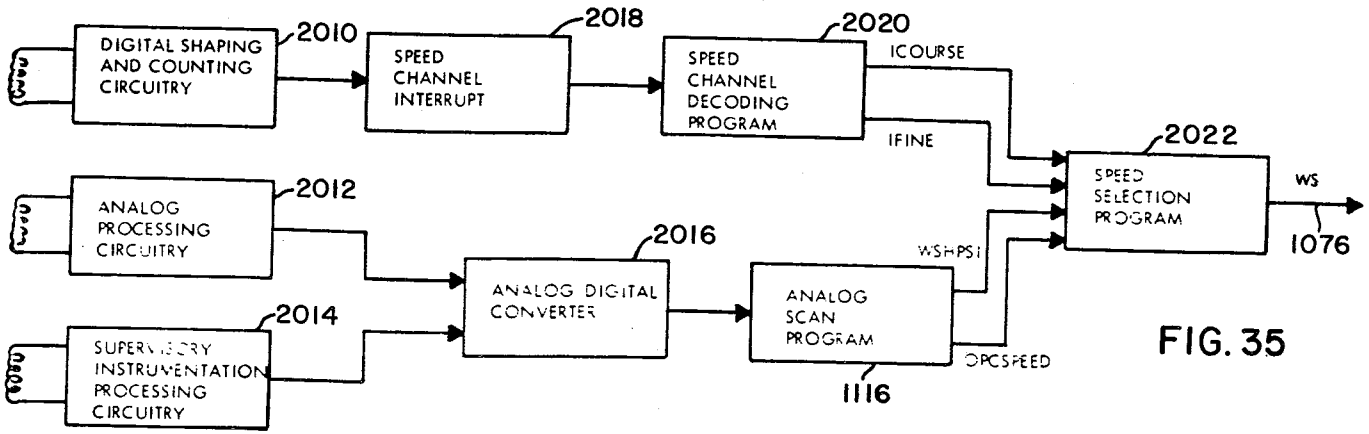
FIG. 35 shows a block diagram of speed instrumentation and computation interface with special speed sensing circuitry which is operable in accordance with the principles of the invention.

Referring now to FIG. 35, a block diagram of the DEH speed instrumentation and computation interface is shown. A digital counting and shaping circuit 2010 described in the copending Ruether application Ser. No. 412,513, referred to supra, generates the highly accurate digital signal. The digital shaping and counting circuitry 2010 includes a magnetic pickup, a shaping and counting circuit which passes the data to the DEH computer in the form of a digital numerical value. The second or analog speed signal is generated by high accuracy analog processing circuitry 2012. The third or supervisory signal is generated by analog supervisory instrumentation processing circuitry 2014 and transmitted to an analog to digital converter 2016 with the signal from the high grade analog processing circuitry 2012.

The digital signal from the digital shaping and counting circuitry 2010 passes through a speed channel interrupt 2018 to a speed channel decoding program 2020 as shown in FIG. 35. In this speed counting program 2020 an output quantity designated ICOURSE is the low range course value used from about 0 to 1600 rpm, while the IFINE quantity is the high range fine value used between about 1600 to 4500 rpm.

An analog to digital converter 2016 makes both the high precision analog signals from the analog processing circuitry 2012 and the supervisory circuitry 2014 available to the analog scan program 1116 which in turn provides the represented speed values available to the speed selection program 2022. The speed selection program 2022 compares the digital speed value and the high grade analog speed value with the supervisory analog speed value in order to determine whether both the digital value and the high grade analog value are accurate or whether there is any discrepancy between the two. The supervisory speed value is generally not accurate enough for speed control. Therefore, the speed selection program 2022 makes use of the supervisory speed value to determine which of the high grade speed values is accurate if they are not equal.

The speed selection function determines which of these available speed inputs should be used in the DEH Control System. If the speed selection process concludes that the digital speed is reliable, then under all circumstances it is used as the controlling speed signal because it is the most accurate. If the selection process concludes that the digital speed is unreliable, the analog speed is used as the controlling speed signal since it is of acceptable accuracy. If neither the digital nor the analog speed signal is reliable, the speed selection function must disable the speed feedback control loop, because the supervisory speed is not of acceptable accuracy for controlling turbine speed response.

Although the supervisory speed is unacceptable for control requirements, it performs a valuable role in helping to detion process is the value WS which is used by all other programs in the DEH system.

The digital speed value from the digital shaping and counting circuitry 2010 is used as the reference WS at 1076 if it is found to be accurate enough for control purposes. The high grade analog speed value from the analog processing circuitry 2012 is utilized if the digital speed value is not accurate enough for control purposes. If either of the high grade signals becomes unreliable, appropriate monitor lamps on the control panel 1130 alert an operator to this fact.

If both the high grade analog and the high grade digital speed values become unreliable and if the DEH system 1100 is on wide range speed control then a transfer takes place to the manual mode of control. However, if the turbine system 10 is on load control, the DEH system 1100 opens the speed feedback loop bumplessly and continues on automatic control with the remaining feedback loops intact.

SELECT OPERATING MODE FUNCTION

Input demand values of speed, load, rate of change of speed, and rate of change of load are fed to the DEH control system 1100 from various sources and transferred bumplessly from one source to another. Each of these sources has its own independent mode of operation and provides a demand or rate signal to the control program 1020. The control task 1020 responds to the input demand signals and generates outputs which ultimately move the throttle valves TV1 through TV4 and/or the governor valves GV1 through GV8.

With the breaker 17 open and the turbine 10 in speed control, the following modes of operation may be selected:

1. Automatic synchronizer mode — pulse type contact input for adjusting the turbine speed reference and speed demand and moving the turbine 10 to synchronizing speed and phase.
2. Automatic turbine startup program mode — provides turbine speed demand and rate.
3. Operator automatic mode — speed, demand and rate of change of speed entered from the keyboard 1860 on the operator's panel 1130 shown in FIG. 16.
4. Maintenance test mode — speed demand and rate of change of speed are entered by an operator from the keyboard 1860 on the operator's control panel 1130 of FIG. 16 while the DEH system 1100 is being used as a simulator or trainer.
5. Manual tracking mode — the speed demand and rate of change of speed are internally computed by the DEH system 1100 and set to track the manual analog back-up system 1016 as shown in FIG. 4 in preparation for a bumpless transfer to the operator automatic mode of control.

With the breaker 17 closed and the turbine 10 in the level mode control, the following modes of operation may be selected.

1. Throttle pressure limiting mode a contingent mode in which the turbine load reference is run back or decreased at a predetermined rate to a predetermined minimum value as long as a predetermined condition exists.

2. Run-back mode — a contingency mode in which the load reference is run back or decreased at a predetermined rate as long as a predetermined condition exists.

3. Automatic dispatch system mode — pulse type contact inputs are supplied from an automatic dispatch system to adjust turbine load reference and demand when the automatic dispatch system button 1870 on the operator's panel 1130 is depressed.

4. Operator automatic mode — the load demand and the load rate are entered from the keyboard 1830 on the control panel 1130 in FIG. 16.

5. Maintenance test mode — load demand and load rate are entered from the keyboard 1860 of the control panel 1130 in FIG. 16 while the DEH system 1100 is being used as a simulator or trainer.

6. Manual tracking mode — the load demand and rate are internally computed by the DEH system 1100 and set to track the manual analog back-up system 1016 preparatory to a bumpless transfer to the operator automatic mode of control.

The select operating mode function responds immediately to turbine demand and rate inputs from the appropriate source as described above. This program determines which operating mode is currently in control by peforming various logical and numerical decisions, and then retrieves from selected storage locations the correct values for demand and rate. These are then passed on to the succeeding DEH control programs for further processing and ultimate positioning of the valves. The select operating mode function also accommodates switching between operating modes, accepting new inputs and adapting the DEH system to the new state in a bumpless transfer of control.

Various contact inputs are required for raise and lower pulses, manual operation, maintenance test, and so forth; these are handled by the SEQUENCE OF EVENTS interrupt program and the PLANTCCI subroutine, which performs a contact input scan. In addition, certain panel pushbuttons affect the operating mode selection; these are handled by the PANEL INTERRUPT program and the PANEL task, which decode and classify the pushbuttons pressed. The LOGIC task then checks all permissive conditions and current control system status, and computes the appropriate logical states for interpretation by the CONTROL task and the SELECT OPERATING MODE program.

Figure 36:
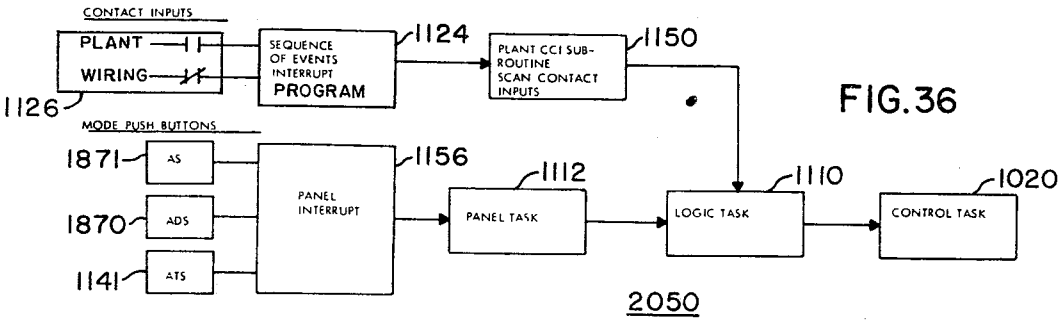
FIG. 36 shows a block diagram of an operating mode selection function which is operable in accordance with the principles of the invention.

Referring now to FIG. 36, a block diagram is shown illustrating the select operating mode function 2050. Contact inputs from plant wiring 1126 activate the sequence of events interrupt program 1124 which calls the plant contact input subroutine 1150, to scan the plant wiring 1126 for contact inputs. Mode pushbuttons such as automatic turbine startup 1141, automatic dispatch system 1170 and automatic synchronizer 1871 activates the panel interrupt program 1156 which calls the panel program 1112 for classification and which in turn calls upon the logic program 1110 to compute the logic states involved. The logic program 1110 calls the control program 1020 to select the operating mode in that program.

Figure 37A:
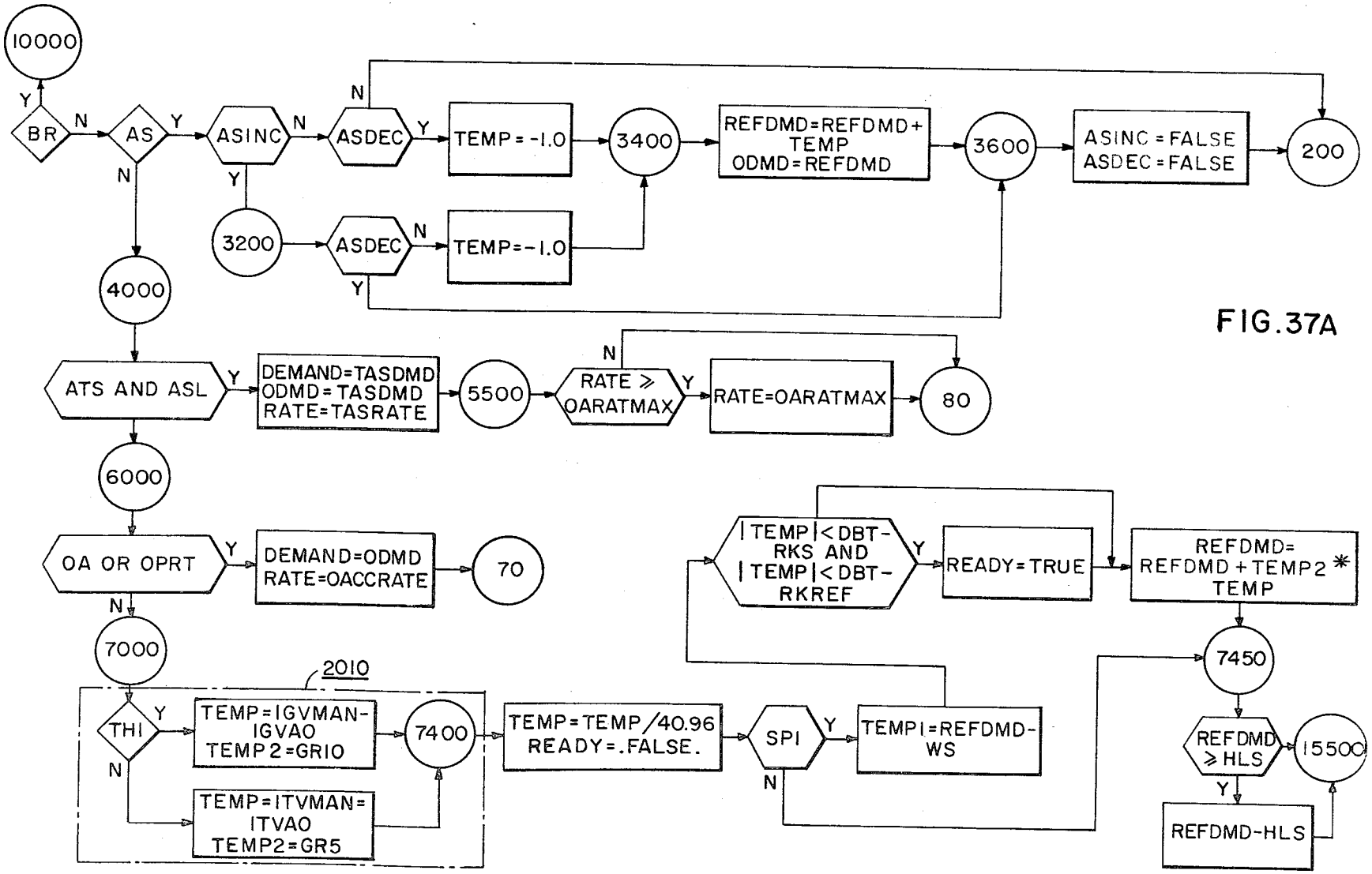
FIGS. 37A and 37B show a flow chart of a select operating mode function which is operable in accordance with the principles of the invention.
Figure 37B:
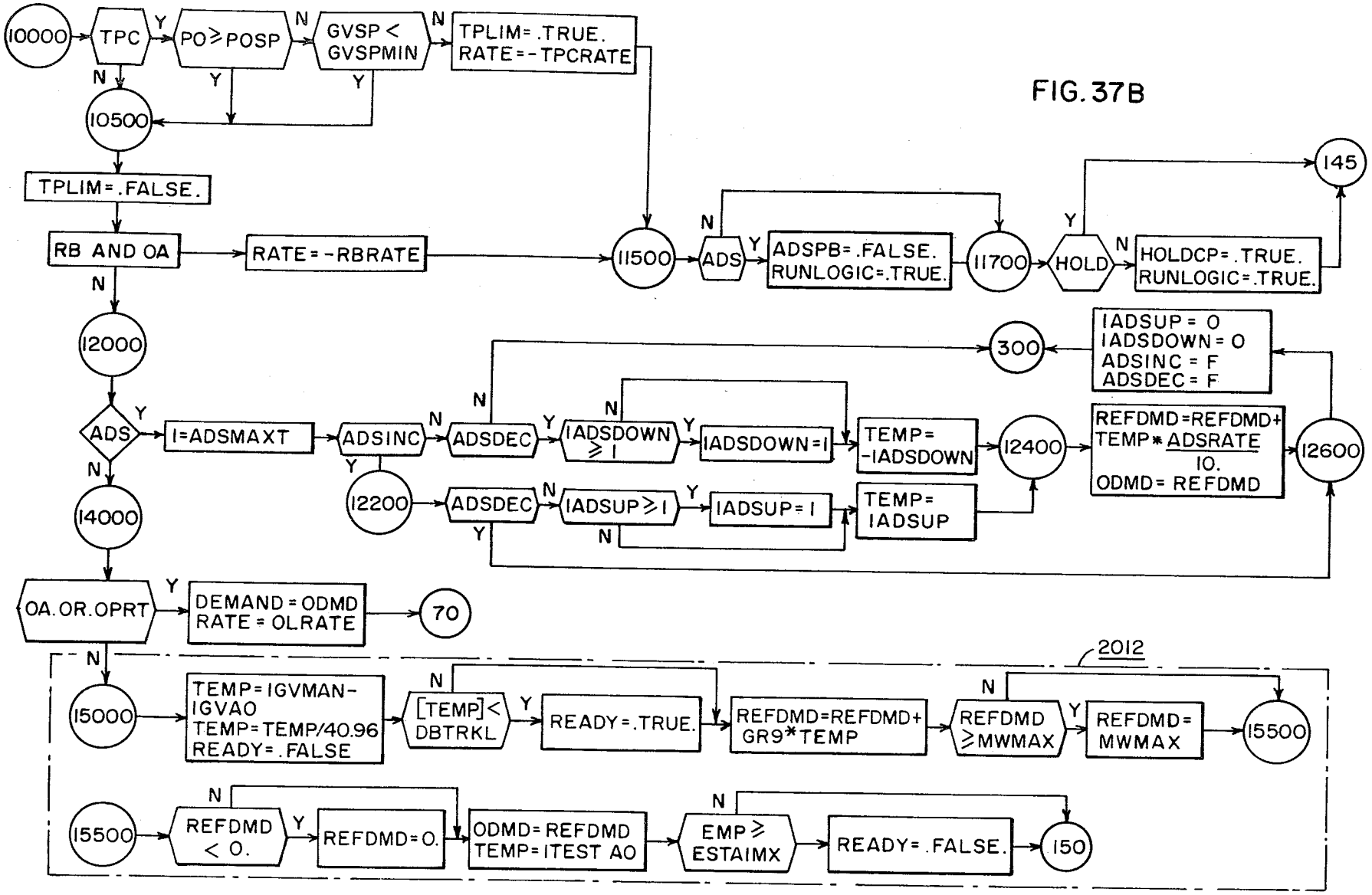

In FIGS. 37A and 37B a flow chart of the select operating mode logic is shown. As one example of mode selection referring to a path 2023, after a statement 7000, provisions are made for a bumpless transfer from an automatic or test mode to an operator mode. The bumpless transfer is accomplished by comparing the computer outputs and the operator mode output signals for the governor valve GV1-GV4 positions. The DEH system 1110 inhibits any transfer until the error between the transferring output and the output transferred is within a predetermined deadband (DBTRKS). Bumpless transfer is accomplished by the DEH control system 1100 by comparing output from one mode of control of the governor valves GV and the throttle valves TV and the same output from another output mode controlling the same parameters. The flow chart of FIGS. 37A and 37B shows mode selection for a complete operating system. In a hardwired or analog control system, the analog parameter output, to be transferred to must continuously track the parameter output to be transferred from. This tracking method is expensive and cumbersome since it has to be done continuously and requires complex hardware. However, in a digital system, such as the DEH control system 1100, the equating of the two parameter outputs need be performed only on transfer. Therefore, great economy of operation is achieved.

SPEED/LOAD REFERENCE FUNCTION

Figure 38:
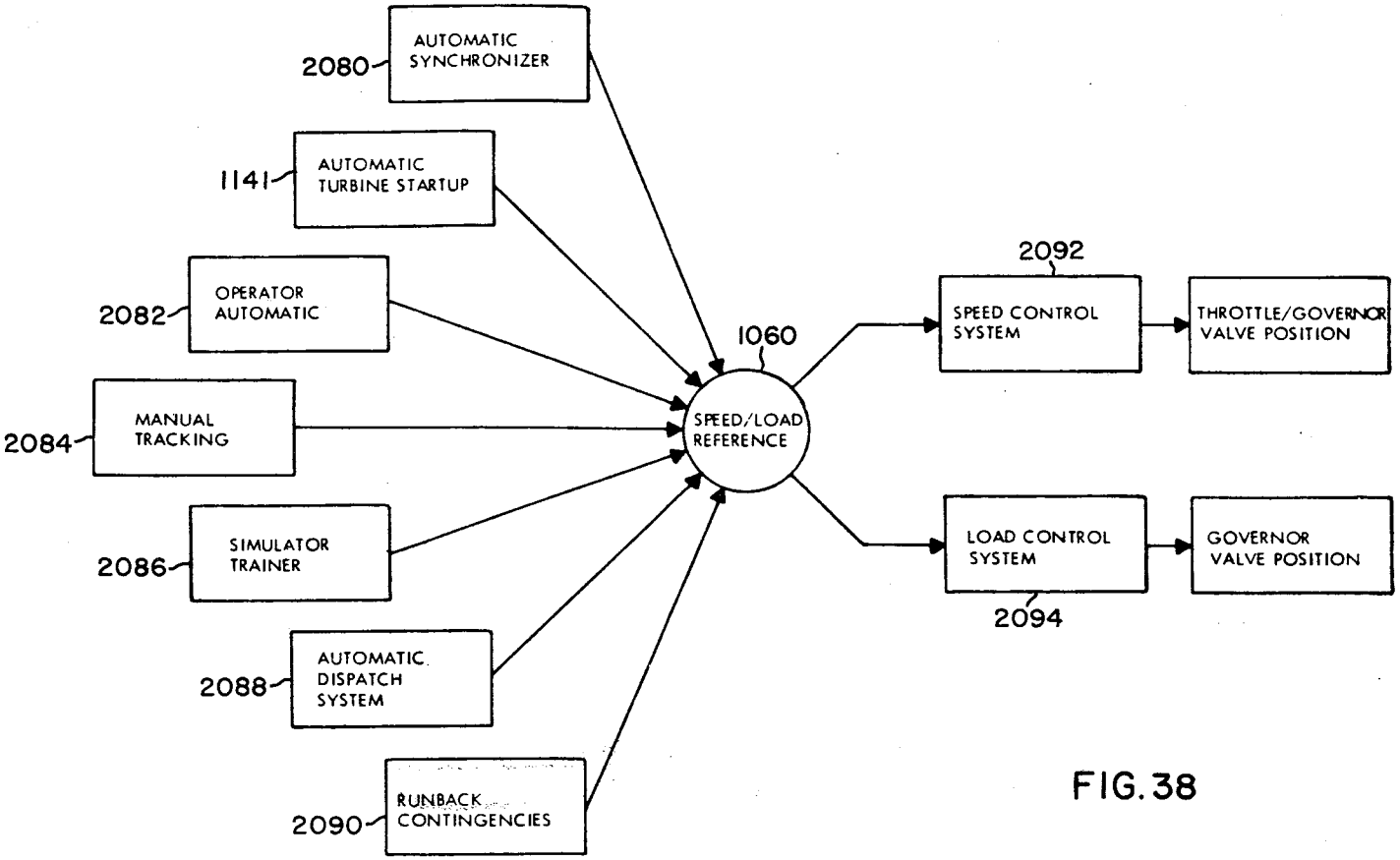
FIG. 38 shows a symbolic diagram of the use of a speed/load reference function which is operable in accordance with the principles of the invention.

In the DEH turbine controller, the speed/load reference is the central and most important variable in the entire control system. The reference serves as the junction or meeting place between the turbine speed or load demand, selected from any of the various operating modes discussed in the last section, and the Speed or Load Control System, which directs the reference through appropriate control system strategy to the turbine throttle and governor valves to supply the requested demand. FIG. 38 is a diagram which indicates the central importance of the reference in the DEH control system.

The speed/load reference function increments the internal turbine reference at the selected rate to meet the selected demand. This function is most useful when the turbine is on Operator Automatic, on the AUTOMATIC TURBINE STARTUP program, or in the Simulator/Trainer modes. This is because each of these control modes requests unique rates of change of the reference, while the remaining control modes, such as the Automatic Synchronizer and the Automatic Dispatch System, move the reference in pulses or short bursts which are carried out in one step. The Runback and Throttle Pressure contingency modes use some of the features of the reference function, but they bypass much of the subtle reference logic in their hurry to unload the turbine.

For these modes which request movement of the reference at a unique rate, the reference function must provide the controlled motion. Not only must the rate be ramped exactly, but the logic must be such that, at the correct time, the reference must be made exactly equal to the demand, with no overshoot or undershoot. In addition, the reference logic must be sensitive to the GO and HOLD states, and must start or stop movement instantly if requested to do so. Finally, the reference system must turn off the GO and HOLD lamps, if conditions dictate, by passing on to the LOGIC task the proper status information to accomplish this important visual indication feature.

The decision breaker function 1060, of FIG. 5, is identical to the speed/load reference function 1060, of FIG. 38. A software speed control subsystem 2092 of FIG. 38, corresponds to the compare function 1062, the speed reference 1066 and the proportional plus reset controller function 1068, of FIG. 5. The software load control subsystem 1094, of FIG. 38, corresponds to the rated speed reference 1074, the turbine speed 1076, the compare function 1078, the proportional controller 1080, the summing function 1972, the compare function 1082, the proportional plus reset controller function 1084, the multiplication function 1086, the compare function 1090, the impulse pressure transducer 1088 and the proportional plus reset controller 1092, of FIG. 5. The speed/load reference 1060 is controlled by, depending upon the mode, and automatic synchronizer 1080, the automatic turbine starter program 1141, and operator automatic mode 1082, a manual tracking mode 2084, a simulator/trainer 2086, an automatic dispatch system 2088, or a run-back contingency load 2090. Each of these modes increments the speed/load reference function 1060 at a selectd rate to meet a selected demand.

SPEED CONTROL FUNCTION

Figure 39:
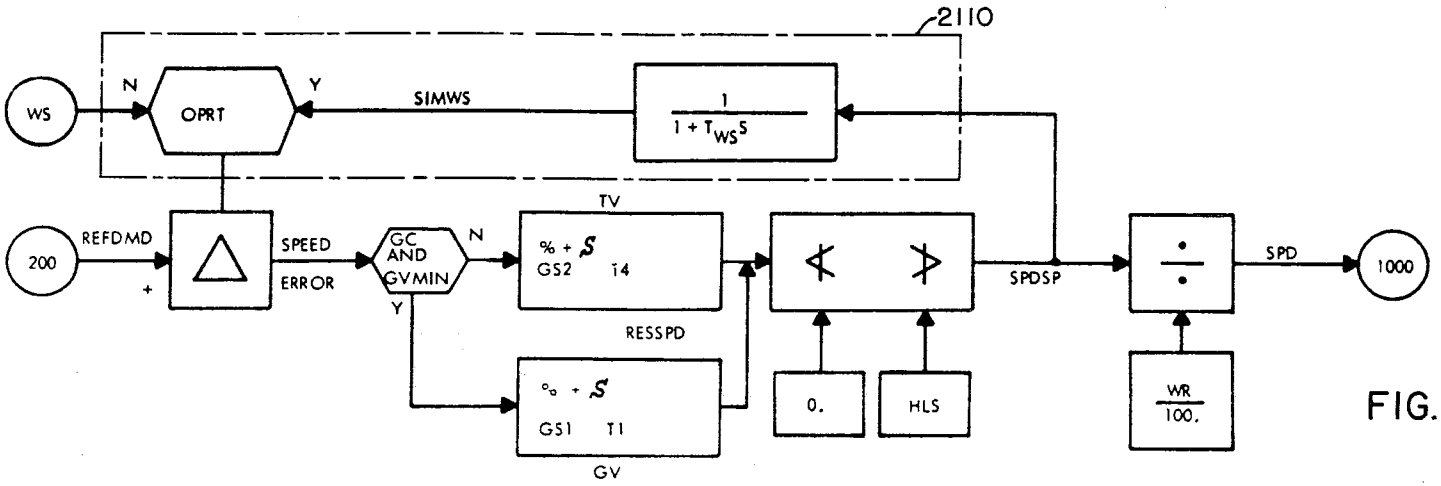
FIG. 39 is a block diagram showing a speed control function which is operable in accordance with the principles of the invention.

The speed control function positions the throttle and governor valves to achieve the existing speed reference with optimum dynamic and steady state response. This is accomplished by using individual proportional-plus-reset controllers for throttle and governor valve speed control, as shown in FIG. 39. The speed error between the turbine speed reference and actual speed drives the appropriate controller, which then reacts by positioning the proper valves to reduce the speed error to zero. The speed controller outputs are low-limit checked against zero and high-limit checked against the quantity HLS, which is a keyboard-entered constant set at 4200 rpm. This prevents the controllers from reaching a reset-windup condition which may inadvertently occur in odd circumstances. The speed controller output is then suitably ranged from 0 to 100 percent and sent downstream as the quantity SPD in the CONTROL task to the THROTTLE and GOVERNOR VALVE programs.

LOAD CONTROL FUNCTION

Figure 40:
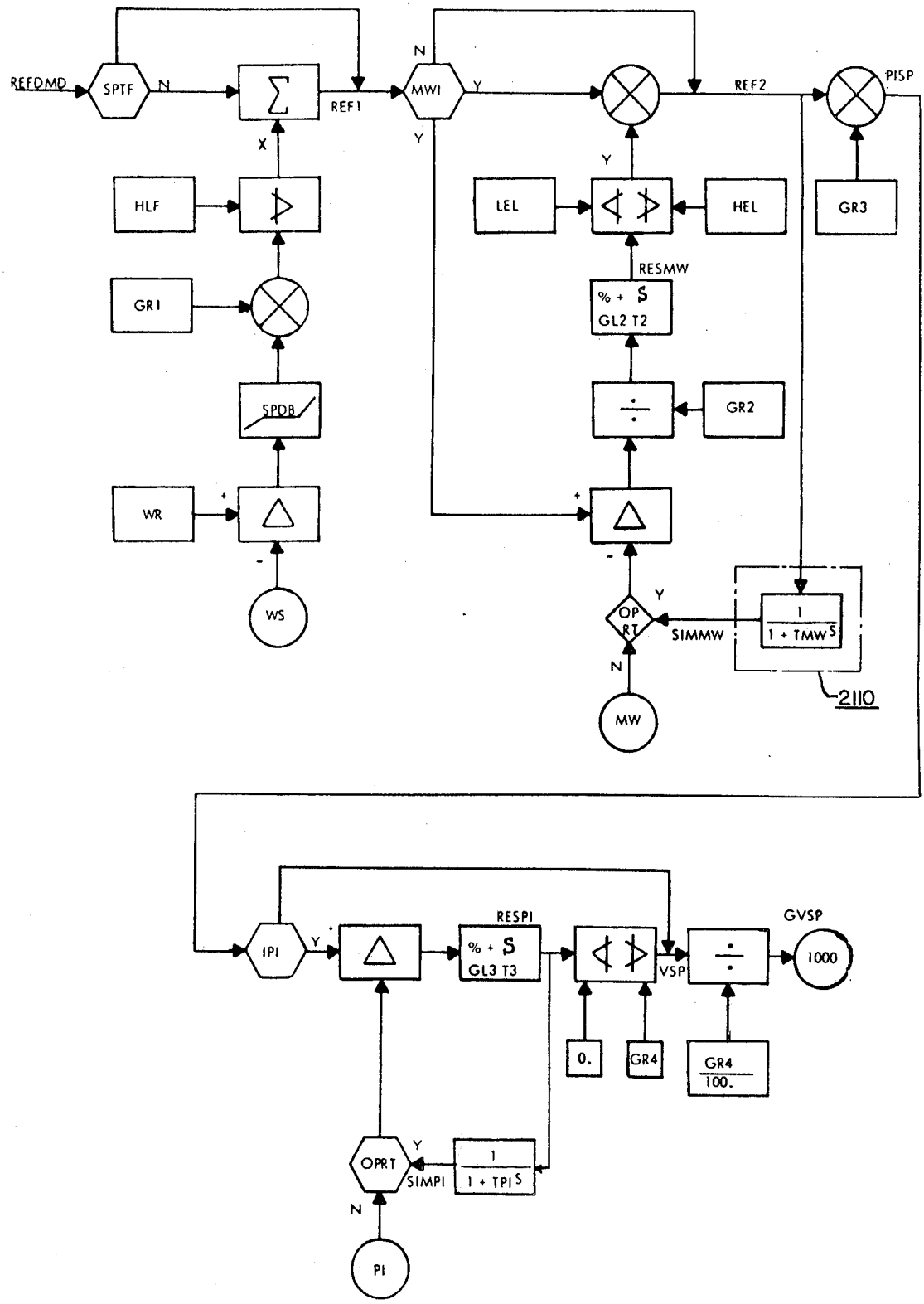
FIG. 40 shows a block diagram of the load control system which is operable in accordance with the principles of the invention.
Figure 41:
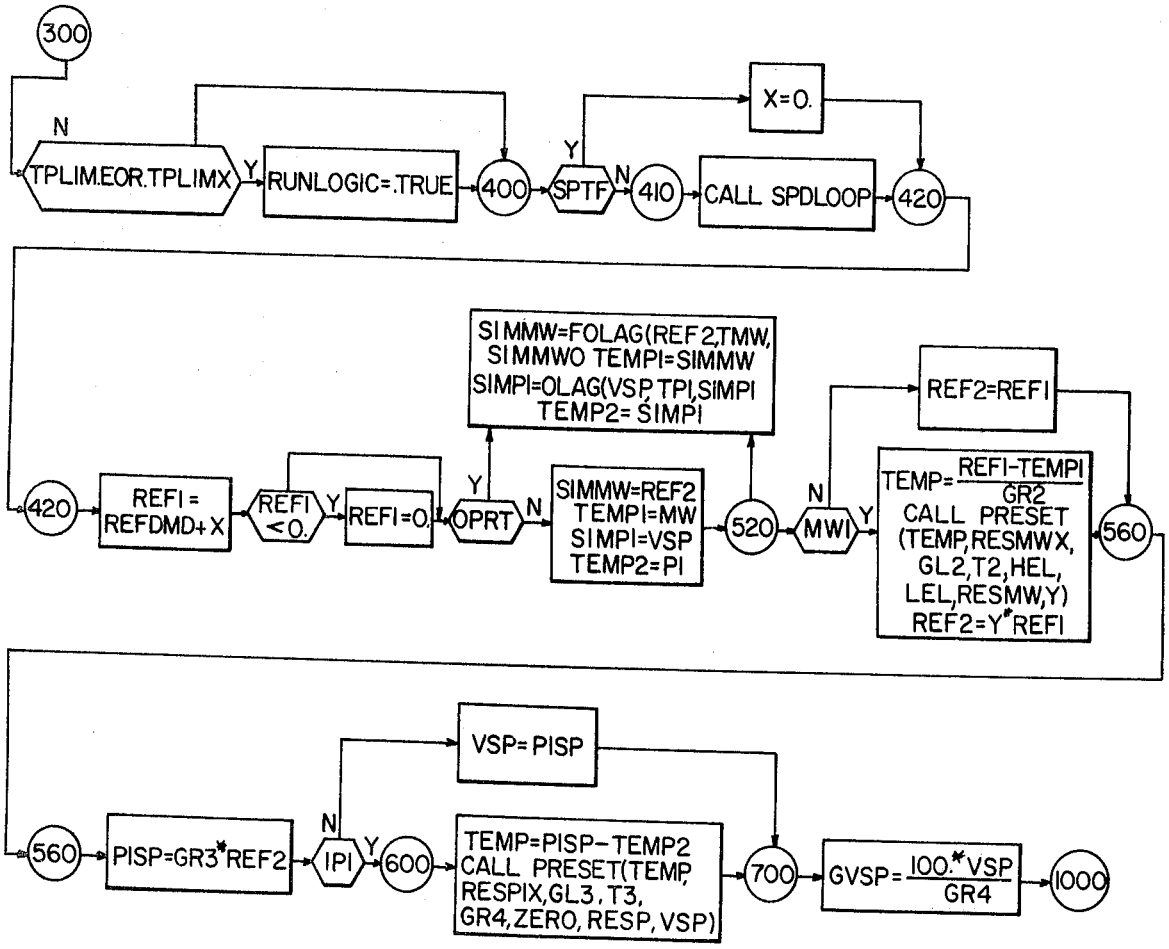
FIG. 41 includes a flow chart of the load control system which is operable in accordance with the principles of the invention.

The load control function positions the governor valves to achieve the existing load reference with optimum dynamic and steady state response. This is accomplished with a feedforward-feedback control system strategy designed to stabilize interactions between the major turbine-generator variables: impulse chamber pressure, megawatts, shaft speed and valve position. FIGS. 40 and 41 show the control system which satisfies these objectives.

The main feedforward path is represented by the turbine load reference value (REFDMD), which is computed by the operating mode selection function described earlier. The feedforward variable (REFDMD) is compensated with two feedback trim factors to account for frequency (speed) participation and megawatt mismatch. The speed compensation is provided by a proportional feedback loop in which the droop regulation gain (GR1) is adjusted to yield rated megawatts correction for a 180 rpm speed error. This speed feedback factor (X) is then summed with the turbine load reference (REFDMD) to produce the speed-corrected load reference (REF1).

A special feature which has been incorporated in the speed feedback loop is a software speed-deadband; this non-linear function filters out high-frequency low-amplitude noise on the speed input signal, thus keeping the load control system from responding to such meaningless information. The width of the speed deadband may be adjusted from the keyboard by setting the appropriate value into the constant SPDB. Another special feature of the speed deadband is the method of implementing this function in comparison with most standard control systems. The common way to incorporate the speed deadband in previous systems is to allow speed errors greater than the width of the deadband to enter the control system completely. This has been found to shock many systems into oscillatory conditions which may have undesirable effects. In the DEH Control System the speed error, when it is larger than the deadband, is smoothly entered into the speed compensation factor by a linear relationship. Thus the shock effect of a sudden speed error is removed completely.

The megawatt feedback loop provides a trim correction signal which is applied to the speed-compensated load reference (REF1) in a product form to yield the speed-and-megawatt corrected load reference (REF2). An additional highly desirable feature of megawatt feedback in the DEH system is that with it the reference and demand display windows on the Operator's Panel are calibrated in actual megawatts when the loop is in service. A proportional-plus-reset controller is used to reduce megawatt error to zero, with the loop providing a feedback factor (Y) which floats around unity (1.0) in performing its corrective action. As usual, high and low limits are provided to prevent reset windup and to bound the range of megawatt compensation.

The load reference (REF2), now corrected for speed and megawatt errors, becomes the set point for the impulse pressure cascade feedback loop or the direct demand for valve position, depending on whether the impulse pressure loop is in or out of service. REF2 is multiplied by a ranging gain (GR3) to convert to impulse pressure set point (PISP) in psi. If the loop is in service, then a proportional-plus-reset controller is implemented to drive the impulse pressure error to zero; as always, high and low limits restrict the range of variation of the controller to eliminate the possibility of reset windup. The final governor valve set point (VSP), whether it is generated by the feedback loop or directly from the load reference (REF2), is then converted into a percent valve demand (GVSP) by suitable ranging and is sent downstream in the control task to the THROTTLE and GOVERNOR VALVE programs.

The load control function block diagram shown in FIGS. 65 and 65A is an expansion of the load control, shown in FIG. 5, incorporating the speed loop subroutine and proportional control of function diagram of FIG. 11.

THROTTLE VALVE CONOTROL FUNCTION

Figure 42:
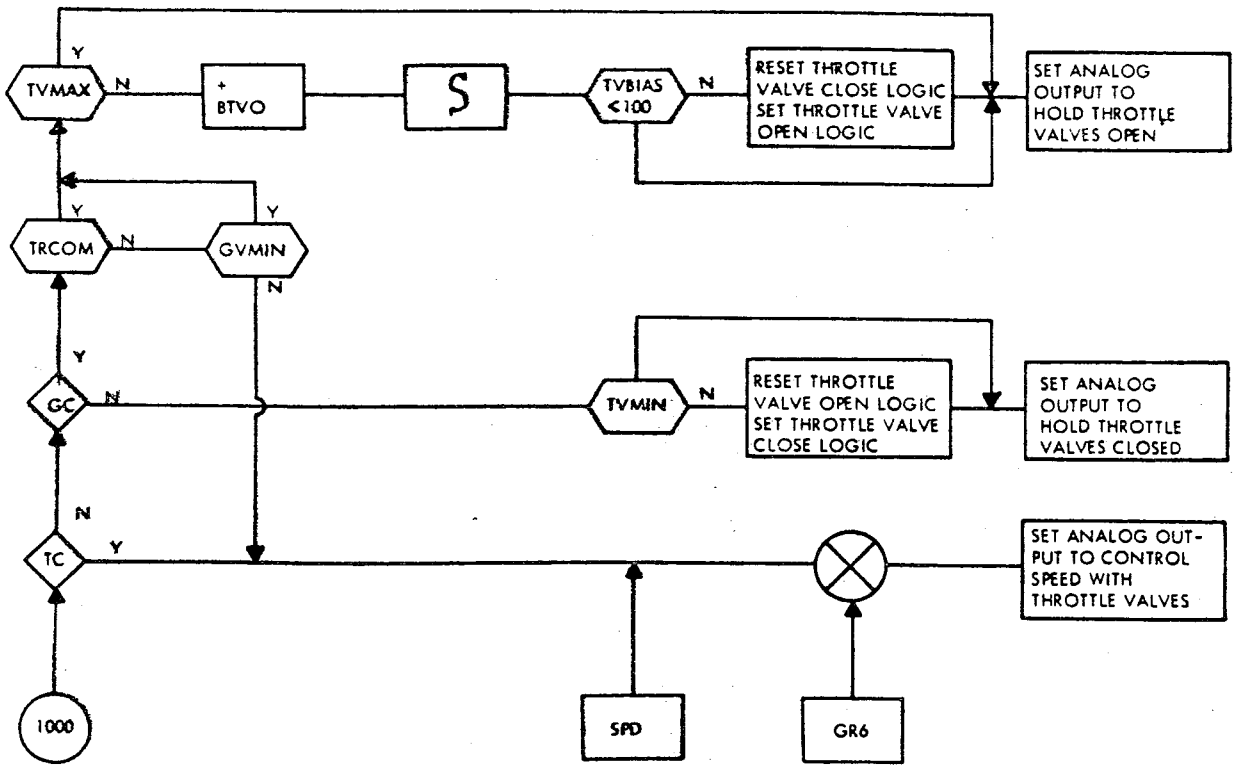
FIG. 42 shows a block diagram of the throttle valve control function which is operable in accordance with the principles of the invention.

The throttle valve control function (FIG. 42) computes the correct value of the throttle valve analog output at all times. When the DEH system is on automatic control, this analog output actually positions the throttle valves; when the DEH system is on manual control, this analog output tracks the backup system preparatory to transfer to automatic control.

To accomplish its objective, the throttle valve control function must interrogate various turbine logical and numerical states, and proceed to act on the outcome of these decisions. There are five distinct situations which must be detected by these logical and numerical interrogations. A brief description of these follow; refer to Figure for the method of performing these tests and the major actions taken.

1. The turbine is unlatched and in neither throttle nor governor valve control. During this time the throttle valves are held closed by the throttle valve control function.

2. The turbine is latched and in positive throttle valve control while the DEH system is in wide-range speed control. During this time the throttle valve control function accepts the output of the speed controller (SPD) and positions the throttle valves accordingly.

3. The DEH system is in a transition period, transferring from throttle to governor valves during wide-range speed control. For this interval of time, the throttle valves are still in positive control and the throttle valve control function continues to accept the speed controller output (SPD) and positions the throttle valves accordingly.

4. The DEH system remains in the transition period of transferring from throtte to governor valve control; but now the governor valves are in positive control. During this time the throttle valve control function drives the throttle valves to the wide-open position with a throttle valve bias integrator (TVBIAS), which has a constant input (BTVO) incrementing the integrator.

5. The transition period is over and the transfer from throttle to governor valve control is complete; the turbine is now on either wide-range speed control or on load control after having been synchronized with the power system. During this time the throttle valve control function keeps the throttle valves wide open.

GOVERNOR VALVE CONTROL FUNCTION

The governor valve control function (FIG. 43) computes the correct value for the governor valve analog output at all times. When the DEH system is on automatic control, this analog output actually positions the governor valves; when the DEH system is on manual control, this analog output tracks the backup system preparatory to transfer to automatic control.

To accomplish its objective, the governor valve control function must interrogate various turbine logical states and proceed to act on the outcome of these decisions. There are five distinct situations which must be detected by these logical interrogations. A brief description of these follows; refer to Figure for the method of performing these tests and the major action taken.

1. The turbine is unlatched and in neither throttle nor governor control. During this time the governor valves are held closed by the governor valve control function.

2. The turbine is latched and in positive throttle valve control while the DEH system is in wide-range speed control. During this time the governor valve control function drives the governor valves wide open with a governor valve bias integrator (GVBIAS).

3. The DEH system is in a transition period, transferring from throttle valve to governor valve control during wide-range speed operation. For this interval of time, the governor valve control function drives the governor valves to the closed position with the governor valve bias integrator (GVBIAS). The governor valve control function then waits for a decrease in turbine speed and for the Analog Backup System to track the computer outputs.

4. The DEH system remains in the transition period but now the governor valves are in positive control during wide-range speed operation. During this time the governor valve control function accepts the output of the speed controller (SPD) and positions the governor valves accordingly.

5. The main generator circuit breaker is closed and the DEH system is in load control. During this time the governor valve control function accepts the output of the load control system (GVSP) and positions the governor valves accordingly.

FIG. 67 shows a block diagram of the governor valve control function which computes the position of the governor valve output at all times.

TURBINE OPERATION SIMULATION

In order to allow operators to become proficient in the operation of the DEH system 1100 without risking damage to a multimillion dollar turbine-generator system 10 a simulation subroutine 2110, in FIG. 64, is provided during speed control. A similar subroutine 2111 is provided for simulation of the turbine-generator system dynamics.

BUMPLESS TRANSFER

A flow chart path (FIG. 43) allows for the smooth and bumpless transfer from governor valve control to throttle valve control and vice versa. A function 2102 tests whether a governor valve bias integrator GVBIAS has reached zero. By forcing the DEH system 1100 to wait until the governor valve bias integrator GVBIAS has reached zero a bumpless transfer from governor to throttle valve control and vice versa is effectuated. Other bumpless transfer features are considered elsewhere herein.

DEH SYSTEM PROGRAMS

AUXILIARY SYNCHRONIZER (AUX SYNC) TASK

The program first checks the CONTROLLER RESET pushbutton on the DEH Operator's Panel; if the button is backlighted, the operator has not acknowledged computer return from a power failure or an out-of-sync condition. When the button is pressed, the AUX SYNC task proceeds to carry out its functions.

The program checks three counters for timing. IVPL is incremented in 1/10 sec steps as long as the VALVE POSITION LIMIT RAISE or LOWER buttons are pressed. CADSUP is similarly incremented as long as the Automatic Dispatch System (ADS) raise contact input is set. CADSDOWN is incremented while the ADS lower contact input is set. Finally, if the RUN-LOGIC variable is set, AUX SYNC bids the LOGIC task to run.

The program then initiates a FORTRAN DO loop to check for normal execution of the DEH system periodic tasks. Each entry in the array ICOUNTER is incremented and tested against its maximum count (IMAX). If ICOUNTER has expired, it is reset to zero and transfer is made to appropriate portions of the remaining program. Otherwise the next counter is examined in the same way until all have been tested; at this time the AUX SYNC task exits until the next bid from the Monitor.

When the first ICOUNTER expires, the CONTROL task is bid and a flag (ISCAN) is set for further action in both the AUX SYNC and the ANALOG SCAN tasks. When the second ICOUNTER expires, logical decisions are made on ISCAN and INTSCAN to set up the necessary information to properly execute the ANALOG SCAN task. This task and the FLASH task are then bid to run.

When the third ICOUNTER expires, the AUTOMATIC TURBINE STARTUP (ATS) task is bid. In addition, the VISUAL DISPLAY task is bid if no key entry is being made on the Operator's Panel keyboard. The PLANTCCI subroutine is called if the constant PERCCI has been set non-zero from the keyboard to request a periodic contact input scan. Finally, when the fourth ICOUNTER expires the ATS MESSAGE WRITER task is bid.

The AUX SYNC program communicates with the various counters, flags and variables in the DEH system through the COMMON areas BETA, DELTA, ZETA and THETA. The program size is 135 words, the data pool size is 36 words, and the task header size is 9 words, for a required minimum storage of 180 locations. AUX SYNC is linked as a separate task and is loaded into the computer through the tape reader. The core area assigned to the task is from (14EO to 149F)$_{16}$; this is $CO_{16}(192_{10})$ locations, thus allowing some room for expansion.

VALVE INTERRUPT PROGRAM

The VALVE TEST CLOSEPB is interrogated to determine if it was the pushbutton released. If so, the pushbutton flag is reset and the contact output holding the throttle valve in a test close position is reset. If not, the VALVE TEST OPENPB is interrogated to determine if it was the pushbutton released. If so, the pushbutton flag is reset and the test analog output (TESTAO) is checked to determine if it has been reduced to zero. If not, no further action is taken since the test is not completed. But if the test analog output is zero, then the counter (NVTEST) indicating which valve was being tested is reset to zero and the contact output connecting this test signal to the governor valve servo amplifier is reset.

If neither the CLOSEPB nor the OPENPB had been released, then the VALVE INTERRUPT program concludes that it was a VALVE POSITION LIMIT RAISE or LOWER pushbutton; therefore, both of these are reset and return is made to the Monitor interrupt handler indirectly through location $OODF_{16}$ ($0223_{10}$) in the Monitor zero table.

ANALOG SCAN TASK

The ANALOG SCAN task is assigned priority level $B_{16}(11_{10})$ and is bid by the AUX SYNC task every ½ sec.

The ANALOG SCAN task communicates with other parts of the DEH system through various COMMON areas. The BETA COMMON contains the variable FLGWRD which is set by the Monitor analog handler to indicate that the A/D converter is out of service. The converted base DEH system analog inputs are stored in the GAMMA COMMON area, while DELTA contains the arrays SLOPE and BINT for conversion of inputs to engineering units. Additional logic states are accessed via ZETA COMMON, while the ATS analog inputs and control words are located in TAAI and TAADBUF.

The program first checks the value of ISCAN, which is set by the AUX SYNC program to indicate whether to scan base DEH inputs or ATS inputs. These groups are each scanned on alternate ½ sec; the AUX SYNC task arranges the timing so that ½ sec prior to bidding the CONTROL task, the ANALOG SCAN task is directed to scan the inputs necessary for the control system. The following ½ sec, while the CONTROL task is running, the AUX SYNC task arranges the timing so that the ANALOG SCAN task will scan a group of ATS inputs. This is done by setting ISCAN = 0 for base DEH inputs and ISCAN = 1 for ATS inputs.

When ISCAN = 0, the Monitor analog handler is called to scan the 15 base DEH inputs. The handler must be provided with a list of control words, one per input, which defines the hardware configuration of each input which are stored in ADBUF1. The P2000 Monitor Reference Manual, TP043, describes the format and function of each bit in these words, but essentially these bits define the channel, bit, multiplexer word and A/D gain setting for each input.

When the A/D converter completes the scanning of these inputs, the raw bit patterns are stored in a temporary buffer (VALBUF). The scan program then executes a FORTRAN DO loop to process these inputs. The two inputs MW and PI are checked for sensor failure against absolute low and high limits, and appropriate action is initiated if either failure occurs.

The remaining 10 base DEH inputs represent governor and throttle valve demand from the analog backup system and the digital system, and the actual LVDT position of each governor and throttle valve. These inputs are not converted but are kept in their raw form until used by the appropriate program. The reason for this is that these quantites are used much less frequently than the above inputs. In addition, the format of these inputs in engineering units is a percent value from 0 to 100; consequently, there is not much advantage to their conversion. However, these values are checked for low sensor limit, and if this occurs, they are set to zero. A portion of the instructions to do this work are written in Assembly language to reduce the program size. The inputs for the valve demands are stored in array ITVGV and the LVDT inputs are stored in arrays ITVGVSS.

The last action taken in this part of the ANALOG SCAN program is to check the A/D converter. The Monitor analog handlers set the variable FLGWRD if the A/D converter cannot be adjusted to the existing plant conditions; if this flag is set, the converter is said to be out of service and all feedback loops must be removed from the control system.

The variable ISCAN is reset to zero and a GO TO statement is executed; the transfer point depends on the value of INTSCAN, which is incremented once a second and runs from 1 to 10 before being reset back to 1. INTSCAN values 1, 3, 6 and 8 represent intervals of time when no addditional work need be done, as can be seen on the timing chart of FIG. 2. INTSCAN values of 2 and 7 (thus being 5 sec apart) transfer to statement 200. Here a second counter (ISPAN) is incremented in steps of 1; when ISPAN = 3, this represents a 15 sec interval and thus a SPAN/ADJUST call must be made. As this is done, the counter ISPAN is set back to zero.

When INTSCAN = 9, it is time to call for a group of temperature analog inputs; these are scanned in groups of 10, and there are 6 such groups. Thus, the counter NSYNC1 is incremented from 1 to 6 to indicate to the ATS conversion program which group has been input at this time. Also, the variable NSYNC2 is set to −1 to indicate that temperatures are coming in now. Finally, J is a pointer to the proper control words in the ATS COMMON area ITAAI.

When INTSCAN = 4, the ATS miscellaneous inputs which are scanned every 10 sec will be input. Statement 400 sets J to the proper pointer and sets NSYNC2 = −2 to indicate this fact.

When INTSCAN = 5 or 10, transfer is to statement 500 which sets up J to point to the ATS 5 sec vibration inputs. A flag (BIDATSCV) is also set at this point so that the ATS CONVERSION task may be bid further on in this program (note that this conversion task is bid every 5 sec). Finally, the Monitor analog handler is called with the proper pointer to control word tables and buffer areas where the raw bit patterns are stored for the appropriate group of ATS inputs.

The ANALOG SCAN task size is 335 words, its data pool size is 89 words, and its header is 9 words for a required minimum storage of 433 locations. ANALOG SCAN is linked as a separate task and loaded into the computer through the tape reader. The core area assigned to ANALOG SCAN is (16DO to 188F)$_{16}$; this is 11CO$_{16}$(448$_{10}$) locations, which allows a few spares.

LCCO SUBROUTINE

The subroutine is called only by the LOGIC task and thus is not reentrant. Arguments to the LCCO subroutine include three variables which indicate the appropriate action to be taken, and a pointer to a table of contact output words and bits which define the hardware connections for the quantities which must be set or reset.

The LCCO subroutine is designed so that a call from the LOGIC task provides a list of the variables necessary to evaluate whether or not contact outputs should be actuated and, if so, whether they should be set or reset. Not all calls to LCCO involve the logical pushbutton state; in those cases this argument (LVIPB) is a dummy which satisfies the calling sequence but accomplishes no other significant action. An exclusive-OR test is made on LV and LVX; if they are alike, no further action is taken. If they are different, this means contact outputs must be actuated.

LOGIC TASK

The LOGIC task is organized as a series of small subprograms which are executed sequentially and which address themselves to particular aspects of the total DEH Control System logical operation. The subprograms are in some cases quite simple, as when monitor lights are turned on or off, and in other cases they are quite complex, as when it is necessary to account for many permissive conditions to allow feedback loops to be put into service.

FLIP-FLOP FUNCTION

The flip-flop is a basic building block of most logic systems, whether the system be of hardware or of software construction. A flip-flop is essentially a memory element which may be set or reset by other logical elements to achieve a desired result. The flip-flop has two input terminals, one for setting and one for resetting (or clearing), and one output terminal, which indicates the state of the flip-flop.

The operation of the flip-flop is as follows. A logically true signal at the set terminal results in a logical true signal at the output terminal, while a logically true signal at the reset terminal produces a logical false signal at the output terminal. Simultaneous logically true signals at both the set and reset terminals yield a logical false signal at the output terminal, thus providing the reset terminal with precedence over the set terminal. Simultaneous logically false signals at both the set and reset terminals yield no change at the output terminal; that is, the output stays at whatever state it had been, thus providing the memory feature of the flip-flop.

The flip-flop function has been incorporated into the DEH system with a FORTRAN FUNCTION statement, thus allowing evaluation of the flip-flop element anywhere in the LOGIC task as an in-line statement.

MAINTENANCE TEST

The MAINTENANCE TEST system is activated by a two-position key-lock switch on the Operator's Panel. The function of this switch is to allow tuning or adjusting of certain constants in the DEH Control System, or to allow operation of the DEH system in a simulation mode for training purposes. When such tests are to be performed, the maintenance test key is moved to the right position; this immediately switches the turbine to manual control by a wired connection and sets a contact input to the DEH system. The LOGIC task then reacts in three ways: first, a contact output is set which turns on a monitor lamp above and to the right of the maintenance test switch; second, another contact output is set which requests transfer to manual as a backup to the wired connection; and third, the manual-tracking portion of the DEH Control System is disabled.

When the maintenance test action is completed and the test switch returned to the off position, the LOGIC task resets the two contact outputs to turn off the maintenance test lamp and to release the request for manual control. In addition, this part of the program enables the manual-tracking system by resetting the turbine REFERENCE and DEMAND to zero and allowing the normal control programs to run.

TURBINE SUPERVISION OFF LOGIC

The logical state (TSOFF) may be set by either the panel pushbutton represented by TURBSPOF or by the A/D converter out of service as given by VIDAROS. The pushbutton state (TURBSPOF) is generated by the PANEL task while VIDAROS is generated by the ANALOG SCAN task. A call to the LCCO subroutine is then made to update the pushbutton lamp status.

OPERATION AUTOMATIC LOGIC

The state of manual or automatic operation of the DEH system is actually determined by circuitry in the analog backup system, and the DEH programs simply respond to these states. When the DEH system is in manual control, the analog backup system ignores the computer output signals and positions the valves according to its up/down counter circuitry. Conversely, when the DEH system is in automatic control, the analog backup system uses the computer outputs to position the valves and adjusts its up/down counter to track the computer outputs.

When transfer is made to manual, either by pushbutton or computer request, the analog backup system opens contacts carrying the computer outputs to the valves and simultaneously closes contacts carrying backup system outputs to the valves. In addition, a contact input is sent to the DEH system LOGIC task indicating manual operation. When transfer is made to automatic control by pressing the OPERATOR AUTOMATIC pushbutton, and assuming that the computer system is tracked and ready for automatic, the analog backup system opens contacts carrying its own signals to the valves and simultaneously closes contacts carrying the computer outputs to the valves. The operator automatic logic thus merely updates internal computer variables to the state of manual or automatic control as determined by the backup system.

In updating the DEH system programs to the existing control state, the internal operator automatic variable (OA) is set to the logical inverse of the manual contact input represented by TM. Then a decision is made to determine if the system has just been switched to automatic by comparing OA and its last value (OAX). If automatic has just occurred, ready tracking flags are reset; if not, no action is taken. In either case, the last value (OAX) is set to the current automatic state (OA) for use in the next bid of the LOGIC task.

GO LOGIC

When the DEH system is on operator automatic control, the turbine speed/load (DEMAND) is entered from the keyboard. The operator then may allow the turbine reference to adjust to the demand by pressing the GO pushbutton. When the operator does this, the GO lamp is turned on and logical states are set to begin moving the reference in the CONTROL task. When the reference equals the demand, the GO lamp is turned off. The GO logic detects the various conditions affecting the GO state and sets the status and lamp accordingly.

The GO pushbutton (GOPB), which is updated by the PANEL task, is the set signal for the GO flip-flop. The reset or clear signal, which will override the set signal, can occur from a number of different conditons as follows: the HOLD pushbutton (HOLDPB) as updated by the PANEL task, a computed hold condition (HOLDCP) as set by the CONTROL or LOGIC tasks, the DEH system not being in operator automatic control (OA) or in the maintenance test condition (OPRT) (during which the system may be used as a simulator/-trainer), or the condition in which the reference has reached the demand and the CONTROL task sets the GOHOLDOF state to clear the GO lamp.

HOLD LOGIC

When the DEH system is an operator automatic control, the turbine speed/load (DEMAND) is entered from the keyboard. The operator may then inhibit the turbine reference from adjusting to the demand by pressing the HOLD pushbutton. When the operator does this, the HOLD lamp is turned on and logical states are set to prohibit the reference from moving in the CONTROL task. The HOLD logic detects the various conditions affecting the HOLD state and sets the status and lamp accordingly.

The HOLD pushbutton state (HOLDPB), which is set by the PANEL task, or the hold state (HOLDCP) computed by the CONTROL or LOGIC tasks, acts as the set signal for the HOLD flip-flop. The reset or clear signal, which will override the set signal, can occur from a number of different conditions as follows: the DEH system not being on operator automatic control (OA) or in the maintenance test condition (OPRT) (during which the system may be used as a simulator/-trainer), the GO fip-flop being set and thus overriding the HOLD state, or the condition in which the reference has reached the demand and the CONTROL task sets the GOHOLDOF state to clear the HOLD lamp. The HOLD logic program then resets the computed hold state (HOLDCP) and the GOHOLDOF state, so that they may be used in future decisions by the CONTROL and LOGIC tasks.

GOVERNOR CONTROL LOGIC

Control of turbine steam flow with the governor valves is required during speed and load control. Normally governor control is initiated when the turbine has been accelerated to near synchronous speed, after which the unit is brought up to synchronous speed, synchronized and then loaded with the governor valves as the normal mode of operation.

The governor control logic detects turbine latch and unlatching conditions, transfer from throttle valve to governor valve control, and manual operation of the governor valves. When any of these conditions occur, the governor logic must align the DEH system to the appropriate governor control state.

The governor control flip-flop (GC) may be set by a number of conditions, the most common of which occurs on automatic control when the operator presses the transfer TV/GV pushbutton (TRPB). Assuming that the governor valves are at their maximum open position as indicated by GVMAX and that the automatic turbine startup mode (ATS) is not selected, then the governor flip-flop will be set. An alternate path for setting this flip-flop occurs if the automatic turbine startup program (ATS) requests transfer via the logical variable ATSTRPB. In addition, when the throttle valves reach about 90 percent position, a contact input (THI) is activated by the analog backup system, and this contact sets the GC flip-flop. This last case occurs when the turbine is a manual control. Finally, the governor control flip-flop is reset when the turbine latch contact input (ASL) is released.

Following the GC flip-flop, a decision is made to determine if the system has just switched to governor control by comparing GC with its last state (GCX). If transfer has just occurred, the turbine speed (WS) at this instant is saved as WSTRANS, the speed at throttle/governor valve transfer. This value is used in the CONTROL task for a special valve position control logic decision. The last operation in the governor control program is to call the LCCO subroutine to update the GC lamp.

THROTTLE VALVE CONTROL LOGIC

Control of turbine steam flow with the throttle valves is required when the turbine is initially rolled and during speed control up to the point of transfer to governor valve control. After this the throttle valves are kept wide open during normal operation. The throttle control logic detects turbine latch and unlatching conditions, transfer from throttle to governor valve control, and manual operation of the throttle valves. When any of these conditions occur the throttle logic must then align the DEH system to the appropriate throttle control state.

The throttle control state (TC) is simply the logical inverse of the governor control state (GC) when the turbine is latched. However, the throttle control lamp flip-flop (TCLITE) may be set by either TC or by manual operation (TM) while the throttle valves are below 90 percent open as indicated by the contact input (THI) not being set. The TCLITE flip-flop is reset by the contact input (THI) indicating throttle valves wide open or by the turbine latch contact input (ASL) not set.

The throttle control logic also indicates that the transfer from throttle to governor valve state (TRTVGV) is underway when governor control (GC) exists but the throttle valves are not yet wide open. In addition, the transfer complete state (TRCOM) is set when the throttle valves are wide open on governor control as indicated by THI. Finally, the program sets various contact outputs to pass this information on to the plant and operating personnel by calling the LCCO subroutine.

TURBINE LATCH LOGIC

Before the turbine can be rolled and accelerated, it must be mechanically latched; this means the hydraulic fluid system must be prepared to move the throttle and governor valves, and a series of safety features as described in the turbine instruction book must be satisfied. After the turbine is latched, if unlatching should occur at any future time during speed or load control, then the control system must trip the turbine and close all valves immediately. The turbine latch logic detects latching or unlatching, and instantly sets the turbine reference and the control system to the proper states. A decision is made to determine if the turbine has just unlatched by comparing the current latch state (ASL) with the last state (ASLX). If unlatched has just occurred, then the DEH turbine reference given by REFDMD, the demand given by ODMD, and the speed integral controller given by RESSPD are immediately reset to zero. If the turbine has not unlatched, then a decision is made to determine if the turbine has just latched by a similar comparison of ASL and ASLX. If the unit has just latched, the DEH reference (REFDMD) and demand (ODMD) are set to the existing speed so that the control system may "catch the unit on the fly" should it be decelerating. The speed integral controller (RESSPD) is set to a zero value, from which point the control system will act to control the throttle valves.

BREAKER LOGIC

The necessary and sufficient condition which must be satisfied when transferring from speed to load control is that the governor valve analog output must remain constant. This may be expressed as:

$$GVAO_{LOAD} = GVAO_{SPEED} \quad (1)$$

The computed values for these outputs may be written by referring to FIG. 23. This diagram shows the path taken by the CONTROL program on initial load control, when the megawatt and impulse pressure feedbacks are out of service, and on speed control prior to breaker closing. The expressions for the two governor valve analog outputs given in Equation (1) above follow.

$$GVAO_{LOAD} = GR8 * GVPOS$$
$$GVAO_{SPEED} = GR7 * SPD$$

These may be substituted into Equation (1) and solved for the governor valve position (GVPOS) in terms of the governor valve speed position (SPD) and ranging gains (GR7 and GR8).

$$GVPOS = \frac{GR7}{GR8} * SPD \quad (2)$$

The required position (GVPOS) may in turn be related to the governor valve set point (GVSP) and the governor valve characterization curve. This relationship follows.

$$GVPOS = \frac{POS(2)}{SP(2)} * GVSP \quad (3)$$

POS(2) and SP(2) are points on the valve characterization and represent the slope of the first segment of the curve. Substitution of Equation (3) into (2) and solution for GVSP yields the required set point for correct valve position.

$$GVSP = \frac{SP(2)}{POS(2)} * \frac{GR7}{GR8} * SPD \quad (4)$$

Referring to the load control system an expression for the governor valve set point can be written in terms of additional computed quantities as follows:

$$GVSP = \frac{VSP}{GR4} \quad (5)$$

VSP is the governor valve set point in psi and GR4 is a ranging constant to convert to percent position. Substitution of Equation (5) into (4) produces the necessary value of VSP.

$$VSP = GR4 * \frac{SP(2)}{POS(2)} * \frac{GR7}{GR8} * SPD \quad (6)$$

Note that immediately after synchronizing, the impulse pressure loop is out of service. In this case, then the governor valve set point (VSP) in psi is identical to the impulse pressure set point (PISP) in psi. This is given below.

$$VSP = PISP \quad (7)$$

Substitution of Equation (7) into (6) yields the required value of PISP.

$$PISP = GR4 * \frac{SP(2)}{POS(2)} * \frac{GR7}{GR8} * SPD \quad (8)$$

Now the impulse pressure set point (PISP) can be related to the megawatt set point (REF2) as follows:

$$PISP = GR3 * REF2 \quad (9)$$

GR3 is a ranging gain which converts megawatts to psi. Substitution of Equation (9) into (8) allows computation of REF2.

$$REF2 = \frac{GR4}{GR3} * \frac{SP(2)}{POS(2)} * \frac{GR7}{GR8} * SPD \quad (10)$$

Note that at the instant of synchronization, the megawatt feedback loop is out of service and that the speed error is essentially zero (otherwise the unit would not have been synchronized). Thus, the expression for the turbine reference is:

$$REFDMD = REF2 \quad (11)$$

Substitution of Equation (11) into (10) yields the desired result:

$$REFDMD = \frac{GR4}{GR3} * \frac{SP(2)}{POS(2)} * \frac{GR7}{GR8} * SPD \quad (12)$$

Equation (12) thus gives the required value which must be set into the turbine reference when the main breaker closes to maintain governor valve position on transfer from speed to load control. When this is added to the throttle-pressure modified initial megawatt pickup discussed above, the DEH Control System will make a smooth transfer from speed to load control with no potential motoring action by the turbine.

Figure 24:
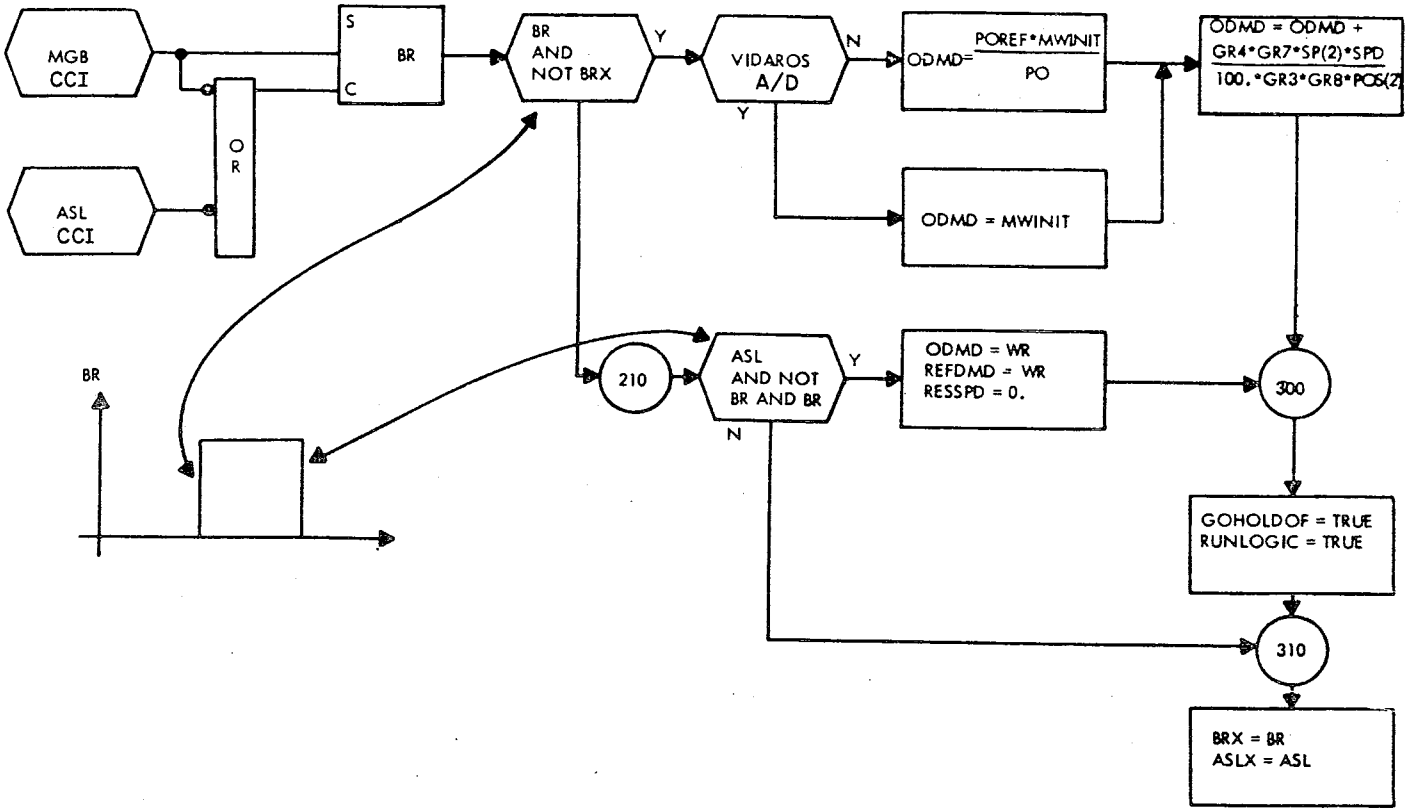
FIG. 24 is a flow chart of a breaker logic program which is operable in accordance with the principles of the invention.

As shown in FIG. 24, the main generator breaker contact input (MGB) sets the breaker flip-flop (BR), while loss of either MGB or the latch contact input (ASL) resets the BR flip-flop. Then a test is made to determine if the breaker just closed by comparing BR with its last state (BRX) as indicated by the leading edge of the BR pulse. If the breaker just closed, then the initial megawatt pickup (MWINIT) modified by throttle pressure ratio is computed as discussed above, the equivalent load governor position as given in Equation (12) is computed, and these are added together to form the new load REFERENCE and DEMAND.

If the breaker did not close, then BR and BRX are tested to see if the breaker opened as indicated by the trailing edge of the BR pulse. If this is the case, the turbine REFERENCE and DEMAND are set to synchronous speed, and logical flags set to rerun the LOGIC task to update the DEH system status. The final operation in the program then is to set the last states (MGBX and ASLX) to the current values of MGB and ASL for succeeding bids of the LOGIC task.

THROTTLE PRESSURE CONTROL LOGIC

Control of throttle pressure in a fossil fired power plant is primarily a function of the boiler control system. Traditional turbine control practice is to react defensively to throttle pressure variations such that protection of the turbine is guaranteed. The DEH Control System is designed to detect throttle pressue below a set point and to runback the turbine reference at a preselected rate until the throttle pressure condition is corredted. For this purpose, the throttle pressure detector 112 of FIG. 1, transmits a signal to the DEH computer which is compared to a predetermined pressure set by keyboard 1816 entry on the Operator's Panel 1130. The throttle pressure control logic allows the throttle pressure controller to be placed in service or to be taken out of service by the operator when the turbine is on automatic control. In addition, this logic will automatically remove the loop from service under certain contingency conditions or when the turbine is in speed control.

The throttle pressure control flip-flop (TPC) may be set by the throttle pressure pushbutton (TPCPB) on the Operator's Panel or by the analog backup system having its throttle pressure controller in service prior to transfer to automatic control; this latter case is given by the last state (MANTPCX) of the contact input (MANTPC) being set while in manual control. The TPC flip-flop is reset by a number of conditions; the panel pushbutton (TPCPB) when the loop is in service, breaker (BR) open, manual operation (TM), throttle pressure transducer failure (TPTF) which is a contact input from the backup system, the analog-to-digital converter out of service (VIDAROS), or an attempt to put the loop in service when the existing throttle pressure (PO) is below the set point (POSP). After evaluation of the TPC flip-flop, the program calls the LCCO subroutine to place the throttle pressure contact outputs in the correct state. Then the last values of the manual control and throttle pressure circuit are updated.

MEGAWATT FEEDBACK LOGIC

To place the loop in service bumplessly, it is necessary to maintain constant governor valve position while inserting the megawatt proportional-plus-reset controller in the control system computations. This means that the integrator in this controller must be instantly set to the proper value, the reference must be reset to that value which will yield no change in governor valve position, and proper account must be taken of the speed feedback effect at the instant of putting the loop in service. A derivation of the equations necessary to guarantee these conditions follows.

REF2 is effectively the governor valve set point which must remain fixed in placing the loop in service, REFDMD is the turbine reference, X is the speed feedback effect and REF1 is the speed modified reference. When the loop is placed in service, the proper values of Y, the megawatt feedback factor, and RESMW, the megawatt integrator, must be computed, and REFDMD then readjusted to produce exactly the same value for REF2 to yield bumpless transfer. The necessary and sufficient condition for bumpless transfer then is that REF2 before and after the switching must be identical, as shown in Equation (13).

$$REF2_{IN} = REF2_{OUT} \quad (13)$$

The value of REF2 before the switch is retained in computer memory, whereas the expression for REF2 after the loop is in may be determined result follows.

$$REF2_{IN} = Y * REF1_{IN} \quad (14)$$

Immediately after the switch, the value of REF1 must equal the existing analog input representing megawatts (MW), so that the integrator sees a zero error. Thus, an equation for this condition is:

$$REF1_{IN} = MW \quad (15)$$

Substituting Equations (13) and (15) into (14) and solving for the required value of the megawatt factor (Y) and therefore the megawatt integrator output (RESMW) yields the following result:

$$Y = RESMW = \frac{REF2_{OUT}}{MW} \quad (16)$$

Finally, to guarantee that the transfer will be bumpless the new value of REFDMD must be computed as follows.

$$REF1_{IN} = REFDMD_{IN} + X \quad (17)$$

Substituting Equation (15) into (17) and solving for REFDMD completes the required derivation.

$$REFDMD_{IN} = MW - X \quad (18)$$

The steps in the computation may be summarized: compute the new value of Y and RESMW from Equation (16), compute the new value of REFDMD from Equation (18), set the megawatt integrator last input (RESMWX) to zero, and place the loop in service.

To remove the megawatt loop from service bumplessly, a similar set of computations must be followed. The necessary and sufficient condition for bumpless transfer is to retain a constant value for REF2 as follows.

$$REF2_{OUT} = REF2_{IN}$$

The value of REF2 before the switch is retained in computer memory, whereas the expression for REF2 after the switch may be determined as given below.

$$REF2_{OUT} = REF1_{OUT}$$

Immediately after the switch, the value of REF1 must equal the value of REF2 before the switch, since the megawatt loop is now out of service.

$$REF1_{OUT} = REF2_{IN} \quad (19)$$

Finally, to guarantee the bumpless transfer, the new value of the reference REFDMD must be computed to satisfy Equation (19).

$$REF1_{OUT} = REFDMD_{OUT} + X \quad (20)$$

Substituting Equation (19) into (20) and solving for REFDMD yields the final result.

$$REFDMD_{OUT} = REF2_{IN} - X \quad (21)$$

Thus to take the megawatt loop out of service, the reference is reset to the value given in Equation (21) and the monitor lamp indication is reset.

The megawatt pushbutton, represented by MWIPB and updated by the PANEL program, sets the megawatt flip-flop (MWI), while this flip-flop may be reset by a number of conditions as follows: the main breaker (BR) open; a megawatt transducer failure (MWTF), which is a contact input set by the analog backup system; a valve position limit condition as indicated by VPLIM; an analog input failure (AIFAILMW) of the megawatt feedback signal as set by the ANALOG SCAN program; or the analog-to-digital converter out of service (VIDAROS). After evaluation of the megawatt flip-flop, decisions are made to determine if the megawatt loop has just been put into service or just taken out of service, assuming that the main breaker (BR) is closed. If the loop has just been put in, as indicated by the leading edge of the MWI pulse, then the bumpless transfer computations listed in Equations (16) and (18) are executed. If the loop has just come out of service, as indicated by the trailing edge of the MWI pulse, then the bumpless transfer computation listed in Equation (21) is executed. In both cases a call to the LCCO subroutine is made to place the megawatt lamp and two status contact outputs for the megawatt loop in the proper state.

IMPULSE PRESSURE FEEDBACK LOGIC

To place the impulse pressure loop in service bumplessly, it is necessary to maintain the governor valves constant while inserting the impulse pressure proportionalplus-reset controller in the control system computations. This means that the integrator in the controller must be instantly positioned at the proper value. Depending on whether the megawatt feedback loop is in service at this time, one of the following two sets of derivations will be appropriate.

GR3 is a ranging constant which converts the megawatt reference value (REF2) to an impulse pressure set point (PISP) while IPI is the impulse pressure flip-flop. The analog input (PI) is the actual impulse pressure at the instant of placing the loop in service, RESPI is the impulse pressure integrator, and VSP is the governor valve set point. When the loop is put in service, both the integrator values (RESMW and RESPI) must be instantly recomputed to hold the governor valve set point (VSP) constant. Thus to remain bumpless, the following expression must hold.

$$VSP_{IN} = VSP_{OUT}$$

The value of VSP before the switch is retained in computer memory, whereas after the loop is in service, the value of VSP will be given by the integrator (RESPI). Therefore this integrator output must be instantly set to the value of VSP.

$$RESPI = VSP_{OUT}$$

The additional requirement is that the impulse pressure set point (PISP) be identical to the existing impulse pressure analog input at the instant of switching so that the integrator sees a zero error. This is satisfied as follows.

$$PISP_{IN} = PI \quad (23)$$

The computed value for PISP now may be written to determine what changes must be made to the megawatt integrator.

$$PISP = GR3 * REF2_{IN} \quad (24)$$

The value of REF2 in turn may be determined in terms of REF1, which does not change when the impulse pressure is switchhed in since REF1 is upstream of the megawatt loop.

$$REF2_{IN} = Y * REF1 \quad (25)$$

Substituting Equations (23) and (24) into (25), and remembering that the megawatt correction factor (Y) and the megawatt integrator output (RESMW) are equal, the new value which must be given to RESMW may be solved for as follows:

$$RESMW = Y = \frac{PI}{GR3 * REF1} \quad (26)$$

The steps in the computation to place impulse pressure feedback into service when the megawatt loop is already in service may be summarized: compute the new value of the impulse integrator from Equation (22), set the last value of the impulse integrator input (RESPIX) to zero, compute the new value of the megawatt integrator from Equation (26), and place the loop in service.

To remove the impulse pressure feedback from service bumplessly, a similar set of computations must be followed. The necessary and sufficient condition is to hold the value of VSP constant as follows:

$$VSP_{OUT} = VSP_{IN} \quad (27)$$

The value of VSP before the switch will be retained in computer memory, whereas the value of VSP after the switch can be determined when the loop is out.

$$VSP_{OUT} = PISP \quad (28)$$

The set point (PISP) can in turn be computed as follows:

$$PISP = GR3 * REF2 \quad (29)$$

Finally, REF2 may be determined from REF1 which does not change since it is upstream of the megawatt integrator.

$$REF2 = Y * REF1 \quad (30)$$

Substituting Equations (27), (28) and (29) into (30), and remembering that the megawatt correction factor (Y) and the megawatt integrator (RESMW) are equal, the new value which must be given to RESMW may be solved for as follows:

$$RESMW = Y = \frac{VSP_{OUT}}{GR3 * REF1} \quad (31)$$

The steps in the computation to remove the impulse pressure feedback from service when the megawatt loop is in service are to compute the new value of the megawatt integrator from Equation (31) and then place the loop out of service.

The above set of computations hold for switching the impulse pressure loop while the megawatt loop is in service. The situation is significantly different when the megawatt loop is out of service, since then the reference must be reset to maintain a bumpless transfer. To put the impulse pressure loop in service bumplessly, it is necessary, as always, to keep the governor valve set point constant.

$$VSP_{IN} = VSP_{OUT}$$

Again, the value of VSP before the switch will memory. in computer memory. The remaining equations describing the system after the switch may be derived with results as follows:

$$RESPI = VSP_{OUT}$$
$$PISP = PI$$
$$PISP = GR3 * REF2$$
$$REF2 = REF1$$
$$REF1 = REFDMD + X \quad (32)$$

Solving this set of equations for the new value of REFDMD yields the required condition.

$$REFDMD = \frac{PI}{GR3} - X \quad (33)$$

Thus, to summarize, when placing impulse pressure feedback in service with the megawatt loop out of service, it is necessary to set the impulse integrator (RESPI) to the value given in Equation (32), reset the last input to this integrator (RESPIX) to zero, compute the new reference REFDMD from Equation (33), and place the loop in service.

The last case to cover is that of removing the impulse pressure loop when megawatt feedback is out of service. Once more the governor valves must remain constant to assure bumpless transfer, as indicated below.

$$VSP_{OUT} = VSP_{IN}$$

As always, the value of VSP prior to the switch will be in computer memory. The set of equations describing the computations may be written as follows:

$$VSP_{OUT} = PISP$$
$$PISP = GR3 * REF2$$
$$REF2 = REF1$$
$$REF1 = REFDMD + X$$

Solving this set of equations for the new value of REFDMD yields the required condition.

$$REFDMD = \frac{VSP_{IN}}{GR3} - X \quad (34)$$

Thus, REFDMD is computed according to Equation (34), the impulse pressure loop is removed, and the transfer proceeds bumplessly.

The impulse pressure pushbutton, represented by IPIPB and updated by the PANEL program, sets the impulse pressure flip-flop (IPI), while a number of conditons may reset the flip-flop as follows: the main breaker (BR) open; a valve position limiting conditon as indicated by VPLIM; an analog input failure (AIFAILPI) for the impulse pressure feedback signal as set by the ANALOG SCAN task; the analogto-digital converter out of service (VIDAROS); or a contact input (SIO) to set impulse pressure out of servie when in the automatic dispatch system (ADS) mode. After evaluation of the impulse pressure flip-flop (IPI), decisions are made to determine if the loop has just been put into service or just taken out of service assuming that the main breaker (BR) is closed. If the loop has just come in, as indicated by "the leading edge of the IPI pulse," then the bumpless transfer computations discussed and derived above are evaluated. If the loop has just come out, as indicated by "the trailing edge of the IPI pulse," then again appropriate bumpless transfer conditions are evaluated as discussed above. An additional decision is made on MWI as to whether or not the megawatt feedback loop is in service. As derived above, the form of the bumpless transfer computations depends on the state of the megawatt loop. After all expressions are evaluated, calls are made to the LCCO subroutine to place the impulse pressure lamp and two status contact outputs in the proper state.

SPEED FEEDBACK LOGIC

The speed feedback loop is critically important when the turbine is on automatic speed control, and is of somewhat less importance on load control. Without speed feedback on automatic speed control, the DEH system must reject to manual operation, while on automatic load control the DEH system merely removes the speed feedback loop from service. The operator may place the speed loop back in service after it has been rejected by pressing the speed loop pushbutton, providing the speed inputs have in the meantime been corrected and are again valid.

Once the speed feedback loop is in service, the operator cannot take it out of service, since standard turbine control practic requires speed in service at all times if the input signals are valid. Thus when the loop is in service, pressing the pushbutton is ignored. The only mechanism for taking the loop out of service is by automatic action of the DEH system programs when a speed transducer failure occurs. The speed feedback logic program responds to those conditions which will activate or deactivate the speed loop, whether the conditions be an operator pushbutton request or automatic rejection by the transducer failure.

AUTOMATIC SYNCHRONIZER LOGIC

The auto sync flip-flop (AS) may be set by the auto sync pushbutton (ASPB) or by the automatic turbine startup program request (ATSASPB), provided in both cases that the unit is on automatic control (OA), the breaker (BR) is open, the turbine is on governor control (GC), and the automatic synchronizer equipment permissive contact input (ASPERM) is set. Otherwise the AS flip-flop will be reset. Decisions are then made to determine if the AS flip-flop has just come on. If AS just came on, the temporary variable (T3) is set to indicate a remote control transfer for later logic programs. Then a call is made to the LCCO subroutine to set the auto sync lamp to the correct state; arguments in the call consist of the current state of AS, the last state (ASX), the auto sync pushbutton state (ASPB) which must be aligned with the AS flip-flop, and a pointer (N9) to a table of contact output words and bits which define connections to the auto sync lamp.

Decisions must be made in the auto sync logic program, when the AS mode has been selected, to detect whether the automatic synchronizing equipment is sending raise or lower pulses to the DEH system. Thus, if the leading edge of the ASUP contact input pulse has just come on, then the logical variable ASINC is set so that the CONTROL task may increment the turbine reference by one rpm. Similarly, if the leading edge of the ASDOWN contact input pulse has just come on, then the logical variable (ASDEC) is set so that the CONTROL task may decrement the turbine reference by one rpm. Finally, last values (ASUPX and ASDOWNX) are updated to the current states (ASUP and ASDOWN) in preparation for future bids of the LOGIC task.

AUTOMATIC DISPATCH LOGIC

The automatic dispatch flip-flop (ADS) may be set by the automatic dispatch button (ADSPB), which is updated by the PANEL program, providing the unit is on automatic control (OA), the breaker (BR) is closed, and the automatic dispatch permissive contact input (ADSPERM) is set. Otherwise the ADS flip-flop will be reset. Decisions then are made to determine if the ADS flip-flop has just come on. If ADS just came on, the temporary variable (T3) is set to indicate a remote control transfer for later logic programs. Then a call is made to the LCCO subroutine to set the ADS lamp to the correct state; arguments in the call consist of the current state of ADS, the last state (ADSX), the automatic dispatch button (ADSPB) which must be aligned with the ADS flip-flop, and a pointer (N10) to a table of contact output words and bits which define connection to the ADS lamp.

Additional decisions must be made in the ADS logic program, when the ADS mode has been selected, to detect whether the ADS equipment is sending raise or lower pulses to the DEH system. Thus if the leading edge of the ADSUP contact input pulse has just come on, then a flip-flop (CADSUP) is set to start a counter which is handled by the AUX SYNC program. As long as CADSUP is set the AUX SYNC will count in 1/10 sec increments, thus determining the length of time the raise pulse is on. When the trailing edge of the ADSUP contact input pulse is detected, this means the raise contact has been released; this then resets the CADSUP flip-flop and the AUX SYNC program will stop counting. Finally, a logical state (ADSINC) is set so that the CONTROL task may raise the turbine reference by an amount proportional to the CADSUP counter. Identical checks and logical decisions are made with respect to the ADS lower contact input (ADSDOWN), after which last values of both ADSUPX and ADSDOWNX are updated with the current state of ADSUP and ADSDOWN in preparation for future bids of the LOGIC task.

AUTOMATIC TURBINE STARTUP LOGIC

Figure 29:
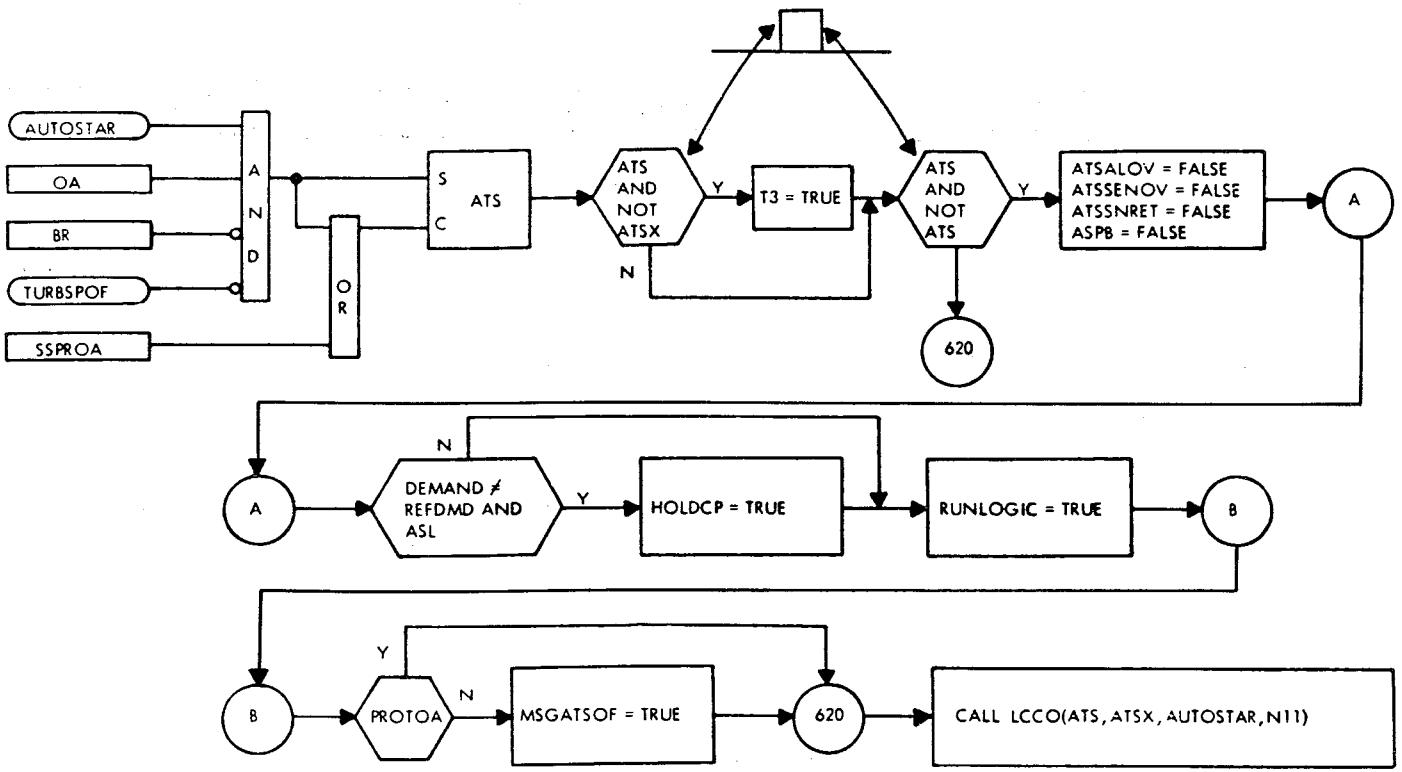
FIG. 29 is a flow chart of an automatic turbine startup program which is operable in accordance with the principles of the invention.

As shown in FIG. 29, the automatic startup flip-flop (ATS) may be set by the pushbutton (AUTOSTAR), which is updated by the PANEL task, provided the turbine is on automatic control (OA), the main breaker (BR) is not closed, and the turbine supervision off pushbutton (TURBSPOF) has not been pushed. Otherwise the ATS flip-flop will be reset by the lack of any of these conditions or by the automatic startup program itself through the variable SSPROA if the program detects improper conditions for startup.

Decisions are then made to determine if the ATS flip-flop has just come on. If so, a temporary logical variable (T3) is set to indicate a remote control transfer for later logic programs. A decision is also made to determine if the ATS flip-flop has just gone off. If this is the case, then a group of logical variables used in the ATS program must be reset. In addition, certain DEH system conditions must be aligned properly; these include the auto sync pushbutton (ASPB), which may have been set by the ATS program, and the reference/demand windows on the DEH Operator's Panel, which may have been left in an unequal state by the startup program. These conditions are cleared by setting RUNLOGIC to request another bid of the LOGIC task. Finally a call is made to the LCCO subroutine to set the ATS lamp to the proper state. Arguments in the call are the current state of ATS, the last state (ATSX), the auto start pushbutton (AUTOSTAR) which must be aligned with ATS, and a pointer (N11) to a table of contact output words and bits which define the hardware connections to the ATS lamp.

REMOTE TRANSFER LOGIC

To transfer from operator automatic to a remote mode, the operator simply presses the appropriate pushbutton on the Operator's Panel. Then, assuming all permissive conditions as described elsewhere in this writeup are satisfied, the new mode will be selected with a bumpless transfer in which the turbine valves remain at the existing position. In addition, a lamp behind the pushbutton selected will be turned on and the lamp for the previous mode will be turned off. Conversely, in order to return from any remote mode to operator automatic, the operator simply presses the OPER AUTO pushbutton. The remote transfer logic program detects operating mode changes and updates the panel lamps according.

Figure 30:
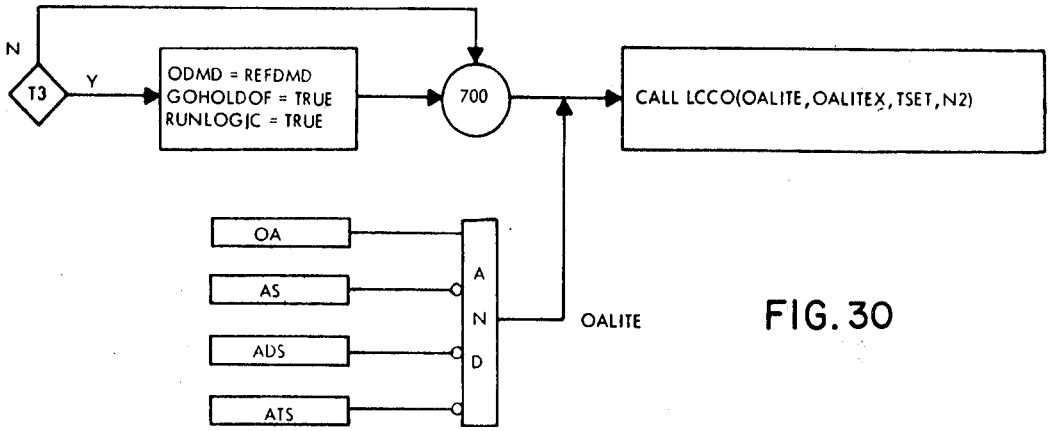
FIG. 30 is a flow chart of a remote transfer logic subroutine which is operable in accordance with the principles of the invention.

As shown in FIG. 30, the temporary logical variable (T3), which has been updated in earlier portions of the logic program, is checked to determine if any remote state has been selected. If so, the operator demand (ODMD) is set equal to the current reference (REFDMD), and logical flags are set to run the LOGIC task again to set the appropriate conditions in the DEH system. Then the status of the operator automatic lamp (OALITE) is determined since a remote control mode selection must result in turning off this lamp. Finally, a call to the LCCO subroutine is made to place this lamp in the proper state.

PANEL TASK

FIG. 32 shows a block diagram of the major functions performed by the PANEL task. These include executing each of the button group functions discussed above, as well as additional decisions, checks, and bookkeeping necessary to properly perform the action requested by the operator.

BUTTON DECODE

The BUTTON DECODE program examines the button identification (IPB) provided by the PANEL INTERRUPT program, and transfers to the proper location in the PANEL task to carry out the action required by this button. The program also does some bookkeeping checks necessary to keep the panel lamps in the correct state. A total of 54 buttons can be decoded in the current version of the DEH PANEL task.

The identification of the last button (IPBX), which had been pressed and which has associated with it a visual display mode lamp, is stored in a temporary integer location (JJ) for later use in turning off the last lamp. Then the current button identification (IPB) is checked to determine if it represents the ENTER pushbutton; if so, a special logical variable ENTERPB is reset for later use should the ENTER button be pressed two or more consecutive times. This has been found to be a rather common operator error and is flashed as an invalid request. The program then simply executes a FORTRAN computed GO TO statement and transfers to the appropriate portion of the PANEL task.

CONTROL SYSTEM SWITCHING

There are six buttons on the Operator's Panel which may switch control states of the DEH system. A brief description of each follows:

1. TRANSFER TV/GV — This button initiates a transfer from throttle valve to governor valve control during wide-range speed operation. The pushbutton has a split lens. When control is on the throttle valves, the upper half of the lens is backlighted. When the button is pressed, to transfer control, the entire lens is backlighted. At the completion of the transfer, only the bottom half of the lens remains on. Once the DEH system is on governor control, it stays in this mode until the turbine is tripped and relatched. At this time, it is again in throttle valve control.

2. IMPULSE PRESSURE FEEDBACK IN/OUT — This is a push-push button with split lens. It places the impulse pressure feedback loop in or out of service, with appropriate backlighting of the button lens.

3. MEGAWATT FEEDBACK IN/OUT — This is a push-push button with split lens. It places the megawatt feedback loop in or out of service, with appropriate backlighting of the button lens.

4. SPEED FEEDBACK IN/OUT — This split lens button places the speed feedback loop in service in the DEH system. Normally the speed loop is always in service; however, when the DEH CONTROL task detects a speed channel failure condition in which all speed input signals are unreliable, the speed feedback loop is disabled and the speed channel monitor lamps turned on. When the speed inputs become reliable, the monitor lamps are turned off, thus indicating to the operator that he may place the speed feedback loop back in service. As long as the speed signals are reliable, the operator cannot take the speed loop out of service.

5. THROTTLE PRESSURE CONTROL IN/OUT — This is a push-push button with split lens which places the throttle pressure controller in or out of service, with appropriate backlighting of the lens.

6. CONTROLLER RESET — The button restores the DEH system to an active operating state after the computer has been stopped due to a power failure or hardware/software maintenance.

The logical variable TRPB is set when the TRANSFER Tv/GV button is pressed. The impulse pressure, megawatt, and throttle pressure logical states (IPIPB, MWIPB AND TRCPB respectively) are set to the logical inverse of their previous state when the corresponding buttons are pressed. This is the mechanism which provides the push-push nature of these buttons. The logical variable SPIPB is set when the speed feedback button is pressed. Finally, each of these buttons initiate a bid for the LOGIC task by setting the RUNLOGIC variable prior to exit from the PANEL task.

The CONTROLLER RESET button is handled somewhat differently. The state CRESETPB is set by the STOP/INITIALIZE task, which does cleanup and initialization after a computer stop condition. Then CRESETPB is checked; if it is not set, the computer has been running, and thus the button pressed is ignored. If CRESETPB is set, this means the computer had been stopped; CRESETPB is reset and the lamp behind the button is turned off. In addition, the PANEL task effectively presses the speed feedback button by setting the logical state SPIPB. This is done so that the DEH system restarts after a power failure or other computer stop condition with the speed feedback loop in service. The LOGIC task is requested to run by setting the RUNLOGIC state. The REFERENCE display button is also effectively pressed so that the display windows always start out in the same mode after a stop condition on the computer.

DISPLAY/CHANGE DEH SYSTEM PARAMETERS

Eight buttons allow the operator to display or change various DEH system parameters. Six of these buttons are dedicated to the display or change of a single important parameter for each button. The remaining two buttons provide the ability to display or change a group of DEH system variables from each button. In addition, two special buttons (GO and HOLD) are intimately associated with one of the dedicated display/change buttons, and thus are also included in this discussion.

Before listing each of these buttons, a brief description of the display window mechanism is given. The DEH Operator B Panel contains two digital displays which are provided with five windows each. The left display, labeled REFERENCE, has two major functions. It either presents numerical information which currently exists in computer memory for the six dedicated buttons mentioned above, or it accepts address inputs from the keyboard for the two buttons assigned to display or change groups of DEH system variables. The right display, labeled DEMAND, also has two major functions. It either accepts keyboard inputs in preparation for changing any of the currently existing numerical information in computer memory for the six dedicated buttons mentioned above, or it presents currently existing information in computer memory for the two buttons assigned to display or change groups of DEH system variables.

Of the five windows in each digital display, the leftmost is reserved for mnemonic characters. These characters combine to form a short message identifying the numerical quantity in the remaining four windows. The following table lists the 11 available messages and an explanation of each. The four right windows in each display provide the numerical digits 0 through 9 and a decimal point where appropriate.

MNEMONIC CHARACTER DEFINITION

| Message | Explanation |
|---|---|
| MW | Megawatt Symbol for Load Control |
| SPEED | Speed Symbol for Speed Control |
| % VALVE POSITION | Percent Valve Position for Valve Status |
| RPM/MIN | Acceleration Rate |
| MW/MIN | Load Rate |
| SYS PAR | General DEH System Parameter |
| IMP PRESS % | Impulse Pressure in Percent For Load Control |
| PRESS | General Pressure Variable |
| TEMP | General Temperature Variable |
| VALVE NO. | Valve Identification for Valve Status |
| | Algebraic Negative Quantity |

A brief description of the eight buttons associated with display/change as well as the GO and HOLD buttons, follows:

1. REFERENCE — This button initiates a display or change of the DEH reference and demand for speed or load operation. When the turbine is on operator automatic control, new demand values may be entered from the keyboard. However, when the turbine is in a remote operating mode such as automatic synchronizer, dispatch or ACCELERATION program, the demand cannot be changed from the keyboard. Any attempt to do so is flashed as an invalid request.

2. ACCELERATION RATE — This button initiates a display or change of the acceleration rate used on wide-range speed operation. When the turbine is on operator automatic control, this value is entered by the operator, and may be changed from the keyboard. However, when the turbine is being accelerated by an AUTOMATIC STARTUP program, the displayed value is the rate selected by this program and cannot be changed from the keyboard. Any attempt to do so is flashed as an invalid request.

3. LOAD RATE — This button initiates a display or change of the load rate used on operator automatic control. This value may be displayed or changed at any time.

4. LOW LIMIT — This button is an optional feature which initiates a display or change of the low load limit used on all automatic load control modes. This value may be displayed or changed at any time.

5. HIGH LIMIT — This button is an optional feature which initiates a display or change of the high load limit used on all automatic load control modes. This value may be changed at any time.

Each of these buttons have high or low limits, whichever is appropriate, associated with them when changes are to be made in the values discussed above. Violation of these limits from a keyboard entry is flashed as an invalid request and the entry is ignored. More details of these limits are discussed in a later section where the KEYBOARD program is described.

6. VALVE POSITION LIMIT — This button initiates a display of the governor valve position limit and the quantity being limited. Change or adjustment of the valve position limit is accomplished by raise/lower buttons (described in a later section where the valve buttons are discussed). Any attempt to enter values from the keyboard in this display mode is flashed as an invalid request.

7. VALVE STATUS — This button initiates a display of the status (position) of the turbine throttle and governor valves. Thus, this button is associated with a group of DEH system variables. A description of the steps necessary to carry out this display function is given in later paragraphs (where the valve buttons are discussed).

8. TURBINE PROGRAM DISPLAY — This button initiates a display or change of any DEH system parameter not otherwise addressable with one of the unique buttons described above. These variables include pressures, temperatures, control system tuning constants, and calculated quantities in all parts of the DEH system. A dictionary is provided so that the address of such quantities may be entered from the keyboard. Further discussion of these points is given in later paragraphs where the keyboard is described.

9. GO — This button initiates a special DEH CONTROL program to adjust the turbine reference. The program ultimately positions the valves on operator automatic control. The reference then moves at the appropriate load or acceleration rate until the reference and demand are equal. The updated reference value is continually displayed in the REFERENCE windows so that the operator may observe it changing to meet the demand, which is displayed in the DEMAND windows.

10. HOLD — This button interrupts the reference adjustment process described above, and holds the reference at the value existing at the moment the HO-LD button is pressed. In order to continue the adjustment process on the reference, the operator must press the GO button.

A brief description of the steps necessary to display or change any of the first six variables discussed above follows; description of cases 7 and 8 are withheld until a later section. When the operator wishes to display or change any of the DEH dedicated system parameters, he must execute a sequence of steps which result in the desired action. The steps are listed as follows:

1. The operator presses the appropriate button; the DEH programs display the current value of the parameter in the reference windows while the demand windows are cleared to allow for possible keyboard entry.

2. If the operator wishes only to observe the parameter value, then he does nothing else. The value remains in the reference windows until some new button is pressed.

3. If the operator wishes to change the parameter, he types in on the keyboard the new value which he desires. This is displayed in the DEMAND windows, but will not yet be entered into the DEH programs.

4. If the operator is satisfied with the new value as it appears in the demand windows, he may enter the new quantity into the DEH operating system by pressing the ENTER button. The ENTER button is described in more detail in a later section on the keyboard.

5. If for any reason the operator is not satisfied with the value as it appears in the demand windows, he may press the CANCEL button. The CANCEL button will be described in more detail in a later section on the keyboard. This removes the number from the DEMAND windows and allows the operator to begin a new sequence for the parameter.

6. Assuming that the operator is satisfied with the number and that he presses the ENTER button, the new value of the parameter appears in the REFERENCE window and the DEMAND window is cleared. This is an acknowledgement that the DEH programs have accepted the number and are using the new value from that point on.

7. If for any reason the numerical value entered into the DEH system violates preprogrammed conditions (such as high limits less than low limits), the entire operation is aborted and the INVALID REQUEST lamp is flashed.

The above description of data manipulation is modified somewhat when the operator wishes to display or change the turbine reference and demand. Both of these quantities are displayed when the reference button is pressed. During wide-range speed control, the left REFERENCE display contains the turbine speed reference value, while the right DEMAND display contains the turbine speed demand. During load control the REFERENCE display contains the turbine load reference while the demand display contains the turbine load demand.

Since the reference and demand control the turbine valves directly, it is essential that the operator have a unique handle on these quantities so that he may start or stop reference changes quickly and easily. This is accomplished by use of the GO and HOLD buttons in conjunction with the reference button. The GO and HOLD buttons control two reference states in the DEH system, which indicate whether the reference and demand are equal or unequal. When these quantities are equal, both the GO and HOLD backlights are off.

When these quantities are unequal, either the GO or the HOLD lamp is on. If the GO light is turned on, the reference is changing to meet the demand value at the selected rate. Should the operator wish to stop the reference adjustment process, he simply presses the HOLD button. The HOLD button then backlights and holds the reference at its current value. When the operator wishes to start the reference moving again, he must press the GO button, which then backlights and enables the reference to adjust to the proper value.

The sequence of steps for displaying or changing the reference follows:

1. The operator presses the reference button. The DEH programs display the current value of reference in the left windows and the current value of demand in the right windows.

2. If the operator wishes to change the demand, he types the new value on the keyboard. This is displayed in the DEMAND windows, but is not yet entered into the DEH programs.

3. If the operator is satisfied with the new value, he presses the ENTER button. This places the new demand value in the DEH programs and turns the HOLD lamp, assuming that the new demand satisfies certain limit checks to be described shortly. If these conditions are not met, the INVALID REQUEST lamp is flashed, the new value is ignored, and the original value is returned to the DEMAND windows.

4. If the operator is not satisfied with the new value (set in Step 3), he simply presses the CANCEL button. The DEH programs then ignore this value and return the original value to the DEMAND windows.

5. If a new demand is finally entered and the HOLD lamp comes on, the operator may start the reference adjusting to this new demand by pressing the GO button. The HOLD lamp is turned off, the GO lamp is turned on, and the reference begins to move at the selected rate toward the demand.

6. At any time, the operator may inhibit the reference adjustment by pressing the HOLD button. He may then restart the reference adjustment by pressing the GO button.

7. When the reference finally equals the demand both the GO and HOLD lamps will be turned off.

Each of the eight display buttons set the integer pointer (IPBX) to its assigned value and the appropriate panel lamps are turned off and on. IPBX is then checked by the VISUAL DISPLAY task, which selects the numerical values from computer memory and displays then in the windows.

The TURBINE PROGRAM DISPLAY button also resets a few logical states in preparation for keyboard entries. These are discussed in later paragraphs on the keyboard description. The remote control modes AS, ADS and ATS for the Automatic Synchronizer, Dispatch System and TURBINE STARTUP program are checked, along with the manual control state (TM) if the maintenance test switch (OPRT) is not set. All of these modes exclude the possibility of the GO and HOLD buttons being active, so these buttons are ignored in these states and the PANEL program simply exits. However on operator automatic control, the HOLD button state (HOLDPB) is set, or the GO button state (GOPB) is set. In the latter case, HOLDPB is also reset. The LOGIC task is requested to run by setting the RUNLOGIC variable, and the program then exits.

OPERATING MODE SELECTION

There are five buttons which may be used to select the turbine operating mode. When any of these are pressed, they initiate major operating changes in the DEH Control System, assuming the proper conditions exist for the mode selected. A brief description of these buttons follows:

1. OPERATOR AUTOMATIC (OPER AUTO) — This button places the turbine in automatic control with the operator providing all demand, rate, and set point information from the keyboard. If the turbine had been previously in manual control, the OPER AUTO lamp must be flashing to indicate that the DEH system is ready to accept automatic control; otherwise pressing the OPER AUTO button is ignored. If the turbine had been in one of the remote control modes listed below, then pressing the OPER AUTO button rejects the remote and returns automatic control to the operator.

2. AUXILIARY SYNCHRONIZER (AUTO SYNC) — This button allows automatic synchronizing equipment to synchronize the turbine generator with the power system by indexing the speed demand and reference with raise/lower pulses, in the form of contact inputs.

3. AUTOMATIC DISPATCHING SYSTEM (ADS) — This button allows automatic dispatching equipment to operate the turbine generator by setting the load demand and reference. A number of dispatching options are available, including raise/lower pulses, raise/lower pulse-width modulation, and analog input values to set the reference.

4. AUTOMATIC TURBINE STARTUP (TURBINE AUTO START) — This button allows a special computer program to automatically start up and accelerate the turbine during wide-range speed control. The program may reside in the DEH computer or it may exist in another computer in the plant or at a remote location.

5. COMPUTER DATA LINK (COMP DATA LINK) — This optional button allows another computer, either in the plant or at a remote location, to provide all demand, rate, and set point information to the DEH system.

The OPER AUTO button resets the remote mode button states (ASPB, ADSPB and AUTOSTAR) for Automatic Synchronizer, the Automatic Dispatch System, and the AUTOMATIC TURBINE STARTUP program, respectively. Since the operator automatic state (OA) is merely the logical inverse of the turbine manual state (TM), the PANEL task cannot actually set OA, but can only request the LOGIC task to run, by setting the RUNLOGIC variable. The LOGIC program then determines whether or not operator automatic is accepted by the manual backup system.

The remote buttons set their corresponding pushbutton states after which RUNLOGIC is set. As in the case of operator automatic, the LOGIC task then determines if the requested mode will be accepted.

The data link button is handled somewhat differently; this is a push-push button whose state (DLINK) is given the logical inverse of its previous value at statement 14. The new state is then interrogated in order to determine whether to turn the button backlight on or off, after which the program exits.

AUTOMATIC TURBINE STARTUP

Five buttons are associated with the automatic turbine startup feature of the DEH system. A brief description of these buttons follows:

1. AUTOMATIC TURBINE STARTUP (TURBINE AUTO START) — This button allows a special computer program to automatically start up and accelerate the turbine during wide-range speed control.

2. TURBINE SUPERVISION OFF — This is a push-push button which controls the printout of messages from the turbine supervisory programs. Normally, the messages are always printed; the operator may suppress printing by pressing this button, which then backlights. Should the messages be desired later, then the button may be pressed again; the lamp is turned off and the supervisory messages are printed on the typewriter.

3. OVERRIDE ALARM — This button overrides certain alarm stops which the AUTOMATIC TURBINE STARTUP program may detect. When this happens, the program waits for operator action before proceeding with the acceleration. If the operator decides to continue the startup, he presses the OVERRIDE ALARM button.

4. OVERRIDE SENSOR HOLD — This button overrides certain analog input sensor stops, which the AUTOMATIC TURBINE STARTUP program may detect. When this happens, the program waits for operator action before proceeding with the acceleration. If the operator decides to continue the startup, he presses this button.

5. RETURN SENSOR TO SCAN — This button returns certain analog inputs to scan after their sensor has been repaired. Should a sensor fail, the AUTOMATIC TURBINE STARTUP removes the corresponding input from scan; when the sensor is detected valid again, this button is backlighted to notify the operator. He then presses the button to return the input to its normal scan.

MANUAL BUTTONS

Six buttons on the Operator's Panel are associated with manual operation of the turbine. Even though the DEH PANEL program does not interface directly with these buttons, a brief description of their funcion is given for completeness. In general, these buttons allow the operator to control the position of the turbine throttle and governor valves directly from the panel.

1. TURBINE MANUAL — This button places the turbine under manual control of the operator, with the transition from automatic being achieved essentially bumplessly.

2. TV LOWER — This button lowers, or decreases, the throttle valves at a fixed rate as long as the button is held down.

3. TV RAISE — This button raises, or increases, the throttle valves at a fixed rate as long as the button is held down.

4. GV LOWER — This button lowers, or decreases, the governor valves at a fixed rate as long as the button is held down.

5. GV RAISE — This button raises, or increases, the governor valves at a fixed rate as long as the button is held down.

6. FAST ACTION — This button opens or closes the throttle and governor valves, at a fast rate, in manual control. The FAST ACTION button must be held down at the same time as any of the TV or GV RAISE/LOWER buttons described above to achieve the fast action effect.

KEYBOARD ACTIVITY

There are fourteen buttons associated with keyboard activity on the DEH Operator's Panel. Of this total, eleven are numerical keys; these include the integers 0 through 9 and a decimal point. Three additional buttons are available for use with the keyboard to aid in data display or change. A brief description of these buttons follows:

1. NUMERICAL BUTTONS 0 THROUGH 9 — When the operator keys in numbers of these buttons, the correspoding values are displayed in the reference or demand windows, whichever are appropriate, for the function being performed. The values move from right to left in the windows as new keys are pressed, and both leading and trailing zeros are always displayed. If more than four numerical keys are pressed, the left-most value in the windows is lost as the new value is entered in the right-most window, and the remaining values shift left one position.

2. DECIMAL POINT BUTTON — When the decimal point key is pressed, the PANEL program retains this information but does not yet display it. When the next numerical key is pressed, both the value and the decimal point appear in the right-most window. The decimal point is positioned in the lower left-hand corner of the window position. Should additional numerical keys be pressed, the decimal point moves one position to the left with the number with which it was originally entered. Should the decimal point be shifted out of the left-most window it is lost, and a new point may be entered.

3. ENTER — When this button is pressed, the PANEL program enters the value residing in the reference or demand windows, whichever is appropriate, into core memory and performs the correct action requested by the keyboard activity. This action may consist of visual display, parameter change, or intermediate steps in a sequence of operations as described in preceding sections.

4. CANCEL — When this button is pressed, the PANEL program clears both the reference and demand windows, deletes any intermediate values in computer memory, and aborts the entire sequence of operations which was canceled. The operator may then begin a new sequence of steps.

5. CHANGE — This button indicates a sequence of operations necessary to alter numerical values residing in the DEH system memory. The steps necessary to change parameters are described earlier.

The decimal point key and keys 0–9 are serviced to check the validity of the requested entry and to set the entry if it is valid. Among other checks, a check is made on the integer IPBX, which represents the visual display and change button which has been previously pressed. If this value equals 2, thus indicating the acceleration rate button has been pressed, and the Automatic Turbine Startup mode (ATS) is in control, all keyboard buttons are invalid. During the ATS mode the acceleration rate is controlled by the startup program, and thus may be visually displayed but cannot be changed from the keyboard.

Should the ATS state be satisfied, the pointer IPBX is checked to determine if it is equal to 6; if so, the keyboard entry is flashed as invalid because this represents the valve position limit display mode, which cannot use the keyboard. If this situation is all right, the valve test button state (VTESTPB) is checked; should VTESTPB be set and the valve being tested NVTEST is non-zero, the keyboard entry is invalid. This is because NVTEST indicates that some valve has already been selected for test, thus implying that no further keyboard activity is necessary.

Finally, some special tests are made if IPBX equals 1; this means the reference display mode has been selected. If this is the case, all remote control modes such as Automatic Synchronizer (AS), Automatic Dispatch System (ADS), and Automatic Turbine Startup (ATS), imply that the keyboard cannot be used during reference display. Thus these result in the INVALID REQUEST lamp being flashed. In addition, should the turbine be on manual control (TM) or unlatched (NOT ASL), and not in the maintenance test mode (OPRT), then keyboard activity is also invalid during reference display. All of these cases are invalid for keyboard entry because the turbine demand and reference are set by the remote mode or the manual tracking system. The only time that the operator may use the keyboard in the reference display mode is during operator automatic control or during the maintenance test condition in which the DEH system is being used as a simulator and trainer.

Should all of these tests be passed properly, the logical state KEYENTRY is set and the numerical value in location KEY is checked. This is the keyboard button which has just been pressed, and must lie between 0 and 9 inclusive; otherwise, the entry is flashed as invalid. For a valid value of KEY, the program then places the new number in its proper position in the integer array (IW). This array has a place for each of the four window positions of the visual display and, as keyboard buttons are pressed, the entries move down one position in IW and the latest key is entered in the top position. The pointer ID maintains the proper position for each new key. Thus, if ID equals 0, this means there are no entries in the array IW. The value KEY is thus placed in the first position of IW. However, if ID is not zero, then a FORTRAN DO loop is executed to move the entries in IW down one position prior to entering the new value of key in the first position at statement 414. Then the value of the pointer ID is checked again; if it is less than 3, it is incremented by 1. If it is equal to 3, it retains that value. This is the mechanism used to accept more than four keyboard values with only the last four key entries being retained.

CONTROL TASK

Speed Selection Function

An additional task which the speed selection function must accomplish is the bumpless transfer mechanisms necessary when the speed input signals are switched, and when all speed inputs fail. These bumpless transfers are incorporated only on load control, since speed switching then can be significant in affecting governor position and thus turbine load. During speed control, no noticeable effect of speed signal switching may be expected.

Consider first the case when the speed signal is to be switched from the digital to the analog channel, or from the analog to the digital channel. The portion of the Load Control System which will be affected by such a change includes essentially the speed feedback loop output (X, considered simply as a single block since the details are not important in this context), the turbine load reference (REFDMD), and the turbine speed modified load reference (REF1).

When the speed signal is switched, the factor X changes, in general, so it is necessary to change the reference (REFDMD) to avoid a bump in REF1 and ultimately in the valves. Suppose that the system has been using one of the two speed inputs (it is immaterial which one), and thus had been yielding a speed feedback factor ($X_1$). Then the value of REF1 is given by:

$$REF1_1 = REFDMD_1 + X_1 \quad (35)$$

Now the system switches to the other input and yields a speed feedback factor ($X_2$). The corresponding value for REF1 is given in:

$$REF1_2 = REFDMD_2 + X_2 \quad (36)$$

To yield a bumpless transfer, it is necessary to hold the value of REF1 constant, as indicated in the following expression:

$REF1_2 = REF1_1$ Substituting Equations (35) and (36) into (37) and solving for the new value of REFDMD gives the proper condition for a bumpless transfer, as shown below:

$$REFDMD_2 = REFDMD_1 + X_1 - X_2 \quad (38)$$

Thus when the speed signal is switched, the speed selection function recomputes the new value of turbine reference according to Equation (38) and achieves the required bumpless transfer.

Consider next the situation in which both the digital and the analog signals fail, thus requiring the speed feedback loop to be disabled and taken out of service. Again this must be accomplished bumplessly so that the governor valves, and thus turbine load, do not change significantly. The value of the speed compensated reference when the speed loop (SPI) is in service is given by:

$$REF1_{in} = REFDMD_n + X \quad (39)$$

When the loop is taken out of service due to speed channel failure, the value of REF1 is computed from:

$$REF1_{out} = REFDMD_{out} \quad (40)$$

To yield a bumpless transfer, it is necessary to hold the value of REF1 constant as follows:

$$REF1_{out} = REF1_{in} \quad (41)$$

Substituting Equations (39) and (40) into (41) and solving for the new value of REFDMD gives the proper conditions to maintain a bumpless transfer, as shown below:

$$REFDMD_{out} = REFDMD_{in} + X \quad (42)$$

Thus, to satisfy the conditions for bumpless transfer with respect to the speed loop, the speed selection function must reset the reference as given in Equation (42) to maintain constant valve position and thus constant load during this interval. Brief consideration will now be directed to the two out of three logical error detection scheme used by the speed selection function. It must be realized first that the three speed signals will rarely, if ever, be exactly equal; thus, it is necessary to compare these signals with each other and check for a significant difference. The value of the allowable difference given by WSERROR and is a keyboard entered constant; should any two speeds differ in magnitude greater than WSERROR, then one or both of the speeds are faulty. The allowable speed error (WSERROR) is usually set about 100 rpm.

The speed selection process compares the three speeds and bases its logical conclusions on the results of this test. Since there are three differences (between the digital and the analog, the digital and the supervisory, and the analog and the supervisory), which may or may not be greater than WSERROR, then there are eight possible combinations which must be examined. Table 1 lists these combinations, the decision as to which speed to be used, and a comment on each situation. The column titles in Table 1 indicate "approximately equal", which means that the various speeds agree within WSERROR rpm. The letter Y in the table means YES they do agree, while the letter N means NO they do not agree.

The speed selection function simply compares the speed differences which exist every 1 sec (the sampling interval for the CONTROL task) and finds the corresponding entry in Table 1. Logical conditions are then set to carry out the appropriate action as indicated by the comments in Table 1, to assure proper control by the remaining parts of the DEH system.

SELECT OPERATING MODE FUNCTION

The SELECT OPERATING MODE program must distinguish between speed and load control by examining the state of the main generator circuit breaker. For wide-range speed control, the program flow chart is shown in FIG. 37A. The automatic synchronizer state (AS) is first interrogated; if it is the operating mode, the auto sync increase and decrease states (ASINC and ASDEC) are examined. These states are flip-flops which are controlled by the LOGIC task when the auto sync raise or lower contact inputs are set. The program carefully checks to see if both the increase and decrease states are set; if so, no action is taken. Otherwise a temporary location (TEMP) is set to +1 rpm or −1 rpm for each pass through the program during which the appropriate contact input is set. The turbine speed reference and demand are then incremented properly, the ASINC and ASDEC states are reset for the next time, and the program passes to the next stage of the CONTROL task.

If the automatic synchronizer is not the operating mode, then the Automatic Turbine Startup (ATS) state is interrogated at statement 4000 (FIG. 37A. If it is the operating mode, as determined by the LOGIC task, the turbine speed demand and rate are selected from this program via computer locations TASDMD and TASRATE. The rate is then checked against an absolute high limit (OARATMAX), which is a keyboard entered constant usually set at 800 rpm after which the program passes on to the next stage of the CONTROL task.

If the AUTOMATIC TURBINE STARTUP program is not the operating mode, the Operator Automatic (OA) state, and the Maintenance Test (OPRT) state are interrogated at statement 6000 (FIG. 37A). If either of these states are set, the turbine speed demand and rate are selected from the keyboard and the program proceeds to the next stage of the CONTROL task. Note that on Operator Automatic the keyboard values control the turbine, while in Maintenance Test the keyboard values simulate a turbine.

If neither Operator Automatic nor Maintenance Test is the operating mode, then the turbine is in Manual control and the SELECT OPERATING MODE program goes into the manual tracking mode at statement 7000. If the contact input (THI) is set, this means the throttle valves are wide open and the turbine is in speed governor control. Then the error between manual and computer governor valve outputs (IGVMAN and IGVAO) is multiplied by a gain factor (GR10) and saved in a temporary location. If the contact input (THI) is not set, then the turbine is in speed throttle control and the error between manual and computer throttle valve outputs (ITVMAN and ITVAO) is multiplied by a gain factor (GR5) and saved in a temporary location.

In either case, assuming the speed loop (SPI) is in service, the valve output error is checked against a speed tracking deadband (DBTRKS, which is a keyboard entered constant usually set at 1 percent) and the reference is checked against actual speed (WS) through a reference tracking deadband (DBTRKREF, which is also a keyboard entered constant usually set at 50 rpm). If both conditions are met, the READY state is set to indicate the DEH system is ready to assume automatic control. The READY state is detected by the FLASH task, which then flashes the OPER AUTO light to let the operator known that he may transfer to automatic control.

Finally, the gained valve position error in the temporary location (TEMP) is uused to increment the reference (REFDMD), which is then checked against an absolute high speed limit (HLS). This is a keyboard entered constant which is normally set at 4200 rpm. The program then transfers to statement 15500 for some final bookkeeping checks.

When the SELECT OPERATING MODE program determines that the main generator circuit breaker is closed, thus indicating the turbine is on load control, transfer is made to statement 10000 which is shown in FIG. 37B. The Throttle Pressure Control (TPC) state is interrogated; if it is in service, then the actual throttle pressure (PO) is compared against a set point (POSP), which is a keyboard entered constant usually set at about 1600 psia. If the throttle pressure (PO) is above the set point (POSP), no further action is taken. But if PO is below POSP, then the governor valve position (GVSP) as called for by the computer is checked against a minimum governor valve set point (GVSPMIN). This is a keyboard entered constant usually set at about 25 percent. If GVSP is less than GVSPMIN, no further action is taken; but if GVSP is greater than GVSPMIN, then the throttle pressure limiting state (TPLIM) is set and the reference load rate is set to runback the reference at the rate TPCRATE, which is a keyboard entered constant usually set at 200 percent per minute. The program then transfers to statement 11500 for further bookkeeping computation.

If no throttle pressure contingency exists, the RUNBACK contact input (RB) is interrogated; if it is set, the load reference is runback at the rate (RBRATE, which is a keyboard entered constant set at about 100 percent per minute. Then at statement 11500 some bookkeeping details are taken care of. Thus if the Automatic Dispatch System (ADS) state has been in control when either a throttle pressure limit or runback condition occurred, this mode is rejected by resetting the automatic dispatch system pushbutton state (ADSPB) and setting the RUNLOGIC flag. Within 1/10 sec the AUX SYNC task bids the LOGIC task, which then realigns all states to the correct position. A second bookkeeping check is made at statement 11700 where the HOLD state is checked. If HOLD is reset, then it is set so that the operator has an indication of why the reference has been runback.

If no runback contingency exists, then the Automatic Dispatch System (ADS) state is interrogated at statement 1200. If it is the operating mode, the ADS increase and decrease states (ADSINC and ADSDEC) are examined. These are flip-flops which are controlled by the LOGIC task when the ADS increase and decrease contact inputs are set. The program carefully checks to see if both the increase and decrease contacts are set; if so no action is taken. Otherwise a temporary location (TEMP) is set to the ADS raise or lower pulse count (IADSUP or IADSDOWN). The AUX SYNC task keeps track of these pulse counts according to the conditions set up by the LOGIC task. However, a maximum ADS pulse-width is imposed on both the raise and lower pulses in the SELECT OPERATING MODE program by comparing their counts (IADSUP and IADSDOWN) with a limit (ADSMAXT), which is a keyboard entered constant usually set to 10 counts of 1/10 sec each (thus yielding a maximum pulse-width of 1 sec). After the pulse-width limiting action, at statement 12400 the turbine load reference and demand are incremented by an amount proportional to the pulse-width; the proportionality factor (ADSRATE) is a keyboard entered constant usually set somewhere between 1 and 10 MW per sec of pulse-width. Finally, at statement 12600, various ADS counters and states are reset prior to moving on to the next stage of the CONTROL task.

If the ADS state is not set, then the select operating mode program checks the Operator Automatic (OA) state and the Maintenance Test (OPRT) state at statement 14000. If either of these states are set, then the turbine demand and rate are accepted from the keyboard and the program proceeds to the next stage of the CONTROL task. Note that in Operator Automatic the keyboard values control the turbine, while in Maintenance Test the keyboard values simulate a turbine.

If neither Operator Automatic nor Maintenance Test is the operating mode, then the turbine is in Manual control and the SELECT OPERATING MODE program goes into the Manual Load Tracking mode at statement 1500. The error between the manual and computer governor valve outputs (IGVMAN and IGVAO) is stored in a temporary location (TEMP) and compared against a load tracking deadband (DBTRKL), which is a keyboard entered constant usually set at about 1 percent. If the outputs agree within DBTRKL, then the READY state is set to indicate the DEH system is ready to assume automatic control. The READY state is detected by the FLASH task, which then flashes the OPER AUTO light to let the operator know that he may transfer to automatic control.

The valve output error is then gain multiplied by GR9 and added to the current reference (REFDMD), which is high-limit-checked against MWMAX, a keyboard entered constant usually set to about 120 percent of rated megawatts. REFDMD is also low-limit-checked against zero, thus assuring that the tracking scheme will not windup in either direction. Finally, a last check is made to determine if a voltage exists on the test analog output lines; if so, the READY state is reset so that transfer to automatic control is inhibited until this voltage is removed. This may be done by pressing the OPEN valve test pushbutton until the lights behind the OPEN and CLOSE pushbutton go out.

SPEED/LOAD REFERENCE FUNCTION

The GO state is checked; if GO is off, the HOLD state is checked. If HOLD is on and the demand and reference value (REFDMD) are equal, then the logical states (GOHOLDOF and RUNLOGIC) are set. This results in the LOGIC task being bid within 1/10 sec by the AUX SYNC task, which recognizes the RUNLOGIC state. The LOGIC task then turns off the HOLD flip-flop and lamp as requested by the GOHOLDOF state.

If the GO state is set back however, then this is the signal to allow the reference to move toward the demand. The magnitude of the difference between the reference and the demand is computed and stored in a temporary location. Then the magnitude of the incremental step size taken each second by the selected rate, as discussed above, is saved in another temporary location. These two temporary quantities are then compared and if the demand/reference difference in TEMP is greater than the incremental step size in TEMP1, this means the reference must continue to move closer to the demand. However, the governor valve position limiting state (VPLIM) is checked; if it is set and the demand is above the reference, then no movement is allowed in the reference. This is because the valve position limit function is operating and refuses to allow any increase in reference because this will attempt to increase the governor valve position beyond the limit.

If there is no valve position limiting action, then the reference is incremented by the incremental rate step size and the program transfers for final exit.

Eventually the reference will approach within the allotted boundary of the demand. Then the reference program immediately sets the reference equal to the demand. Finally, the state of the breaker (BR) is interrogated; if it is set, the program transfers for the Load Control System computations, while transfer is made for the Speed Control System computations if the breaker state (BR) is reset.

SPEED CONTROL FUNCTION

To provide the simulation and training feature, FIG. 39 shows an additional program path which will internally generate a simulated speed signal (SIMWS) in the Maintenance Test mode of operation. This is accomplished by feeding back the speed controller output (SPDSP) through a first order lag transfer function which approximates the turbine inertia response. This simulated speed then replaces the actual speed in developing a speed error during the Simulation/Training mode of operation.

All speed control system parameters, such as gains, reset times and limits, are keyboard entered constants which are available for tuning or adjustment during the Maintenance Test mode. These changes require transfer of the turbine control to manual operation.

Logical checks are made to determine whether the speed computations should be evaluated. Thus, if the speed inputs failed and are unreliable, then the speed loop (SPI) is taken out of service, and there is no speed information by which to control the turbine. In addition, if the overspeed speed protection circuit in the Analog Backup System is operating, as indicated by the contact input (OPCOP), this closes the governor valve and thus overrides the DEH Speed Control System; consequently in this case, no speed control computations are performed.

Assuming that neither of these situations exist, the speed error is calculated. If the system is in the Simulation/Training mode, this error is the difference between the reference and simulated speed; the speed error is the difference between the reference and actual speed in all other cases. Following this error computation, a decision is made as to whether the turbine is on governor or throttle control. Appropriate calls are then made to the PRESET subroutine to evaluate the proportional-plus-reset controller action for the throttle or governor valve. This subroutine takes care of evaluating the controller algorithm and the high/low limit checks to eliminate reset windup.

LOAD CONTROL FUNCTION

As in the Speed Control System, all parameters in the Load Control System are keyboard entered constants, which may be tuned or adjusted in the Maintenance Test mode. As always, changes of this type require transfer to manual control for the adjustment, after which the DEH system will track and permit return to automatic control.

To provide the simulation and training feature disclosed previously, FIG. 40 shows additional program paths which internally generate simulated megawatt and impulse pressure signals (SIMMW and SIMPI) in the Maintenance Test mode of operation. These are accomplished by feeding back the load reference (REF2) and the valve set point (VSP) (through software) to first order lag transfer functions which approximate the generator and turbine responses. These simulated signals then replace the actual feedbacks in developing megawatt and impulse pressure errors during the Simulation/Training mode of operation.

A check is first made (FIG. 41) to determine if a change has occurred in the throttle pressure limit state (TPLIM); if so the LOGIC task aligns all status variables accordingly. The LOAD CONTROL program next checks the speed transducer failure state (SPTF). If there is no failure, the speed feedback loop is evaluated with a call to the SPDLOOP subroutine; if there is a speed transducer failure, the speed feedback loop is bypassed and the speed compensation factor (X) is set to zero. Whichever is the case, the factor (X) is summed with the turbine load reference (REFDMD) to form the speed compensated load reference (REF1). A low-limit-check against zero is performed on REF1 to keep it from going negative, which is possible should a turbine overspeed condition result.

The LOAD CONTROL program then checks the maintenance test contact input (DPRT), which if set means the DEH system is being used as a simulator/-trainer or control system tuning is underway. In either case, simulated megawatt and impulse pressure signals (SIMMW and SIMPI) are generated; if the turbine is not in this mode, then the simulated signals are set equal to the actual signals.

The state of the megawatt feedback loop (MWI) is checked; if the loop is out of service, the speed/-megawatt compensated load reference (REF2) is simply set equal to the speed compensated load reference (REF1). But if the megawatt loop is in service, the megawatt error is computed and ranged to a per unit value by using the ranging gain (GR2), which is normally set at rated turbine generator megawatts. Then the PRESET subroutine is called to evaluate the megawatt proportional-plus-reset controller, including high/low limit checking. The result of this computation is the megawatt trim factor (Y), which is then applied to the speed compensated load reference (REF1) in a product relationship to form the speed/megawatt corrected load reference (REF2).

The speed/megawatt compensated load reference (REF2) is converted to an impulse pressure set point (PISP) by use of ranging gain (GR3). The state of the impulse pressure feedback loop (IPI) is then interrogated; if it is out of service the governor valve set point (VSP) is simply set equal to the impulse pressure set point (PISP) in psi. But if the impulse pressure loop is in service, then the impulse pressure error is computed and used as the driving signal for the proportional-plus-reset controller, which is evaluated by a call to the PRESET subroutine; this also does the high/low limit checking.

Finally, the governor valve set point (VSP) in psi is converted to a governor valve set point from 0 to 100 percent by use of the ranging gain (GR4), which is normally set at rated impulse pressure. The program then transfers to the final stages of the CONTROL task which actually compute the throttle and governor valve outputs.

THROTTLE VALVE CONTROL FUNCTION

The throttle control state (TC) is interrogated (FIG. 42); if it is set, this means the throttle valves are in positive control, and the program computes the throttle valve analog output from the speed controller value (SPD) and the keyboard entered ranging constant (GR6). However, if the throttle control state (TC) is not set, then the governor control state (GC) is checked. If it is not set, this means that the turbine is unlatched and that the throttle valves should be at their minimum position of completely closed. The program then computes the throttle valve analog output of zero.

If the governor control state (GC) is set, it is then necessary to determine if the throttle/governor transfer is complete by checking the TRCOM state. If TRCOM is not set, this means the transfer is still in progress; an additional check is made to determine if the governor valves have closed as indicated by GVMIN. If GVMIN is not set, then the throttle valves are still in positive control and the program computes the throttle valve analog output as required by the speed controller value (SPD) and the ranging gain (GR6).

Eventually the state GVMIN will be set to indicate that the governor valves are now in positive control. Then the throttle valve maximum position state (TVMAX) is questioned. If it is not set, then the throttle valve bias integrator (TVBIAS) is incremented by the bias constant (BTVO) and the throttle valve analog output set accordingly. In a short time the throttle valves are wide open; after this all logical states will be set to indicate this fact. Succeeding passes through the THROTTLE VALVE CONTROL program will then hold the throttle valve analog outputs wide open until the turbine is unlatched and tripped for some reason.

GOVERNOR VALVE CONTROL FUNCTION

The governor valve position, as set by the governor valve control function, is compared to (and high limited by) the valve position limit (VPOSL) at all times. This gives the operator the ability to override the control system at any time that he considers it necessary, and allows him to control the position of the governor valves from VALVE POSITION LIMIT RAISE and LOWER pushbuttons on the Operator's Panel. If the governor valves are limited by the valve position limit (VPOSL), the lamp behind the VALVE POSITION LIMIT DISPLAY pushbutton flashes, thus alerting the operator to the condition.

Various logical numerical checks are necessary to determine which of the five situations the turbine is currently in, on a second-by-second real time basis. Further, the actual governor valve analog output computation is made for each of these five situations, along with the valve position limit checking feature and additional bookkeeping computations necessary for coordination of the various DEH programs.

Figure 43:
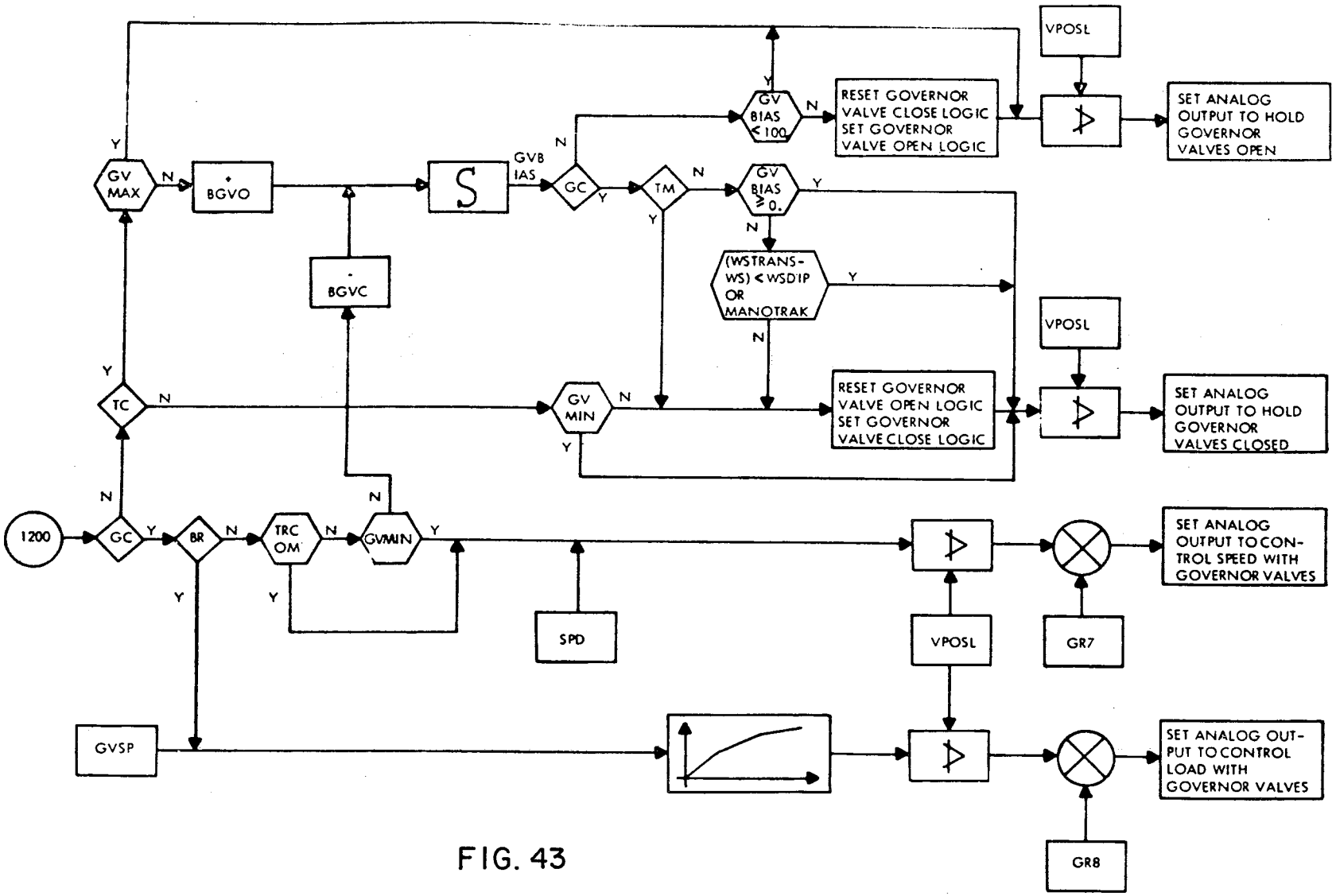
FIG. 43 shows a mixed block diagram of a governor control function program which is operable in accordance with the principles of the invention.
Figure 44:
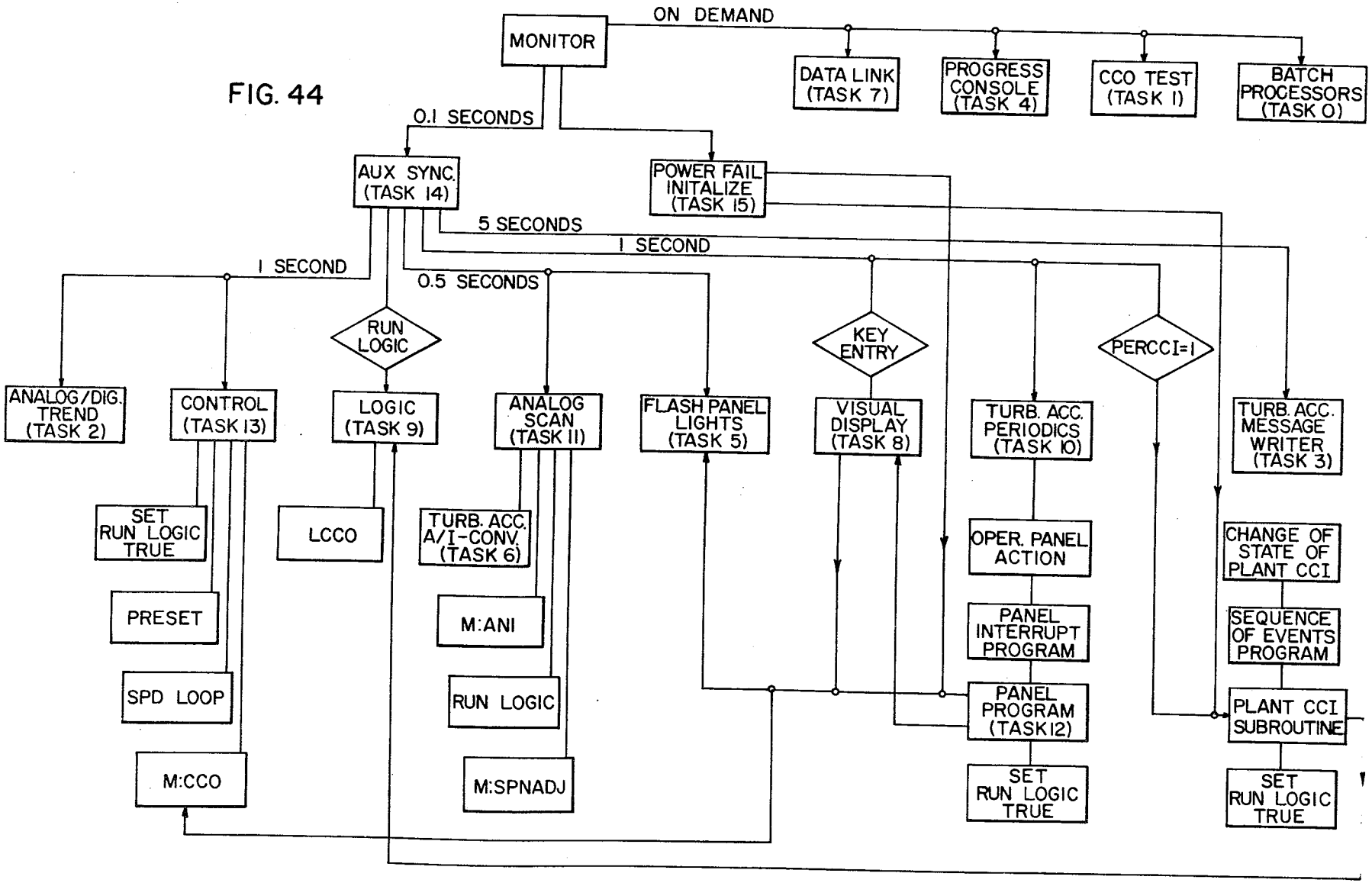
FIG. 44 shows a block diagram of the Digital Electro Hydraulic System which is operable in accordance with the principles of the invention.

Considering the flow chart of FIG. 43 at statement 1200, the valve position limit state (VPLIM) is reset at each pass through the governor valve control program. Then the governor control state (GC) is interrogated; if it is not set, the throttle control state (TC) is checked. If throttle control (TC) is not set, this means the turbine is unlatched and the governor valve minimum state (GVMIN) is checked. If GVMIN is not set, then at statement 1270 all governor valve open states are reset and all governor valve close states, including GVMIN, are set. The program then transfers to statement 1320 for analog output computation and valve position limit checking to hold the governor valves closed. Succeeding passes through the program will find the GVMIN state set and transfer directly to statement 1320.

If the turbine is latched, then the throttle control state (TC) is set. The governor valve control function finds itself at statement 1210, where the governor valve maximum state (GVMAX) is interrogated. If it is not set, then the governor valve bias integrator (GVBIAS) is incremented by the governor valve open-bias constant (BGVO), which is keyboard entered constant usually set at 10 percent to open the governor valves incrementally when the turbine is latched. The program then transfers to statement 1240 where the governor control state (GC) is again checked, since this point in the program may be reached from alternate paths. For the present situation, GC will not be set, thus leading to a check on whether the governor valve bias integrator (GVBIAS) has reached 100 percent and therefore have positioned the governor valves wide open. Assuming that GVBIAS has incremented up to 100 percent, all governor valve close states are reset and all governor valve open states are set, including GVMAX. The program then transfers to statement 1320 for analog output computation and valve position limit checking to hold the governor valves wide open. Succeeding passes through the program find the GVMAX state set at statement 1210 and transfer directly to statement 1320.

Each of the cases discussed above apply when the governor control state (GC) is not set. Once the throttle/governor transfer is initiated, however, this sets the governor control state (GC), in which case the GOVERNOR VALVE CONTROL program arrives at statement 1220. The state of the breaker (BR) is checked; if BR is set, this means the DEH system is on load control and the program transfers to statement 1340 for load computation of the governor valve analog outputs and valve position limit checking.

However, if the breaker (BR) is open and the DEH system still in speed control, the check of BR at statement 1220 finds it not set. Then the throttle/governor transfer complete state (TRCOM) is checked; assuming it has not yet been set, the governor valve closed state (GVMIN) is checked. Normally this will not be set at this point in time, thus requiring the governor valve bias integrator (GVBIAS) to be decremented by the governor valve close-bias constant (BGVC), which is a keyboard entered quantity normally set at 100 percent to instantly close the governor valves when the transfer from throttle to governor control is initiated.

The program then passes on to statement 1240 where the governor control state (GC) is checked again; since GC is set for the present discussion, then at statement 1260 the manual contact input (TM) is interrogated. If the turbine is in manual control at this time, the program transfers to statement 1270 for appropriate bookkeeping which will be described shortly. If the turbine is in automatic control, then the test at statement 1260 on the state of TM finds it not set and an additional test is made on whether the governor valve bias integrator (GVBIAS) has reached zero to indicate the governor valves are closed. If it has not, then the program cycles through this area until the GVBIAS value is zero. Normally this will take only a few passes since the closing bias constant (BGVC) will be quite large to achieve a fast, smooth throttle/governor valve transfer.

Once GVBIAS is zero, the GOVERNOR VALVE CONTROL program searches to determine if the turbine speed (WS) has dropped below the speed at transfer WSTRANS by an amount WSDIP, which is a keyboard entered constant usually set at 10 rpm. When this has occurred, and assuming that the analog backup system has followed the computer governor valve analog output as indicated by the manual not tracking state (MANOTRAK) the GOVERNOR VALVE CONTROL program transfers to statement 1270. All governor valve open states are reset and all governor valve close states, including GVMIN, are set and the program passes on to statement 1320 for computation of the governor valve analog output and valve position limit checking to hold the governor valves closed.

The setting of GVMIN at statement 1270 leads to execution of the LOGIC task, which then uses this information to generate the throttle/governor valve transfer complete state (TRCOM). Succeeding passes through the GOVERNOR VALVE CONTROL program at statement 1220 find TRCOM set and immediately transfer to statement 1380 for computation of the governor valve analog output and valve position limit checking to control turbine speed. The portion of the program at statement 1320 is that necessary to hold the governor valves at the value residing in the governor valve bias integrator (GVBIAS).

The computations necessary to position the governor valves on load control determine where the load control governor valve set point (GVSP) lies with respect to a nonlinear curve which characterizes the governor valve stroke mechanism. The result of this search positions GVSP along the abscissa of the curve, after which the actual valve position (GVPOS) is computed from analytical solution of points along the curve.

The computed governor valve position (GVPOS) is compared with the current valve position limit (VPOSL). If GVPOS is below VPOSL, no action is taken, if GVPOS is greater than VPOSL, then the valve position limiting state VPLIM is set, RUNLOGIC is set and the actual governor valve position GVPOS is reset to the value residing in VPOSL. The LOGIC and FLASH task perform their assigned functions of aligning the DEH system to these conditions and flashing the VALVE POSITION LIMIT DISPLAY lamp, respectively.

In the computations necessary to position the governor valves on speed control, the speed controller percent output (SPD), suitably ratioed to account for differences between the speed ranging gain (GR7) and the maximum ranging factor of 20.47, is checked against the current valve position limit (VPOSL). If the ratioed speed controller output is below VPOSL, no special action is taken; if VPOSL is violated, then the valve position limiting states (VPLIM and RUN-LOGIC) are set to trigger the appropriate responses from the LOGIC and FLASH tasks. In addition the speed controller output (SPD) and the speed integrator (RESSPD) are reset to values consistent with VPOSL.

A FORTRAN DO loop is executed to make final checks on both the throttle and governor valve analog outputs. They are low-limit-checked to guarantee that they do not go below zero and high-limit-checked to guarantee that they do not go above the maximum analog output voltage pattern. Then, the analog output handler is called to output the computed throttle and governor valve patterns. Finally, the CONTROL task exits to the Monitor for the next bid 1 sec later.

CCI SCAN MONITOR — ANNUNCIATOR ALARM

The DEH system scans contact inputs on a demand basis. The scan is initiated by a change of state of any contact. This change triggers a sequence of events interrupt which in turn bids the CONTACT SCAN program. However under certain conditions such as may occur during initial plant startup when all wiring has not been completely checked out, high-frequency noise on a contact can result in the sequence interrupt being generated continuously. This activity essentially "captures" the computer and prevents the DEH programs from carrying out their normal functions.

In order to counteract such a condition, special logic detects high-frequency contact noise. Should this occur, the DEH system immediately switches from a demand scan to a ½ sec periodic contact scan, the sequence interrupt is disabled, and a contact output is set which triggers the DEH CCI SCAN MONITOR annunciator alarm. If this happens, the noisy contact input should be found and the field problem fixed. After this is done, the DEH system may be returned to its originally designed demand scan by entering a particular constant from the keyboard as follows:

1. Turn the MAINTENANCE TEST key to the TEST position; this switches the turbine to manual control.
2. Press the PROGRAM DISPLAY button, which then back-lights.
3. Key in the address 3141 and press the ENTER buttons. The address appears in the left windows and the value 1.000 appears in the right windows.
4. Press the CHANGE button, which backlights. The right windows clear to zero.
5. Key in the value 0 and press the ENTER button. The CHANGE lamp goes out and the DEH CCI SCAN MONITOR annunciator is turned off.
6. Return the MAINTENANCE TEST key to the OFF position. The DEH system tracks the manual backup system preparatory to transfer to automatic control, which the normal demand scan being used.

I claim:

1. A system for operating a steam turbine in an electric power plant, said system comprising an arrangement of throttle and governor valves for supplying steam to the turbine, means for actuating said valves to position said valves in accordance with valve position signals, means for generating signals representative of the turbine speed and the turbine load and other turbine variables, a digital controller having means for generating a speed setpoint and means for generating a load setpoint, means for coupling the turbine speed and load signals and the other turbine variable signals to said digital controller on a periodic or demand basis, means for registering the coupled speed and load and other turbine variables in said digital controller, said digital controller including a speed control for periodically generating valve position outputs in response to the turbine speed and speed setpoint during turbine startup, said digital controller further including a load control for periodically generating valve position outputs in response to the turbine load and load setpoint during turbine load operation, means for continuously generating the valve position signals in response to the valve position outputs, said coupling means including means for generating contact signals representative of predetermined turbine variables and for scanning such signals on a predetermined basis for registration in said digital controller, said coupling means further including means for converting input analog signals to digital signals and for periodically scanning the digital signals for registration in said digital controller, an operator panel having switching means for generating control mode and control parameter signals, means for coupling the operator panel signals to said digital controller and for registering such signals in said digital controller, said speed and load controls having a plurality of control elements and mode switching means for determining which elements are operative in the functioning of the controls, a logic control for generating mode control outputs for operating said mode switching means in response to the registered control mode panel signals and the registered turbine contact signals, said digital controller including means for generating synchronous outputs to trigger the operation of said speed and load controls on a periodic basis, and means for operating said logic control on demand in response to changes in the panel or turbine contact signals.

2. A steam turbine operating system as set forth in claim 1 wherein said digital controller is embodied with a digital computer which further includes monitor means for controlling the execution of said logic control and said speed and load controls and other predetermined program elements in response to program run bids and in accordance with a predetermined priority system.

3. A steam turbine operating system as set forth in claim 2 wherein said synchronous generator output means includes an auxiliary synchronizer which generates trigger outputs for speed and load control program execution for which periodic bids are placed for its own execution at a rate substantially more frequent than the rate at which the control program is to be executed, said monitor means placing a higher priority on execution of said auxiliary synchronizer than on said speed and load controls.

4. A steam turbine operating system as set forth in claim 3 wherein bids are placed for execution of said logic control on demand and said monitor means places a higher priority on control program execution than on logic control program execution.

5. A steam turbine operating system as set forth in claim 3 wherein said auxiliary synchronizer further generates trigger outputs for said analog scan at a rate faster than the execution rate for said speed and load controls and slower than the auxiliary synchronizer execution rate, and wherein said monitor means places priorities on execution bids in the other auxiliary synchronizer, speed and load control, analog scan and logic control.

6. A steam turbine operating system as set forth in claim 2 wherein said synchronous generator output means includes an auxiliary synchronizer which generates trigger outputs for operating said periodic analog scanning means and for which periodic bids are placed for its own execution at a rate substantially more frequent than the rate at which the analog scan is to be executed, said monitor means placing a higher priority on execution of said auxiliary synchronizer than on said analog means.

7. A steam turbine operating system as set forth in claim 2 wherein the input contact signals are normally scanned on demand initiated by a contact signal change wherein said computer includes means for scanning the input contact signals periodically if computer duty above a predetermined level is being applied to contact scanning on a demand basis.

8. A steam turbine operating system as set forth in claim 1 wherein the input contact signals are normally scanned on demand initiated by a contact signal change.

9. A steam turbine operating system as set forth in claim 1 wherein said speed and load control functions approximately once each second and said analog scanning means functions approximately once each half second.

10. A steam turbine operating system as set forth in claim 1 wherein said speed and load controls include a proportional plus reset controller, means for coupling said porportional plus reset controller to each of said control elements which require a proportional plus reset function when such control elements are to be operated, means for uncoupling said proportional plus reset controller for each of the latter control elements when an output has been provided for each of such control elements, and means for registering the outputs from said proportional plus reset controller for use in the operation of the speed and load concontrols.

11. A steam turbine operating system as set forth in claim 1 wherein a speed controller is provided for generating a characteristic output in response to speed error, and means are provided for coupling said speed controller in said speed control or said load control according to the control mode.

12. A steam turbine operating system as set forth in claim 11 wherein the speed controller is a proportional plus integral controller and said speed controller coupling means includes means for applying one characterization in speed control and another characterization in load control.

13. A system for operating a steam turbine in an electric power plant, said system comprising an arrangement of throttle and governor valves for supplying stream to the turbine, means for actuating said valves to position said valves in accordance with valve position signals, means for generating signals representative of the turbine speed and the turbine load and other turbine variables, a digital controller having means for generating a speed setpoint and means for generating a load setpoint, means for coupling the turbine speed and load signals and the other turbine variable signals to said digital controller on a periodic or demand basis, means for registering the coupled speed and load and other turbine variables in said digital controller, said digital controller including a speed control for periodically generating valve position outputs in response to the turbine speed and speed setpoint during turbine startup, said digital controller further including a load control for periodically generating valve position outputs in response to the turbine load and load setpoint during turbine load operation, means for continuously generating the valve position signals in response to the valve position outputs, said coupling means including means for generating contact signals representative of predetermined turbine variables and for scanning such signals on a predetermined basis for registration in said digital controller, said coupling means further including means for converting input analog signals to digital signals and for periodically scanning the digital signals for registration in said digital controller, an operator panel having switching means for generating control mode and control parameter signals, means for coupling the operator panel signals to said digital controller and for registering such signals in said digital controller, said speed and load controls having a plurality of control elements and mode switching means for determining which elements are operative in the functioning of the controls, means for controlling said mode switching means in response to the registered control mode panel signals and the registered turbine contact signals, a flip-flop for generating switch outputs, means for connecting said flip-flop at least into said load and speed controls to function as each of at least some of said mode switching means and to generate a switch output for registration and speed and load control operation when so connected.

14. A system for operating a steam turbine in an electric power plant, said system comprising an arrangement of throttle and governor valves for supplying steam to the turbine, means for actuating said valves to position said valves in accordance with valve position signals, means for generating signals representative of the turbine speed and the turbine load and other turbine variables, a digital controller having means for generating a speed setpoint and means for generating a load setpoint, means for coupling the turbine speed and load signals and the other turbine variable signals to said digital controller on a periodic or demand basis, means for registering the coupled speed and load and other turbine variables in said digital controller, said digital controller including a speed control for periodically generating valve position outputs in response to the turbine speed and speed setpoint during turbine startup, said digital controller further including a load control for periodically generating valve position outputs in response to the turbine load and load setpoint during turbine load operation, means for continuously generating the valve position signals in response to the valve position outputs, said coupling means including means for generating contact signals representative of predetermined turbine variables and for scanning such signals on a predetermined basis for registration in said digital controller, said coupling means further including means for converting input analog signals to digital signals and for periodically scanning the digital signals for registration in said digital controller, an operator panel having switching means for generating control mode and control parameter signals, means for coupling the operator panel signals to said digital controller and for registering such signals in said digital controller, said speed and load controls having a plurality of control elements and mode switching means for determining which elements are operative in the functioning of the controls, means for controlling said mode switching means in response to the registered control mode panel signals and the registered turbine contact signals, said digital controller being embodied with a digital computer having monitor means for controlling the execution of said speed and load controls and other predetermined program elements in response to program run bids and in accordance with a predetermined priority system said synchronous generator output means including an auxiliary synchronizer which generates trigger outputs for speed and load control program execution for which periodic bids are placed for its own execution at a rate substantially more frequent than the rate at which the control program is to be executed, said monitor means placing a higher priority on execution of said auxiliary synchronizer than on said speed and load controls.

15. A steam turbine operating system as set forth in claim 14 wherein said auxiliary synchronizer also triggers said analog scan means at a rate faster than the execution rate for said speed and load controls and slower than the auxiliary synchronizer execution rate and wherein said monitor means places priorities on execution bids in the other auxiliary synchronizer, speed and load control, and analog scan.

16. A system for operating a steam turbine in an electric power plant, said system comprising an arrangement of throttle and governor valves for supplying steam to the turbine, means for actuating said valves to position said valves in accordance with valve position signals, means for generating signals representative of the turbine speed and the turbine load and other turbine variables, a digital controller having means for generating a speed setpoint and means for generating a load setpoint, means for coupling the turbine speed and load signals and the other turbine variable signals to said digital controller on a periodic or demand basis, means for registering the coupled speed and load and other turbine variables in said digital controller, said digital controller including a speed control for periodically generating valve position outputs in response to the turbine speed and speed setpoint during turbine startup, said digital controller further including a load control for periodically generating valve position outputs in response to the turbine load and load setpoint during turbine load operation, means for continuously generating the valve position signals in response to the valve position outputs, said coupling means including means for generating contact signals representative of predetermined turbine variables and for scanning such signals on a predetermined basis for registration in said digital controller, said coupling means further including means for converting input analog signals to digital signals and for periodically scanning the digital signals for registration in said digital controller, an operator panel having switching means for generating control mode and control parameter signals, means for coupling the operator panel signals to said digital controller and for registering such signals in said digital controller, said speed and load controls having a plurality of control elements and mode switching means for determining which elements are operative in the functioning of the controls, means for controlling said mode switching means in response to the registered control mode panel signals and the registered turbine contact signals, said speed and load controls including a proportional plus reset controller means for coupling said proportional plus reset controller to each of said control elements which require a proportional plus reset function when such contact elements are to be operated, means for uncoupling said proportional plus reset controller from each of the latter control elements when an output has been provided for each of such control elements, and means for registering the outputs from said proportional plus reset control for use in other operation of the speed and load controls.

* * * * *